US011313183B2

(12) United States Patent
Slack

(10) Patent No.: US 11,313,183 B2
(45) Date of Patent: Apr. 26, 2022

(54) AXIAL-LOAD-ACTUATED ROTARY LATCH RELEASE MECHANISMS FOR CASING RUNNING TOOLS

(71) Applicant: NOETIC TECHNOLOGIES INC., Edmonton (CA)

(72) Inventor: Maurice William Slack, Edmonton (CA)

(73) Assignee: Noetic Technologies Inc., Edmonton (CA)

( * ) Notice: Subject to any disclaimer, the term of this patent is extended or adjusted under 35 U.S.C. 154(b) by 0 days.

(21) Appl. No.: 17/294,048

(22) PCT Filed: Jan. 19, 2020

(86) PCT No.: PCT/CA2020/000003

§ 371 (c)(1),
(2) Date: May 14, 2021

(87) PCT Pub. No.: WO2020/146936

PCT Pub. Date: Jul. 23, 2020

(65) Prior Publication Data

US 2021/0355764 A1 Nov. 18, 2021

Related U.S. Application Data

(60) Provisional application No. 62/794,619, filed on Jan. 19, 2019.

(51) Int. Cl.

| | |
|---|---|
| ***E21B 19/16*** | (2006.01) |
| ***E21B 19/07*** | (2006.01) |
| ***E21B 23/00*** | (2006.01) |

(52) U.S. Cl.

CPC ..... *E21B 19/16* (2013.01); *E21B 19/07* (2013.01); *E21B 23/006* (2013.01)

(58) Field of Classification Search

CPC ..... E21B 19/07; E21B 19/16; E21B 23/006

See application file for complete search history.

(56) References Cited

U.S. PATENT DOCUMENTS 3,819,282 A * 6/1974 Schultz ..... B43K 25/026 401/105

7,909,120 B2 3/2011 Slack (Continued)

FOREIGN PATENT DOCUMENTS

WO 2019014747 A1 1/2019

OTHER PUBLICATIONS

International Search Report re PCT/CA2020/000003, issued by the ISA/CA dated Mar. 17, 2020.

(Continued)

*Primary Examiner* — Taras P Bemko
*Assistant Examiner* — Ronald R Runyan
(74) *Attorney, Agent, or Firm* — Donald V. Tomkins

(57) ABSTRACT

A rotary latch release mechanism includes axially-aligned upper and lower rotary latch components carried on and rotationally coupled to upper and lower latch assemblies, respectively. The latch release mechanism is movable from an axially-latched position to an axially-unlatched position in response to relative rotation between the upper and lower rotary latch components. The latch release mechanism has a movable land surface that acts in response to relative axial displacement, to induce the relative rotation required to release the latch. The latch release mechanism may be configured such that the axial movement of the movable land surface will cause the relative axial movement required to release the latch in combination with the required rotation. Accordingly, the rotary latch mechanism operates in response to externally-controlled axial movement of a mov- (Continued)

able land surface carried by the latch release mechanism, without requiring externally-induced rotation.

7 Claims, 37 Drawing Sheets

(56) References Cited

U.S. PATENT DOCUMENTS

| | | | |
|---|---|---|---|
| 8,424,939 | B2 | 4/2013 | Slack |
| 9,869,143 | B2 | 1/2018 | Slack |
| 2011/0100621 | A1 | 5/2011 | Slack |

OTHER PUBLICATIONS

Written Opinion of the International Searching Authority re PCT/CA2020/000003, completed by the ISA/CA on Mar. 17, 2020, and issued by the ISA/CA dated Apr. 23, 2020.
International Preliminary Report on Patentability (Chapter II), re PCT/CA2020/000003, issued by the IPEA/CA dated Apr. 21, 2021.

* cited by examiner

AXIAL-LOAD-ACTUATED ROTARY LATCH RELEASE MECHANISMS FOR CASING RUNNING TOOLS

FIELD

The present disclosure relates in general to devices and mechanisms for releasably latching two coaxially-positioned and mating rotary components such that relative axial displacement of the rotary components is prevented when in the latched position, but axial displacement is allowed when the rotary components are in the unlatched position.

BACKGROUND

Power tongs have for many years been used to "make up" (i.e., assemble) threaded connections between sections (or "joints") of tubing, and to "break out" (i.e., disassemble) threaded connections when running tubing strings into or out of petroleum wells, in coordination with the hoisting system of a drilling rig. Tubing strings typically comprise a number of tubing sections having externally-threaded ends, joined end-to-end by means of internally-threaded cylindrical couplers mounted at one end of each tubing section, forming what is commonly called the "box" end, while the other externally-threaded end of the tubing section is called the "pin" end. Such tubular strings can be relatively efficiently assembled or disassembled using power tongs to screw additional tubing sections into a tubing string during make-up operations, or to unscrew tubing sections from a tubing string being pulled from a wellbore (i.e., break-out operations).

However, power tongs do not simultaneously support other beneficial functions such as rotating, pushing, or fluid filling, after a pipe segment is added to or removed from the string, and while the string is being lowered or raised in the wellbore. Running tubulars with tongs, whether powered or manual, also typically requires the deployment of personnel in comparatively high-hazard locations such as on the rig floor and on so-called "stabbing boards" above the rig floor.

The advent of drilling rigs equipped with top drives has enabled another method of running tubing strings, and casing strings in particular, using tools commonly known as casing running tools or CRTs. These tools are configured to be carried by the top drive quill, and to grip the upper end of a tubing section and to seal between the bore of the tubing section and the bore of the top drive quill. In coordination with the top drive, CRTs support hoisting, rotating, pushing, and filling of a casing string with drilling fluid while running casing into a wellbore.

Ideally, these tools also support make-up and break-out operations traditionally performed using power tongs, thereby eliminating the need for power tongs entirely, with attendant benefits in terms of reduced system complexity and increased safety. As a practical matter, however, obtaining these benefits without negatively impacting running rate or consistency requires the time taken to make up connections using CRTs to be at least comparable to that required for the running rate and consistency achievable using power tongs. In addition, it is a practical reality that making up tubing strings using CRTs does increase the risk of damage to the connection threads, or to seals in so-called "premium connections" where these are present.

U.S. Pat. No. 7,909,120 (Slack) [the contents of which are incorporated herein in their entirety, in jurisdictions where so permitted] teaches a prior art CRT in the form of a gripping tool that includes a body assembly comprising:

- a load adaptor coupled for axial load transfer to the remainder of the body assembly, and adapted for structural connection to either a drive head or a reaction frame;
- a gripping assembly carried by the body assembly and having a grip surface, wherein the gripping assembly is provided with activating means to radially stroke or move the grip surface from a retracted position to an engaged position in which the grip surface tractionally engages either an interior surface or an exterior surface of a tubular workpiece in response to relative axial movement or axial stroke of the body assembly in at least one direction relative to the grip surface; and
- a linkage acting between the body assembly and the gripping assembly, wherein relative rotation of the load adaptor in at least one direction relative to the grip surface will result in axial displacement of the body assembly relative to the gripping assembly, so as to move the gripping assembly from the retracted position to the engaged position in accordance with the action of the actuation means.

For purposes of this patent document, a CRT configured for gripping an internal surface of a tubular workpiece will be referred to as a CRTi, and a CRT configured for gripping an external surface of a tubular workpiece will be referred to as a CRTe.

CRTs as taught by U.S. Pat. No. 7,909,120 utilize a mechanically-actuated gripping assembly that generates its gripping force in response to axial load with corresponding axial stroke, either together with or independently from externally-applied axial load and externally-applied torque load applied by either right-hand or left-hand rotation. These loads, when applied, are carried across the tool from the load adaptor of the body assembly to the grip surface of the gripping assembly, in tractional engagement with the workpiece.

Additionally, such CRTs or gripping tools may be provided with a latch mechanism acting between the body assembly and the gripping assembly, in the form of a rotary J-slot latch having a hook-and-receiver arrangement acting between first and second latch components, where the first latch component is carried by the body assembly and the second latch component is carried by the grip assembly (for example, see FIGS. 1 and 14 in U.S. Pat. No. 7,909,120, showing the latch in externally-gripping and internally-gripping full-tool assemblies respectively, and also FIGS. 4-7 in U.S. Pat. No. 7,909,120, describing how mating latch teeth 108 and 110 act as a hook and receiver with respect to each other).

When in a first (or latched) position, with the hook in the receiver, this latch prevents relative axial movement between the body assembly and the gripping assembly so as to retain the grip mechanism in a first (or retracted) position. However, relative rotation between the body assembly and the gripping assembly (which rotation is typically resisted by some amount of torque, which will be referred to herein as the "latch actuation torque") will move the mating hook and receiver components to a second (or unlatched) position, thereby allowing relative axial movement between the body assembly and the gripping assembly, with associated movement of the grip surface into the second (or engaged) position. Accordingly, when in the latched position, this latch mechanism will support operational steps that require the gripping assembly to be held in its retracted position, to enable positioning of the tool relative to the workpiece preparatory to engaging the grip surface, and conversely retaining the grip surface in its retracted position enabling separation of the CRT from the workpiece.

Operationally, achieving this relative movement where the CRT is attached to the top drive quill requires the development of sufficient reaction torque, through tractional engagement when the "land surface" of the CRT is brought into contact with the upper end of a tubular workpiece and axial "set-down" force is applied, to resist the latch actuation torque arising from the rotation applied to move the latch into the unlatched position (typically arranged as right-hand rotation) and to cause axial movement if required (i.e., to move the hook up the "slot" of a J-slot). Any operational step moving the latch from the latched position to the unlatched position is said to "trigger" the tool, thus allowing the tool to be "set".

To re-latch, this same requirement for sufficient tractional resistance between the tool's land surface and the workpiece must be met, with the applied torque direction reversed (i.e., typically left-hand rotation) to "un-set" the tool. For mechanically-set CRTs such as in U.S. Pat. No. 7,909,120, the tractional resistance required to re-latch is less than that required to unlatch.

U.S. Pat. No. 9,869,143 (Slack) [the contents of which are incorporated herein in their entirety, in jurisdictions where so permitted] discusses how it may be difficult in some applications to achieve sufficient tractional resistance between the land surface of a CRT and a workpiece, such as in cases where both the CRT land surface and the contact face of the workpiece are smooth steel, particularly when rotating to release the latch in such tools. U.S. Pat. No. 9,869,143 teaches means for increasing the effective friction coefficient acting between the workpiece and tool under application of compressive load (i.e., the ratio of tractional resistance to applied load). While these teachings disclose effective means for managing this operational variable and thus reducing operational uncertainty, operation of the tool still requires the steps of first setting down a somewhat controlled amount of axial load and then applying rotation with the top drive to move the latch into its unlatched position. Therefore, when the CRT is used to for make-up operations, the time, load, and rotation control to carry out these steps on certain rigs may result in slower cycle times than achievable using power tongs for make-up.

Tubing sections in a tubing string are typically oriented "pin down, box up". Accordingly, during make-up operations, the upper end of the uppermost section in the string, as supported by rig floor slips or a "spider", presents as "box up" in the so-called "stump" into which the pin end of the next tubing section (i.e., workpiece) is stabbed. When using a CRT for make-up, it may be difficult to control the amount of top drive "set-down" load on the stabbed pin and similarly the amount of rotation applied with set-down load present, introducing the possibility of the undesirable situation where the pin end of the workpiece is rotated in the box in the stump before the pin-end and box-end threads are properly engaged, with the attendant risk of galling damage to the threads. While these risks can be ameliorated by careful control of the top drive by the driller, they contribute to both additional uncertainty and increased cycle time.

Accordingly, there is a need for methods and means for reducing the risk of thread damage when using CRTs for make-up, and for providing greater assurance of cycle times comparable to or less than cycle times achievable using power tongs for make-up and other aspects of casing running operations.

SUMMARY OF THE DISCLOSURE

In general terms, the present disclosure teaches non-limiting embodiments of a rotary latch mechanism (alternatively referred to as a trigger mechanism) comprising upper and lower latch assemblies, plus a latch release mechanism comprising an upper rotary latch component carried on and rotationally coupled to the upper latch assembly, and a lower rotary latch component carried on and rotationally coupled to the lower latch assembly. The upper and lower rotary components are configured to move from a first (or axially-latched) position to a second (or axially-unlatched) position in response to rotation of the lower rotary component relative to the upper rotary component in a first (or unlatching) direction. Such rotation induces the development of an associated latch actuation torque.

The latch release mechanism has a movable land element (alternatively referred to as a "cushion bumper") which carries a downward-facing land surface that acts in response to relative axial displacement to urge relative rotation between the upper and lower rotary latch components, so as to exert the latch actuation torque required to move the latch components from the latched position to the unlatched position. Where needed for latch configurations requiring both relative axial compression movement and rotation (such as commonly required for a J-slot latch), the mechanism may be configured such that the axial movement of the movable land element will cause the relative axial movement required to release the latch in combination with the required rotation. Accordingly, exemplary embodiments in accordance with the present teachings are directed to means for inducing the rotation and latch actuation torque required to move the component forming a rotary latch from the latched position to the unlatched position using externally-controlled axial movement of a movable land element carried by the latch release mechanism, without requiring externally-induced rotation sufficient to move the mechanism from the latched position to the unlatched position.

Latch release mechanisms as disclosed herein eliminate the need for externally-applied rotation after applying set-down force when using a tool such as a mechanical CRT that employs a J-latch type mechanism to move from a first (latched) to a second (unlatched) position, by transforming relative axial movement between the tubular workpiece and a component of the tool so as to produce the relative rotation needed to release the latch. This enables a mechanical CRT equipped with such a latch release mechanism (or trigger mechanism) to produce comparable or shorter cycle times with reduced risk of connection thread damage while running casing, as compared to using power tongs for such operations.

In one aspect, the present disclosure teaches embodiments of a rotary latch release mechanism comprising:

- an upper latch assembly and a lower latch assembly, said upper and lower latch assemblies being in axial alignment;
- an upper rotary latch component carried on and rotationally coupled to the upper latch assembly, and a lower rotary latch component carried on and rotationally coupled to the lower latch assembly;
- a bumper element defining a downward-facing land surface, with the bumper element being coupled to the lower latch assembly so as to be both axially movable and rotationally movable relative to the lower latch assembly; and
- a trigger element coupled to the bumper element and the lower latch assembly so as to be movable at least axially relative to the bumper element, and so as to be axially and rotationally movable relative to the lower latch assembly;

wherein:

the upper and lower rotary latch components are configured to move from an axially-latched position to an axially-unlatched position in response to relative rotation between the upper and lower rotary latch components in a first rotational direction;

the upper latch assembly defines one or more downward-facing trigger reaction dog pockets; and the trigger element defines one or more upward-facing trigger dog teeth configured for engagement with the one or more trigger reaction dog pockets of the upper latch assembly;

such that when the one or more trigger dog teeth are disposed within the one or more trigger reaction dog pockets, an upward force applied to the land surface of the bumper element will tend to cause relative axially-upward displacement of the bumper so as to urge rotation of the lower latch assembly, wherein the trigger element acts between the bumper element and through engagement with the trigger dogs with the upper latch assembly so as to force relative rotation between upper and lower latch components to induce axial disengagement of the upper and lower rotary latch components, whereupon continued application of the upward force and resultant axial and rotary displacement of the bumper element relative to the lower latch assembly will cause withdrawal of the trigger dog teeth from the trigger dog reaction pockets.

The rotary latch release mechanism may include a first axially-oriented biasing means acting between the upper and lower latch assemblies so as to bias the latch release mechanism toward the latched position, and a second axially-oriented biasing means acting between the movable bumper element and the trigger element so as to bias the bumper element axially downward relative to the trigger element.

The upper latch assembly may define a downward-facing upper ramp surface that is matingly engageable with an upward-facing lower ramp surface defined by the lower latch assembly, such that the application of an upward force to the land surface of the bumper element will bring the upper and lower ramp surfaces into sliding engagement so as to constrain the relative axial approach of the upper and lower latch assemblies while allowing relative rotation between the upper and lower latch assemblies.

In another aspect, the present disclosure teaches embodiments of a rotary latch release mechanism acting between (1) a generally cylindrical main body having a main body bore, and (2) a generally cylindrical load adaptor coaxially disposed within the main body bore and both axially and rotatably movable therein, with a lower end of the load adaptor being operatively engageable with an axial-load-actuated latching linkage disposed within the main body. In one embodiment, the latch release mechanism comprises:

a load adaptor extension coaxially mounted to an upper region of the load adaptor and having a lower portion forming a skirt defining a first annular space between the load adaptor extension and an outer cylindrical surface of the load adaptor;

a primary trigger element having a primary trigger bore, in which:

an upper portion of the primary trigger element is coaxially disposed within said first annular space, and is mounted to and carried by the skirt so as to be axially and rotationally movable relative to the skirt within defined constraints;

a lower portion of the primary trigger element extends over an upper region of the main body and is axially movable relative thereto; and the primary trigger element carries a downward-facing primary trigger reaction surface;

a secondary trigger element coaxially disposed within a secondary annular space defined by the skirt and the primary trigger element, wherein:

the secondary trigger element is mounted to and carried by the skirt so as to be axially movable, within defined constraints, relative to the skirt, but non-rotatable relative to the skirt; and the secondary trigger element is coupled to the primary trigger element so as to be axially and rotationally movable relative to the primary trigger element within defined constraints;

a secondary trigger extension having a secondary trigger extension bore and being coaxially mounted to a lower end of the secondary trigger element;

a main body extension coaxially and fixedly mounted to an outer cylindrical surface of the main body, said main body extension having a cylindrical upper portion coaxially disposed within the secondary trigger extension bore, wherein:

the inner and outer diameters of the cylindrical upper portion of the main body extension substantially correspond to the inner and outer diameters of the primary trigger element;

the cylindrical upper portion of the main body extension defines an upward-facing first reaction surface (alternatively referred to herein as an "upward-facing dog reaction surface") configured for mating engagement with the primary trigger reaction surface;

an external shoulder defining an upward-facing second reaction surface is provided on a lower region of the main body extension;

the main body extension is axially movable relative to, and is co-rotatable with, the secondary trigger extension; and the lower end of the secondary trigger extension is configured to be engageable with the second reaction surface.

In this embodiment, the primary and secondary trigger elements are configured such that axial compressive load applied to the load adaptor will be reacted by contact and engagement of the first reaction surface with the primary trigger reaction surface and the second reaction surface with the secondary trigger extension, causing corresponding axial displacement between the load adaptor and the main body, thereby inducing rotation and axial movement of the secondary trigger element relative to the primary trigger element, thus generating torque and corresponding rotation to unlatch the latching linkage.

Optionally, in alternative embodiments, a plurality of primary trigger dog teeth each comprising a primary trigger dog tooth load flank, a primary trigger dog tooth crest, and a primary trigger dog tooth lock flank, may be provided on the downward-facing reaction surface on the primary trigger element, with a corresponding plurality of mating reaction dog pockets, each defining a reaction pocket load flank, a reaction pocket crest, and a reaction pocket lock flank, being provided on the upward-facing dog reaction surface provided on the main body extension.

Several exemplary embodiments of latch release mechanisms in accordance with the present disclosure are described below, in the context of use with a CRT utilizing a J-latch to retain the grip surface of the CRT in its retracted position, and providing means for triggering the J-latch by application of set-down load without requiring the application of external rotation and latch actuation torque through the load adaptor.

Embodiment #1—Rotary Cushion Bumper Reacted by Casing Friction (Both CRTi and CRTe)

Embodiment #1 relies on tractional resistance to react latch actuation torque. In this embodiment, the latch release mechanism is carried by the lower latch assembly (comprising the grip assembly of a CRT), and has a movable land element (or cushion bumper) with a generally downward-facing land surface adapted for tractional engagement with the upper end of a tubular workpiece. Upward axial compressive movement of the movable land element relative to the lower rotary latch component, in response to contact with a tubular workpiece, causes the latch release mechanism to rotate the lower rotary latch component relative to the upper rotary latch component in the unlatching direction.

The latch release mechanism is further provided with biasing means (such as but not limited to a spring), for biasing the land surface to resist axial compressive displacement relative to the lower rotary latch component, correspondingly producing tractional resistance to rotary sliding between the land surface and the tubular workpiece. Thus arranged, with the upper and lower rotary latch components initially in the axially-latched position, and with the upper latch assembly (comprising the body assembly of a CRT) supported through the load adaptor to resist rotation relative to the tubular workpiece, axial compressive movement transmitted through the load adaptor to the upper rotary latch component relative to the tubular workpiece tends to urge rotation (as well as axial compressive stroke, if required) of the lower rotary latch component relative to the upper rotary latch component, and where tractional resistance between the land surface and the tubular workpiece is sufficient to exceed the latch actuation torque, the axial compressive movement causes rotation relative to the upper rotary latch component to move the lower rotary latch component to the unlatched position.

Embodiment #2—Frictional Trigger Acting Between a Floating Load Adaptor and Main Body: CRTe with Stroke Embodiment #2, like Embodiment #1, relies on tractional resistance to react latch actuation torque. In this embodiment, the upper latch assembly has a load adapter slidingly coupled to a main body to carry axial load while still allowing axial stroke. The upper rotary latch component is axially carried by the main body, but is rotationally coupled to the load adaptor. The lower latch assembly is carried by and is rotationally coupled to the main body, while allowing axial sliding, over at least some range of motion, when in the unlatched position. The lower latch assembly is further configured to carry a land surface for contact with a tubular workpiece to support set-down loads and to provide tractional resistance to rotation.

The latch release mechanism is carried by a selected one of the load adaptor and the main body, and has a generally axially-facing movable clutch surface adapted for tractional engagement with an opposing reaction clutch surface on the other of the load adaptor and the main body. Axial compressive stroking movement of the latch release mechanism after contact and engagement of the movable clutch surface with the reaction clutch surface, as urged by set-down force applied to the load adaptor, causes the latch release mechanism to urge rotation between the load adaptor and the main body in the unlatching direction. The latch release mechanism is further provided with biasing means (such as but not limited to a spring), for biasing the movable clutch surface to resist axial compressive displacement relative to the component on which it is carried (i.e., either the load adaptor or the main body), correspondingly producing tractional resistance to rotary sliding between the contacting movable clutch surface and the reaction clutch surface (or clutch interface).

Thus arranged, with the upper and lower rotary latch components initially in the axially-latched position, and with the load adaptor supported to generally allow free rotation relative to the main body and hence the tubular workpiece, axial compressive movement within the axial stroke allowance of the load adaptor relative to the main body tends to urge rotation (and axial compressive stroke, if required) of the upper rotary latch component relative to the lower rotary latch component. Where the tractional resistance of the clutch interface is sufficient to exceed the latch actuation torque (and perhaps some external resistance torque of the generally freely-rotating load adaptor), the axial compressive movement induces rotation of the upper rotary latch component relative to the lower rotary latch component to move to the unlatched position.

Where free rotation of the load adaptor is inhibited, the rotation urged by set-down load tends to urge sliding at the clutch interface and at the land-to-workpiece interface. The corresponding torque induced at these two interfaces, upon application of sufficient set-down load, will thus tend to induce sliding on one interface or the other. If sliding occurs on the land-to-workpiece interface, the rotation necessary to release the latch will occur. However, if sliding occurs at the clutch interface, then relative rotation of the latch components will not occur, rendering the latch release mechanism ineffective for its intended purpose in these particular circumstances. It may therefore be advantageous to provide means for increasing the torsional resistance of the clutch interface to increase the effective tractional resistance under application of axial load, such as by providing these mating surfaces as conically-configured surfaces to increase the normal force driving rotational tractional resistance, for a given axial load. Such modifications may be provided in the absence of or in combination with contouring or other surface treatments for increasing frictional resistance.

However, in all cases where it is desired to allow for re-latching, the tractional resistance to rotation occurring at the clutch interface will tend to impede the relative rotation of upper and lower rotary latch components if set-down load is required to effect re-latching. For certain applications it may be possible to reliably control the tractional response of these two interfaces by providing a selected combination of biasing spring force, contact surface geometry, and surface treatment of the clutch and land-to-workpiece surfaces, in coordination with load control sufficient to reliably prevent clutch interface slippage in support of latch release rotation for a first compressive load, while simultaneously allowing clutch interface slippage without resultant land-to-workpiece slippage to support re-latching, for a second selected compressive load in combination with applied rotation.

As described above, Embodiments #1 and #2 rely on the presence of sufficient tractional engagement between contacting components for reliable unlatching with set-down movement. In Embodiment #1, the only limiting tractional resistance is between the tubular workpiece and the cushion bumper, with the additional constraint that the latch actuation torque is further resisted by external support carrying the upper latch assembly. To state this otherwise, relative rotation between the upper rotary latch component and the tubular workpiece must be largely prevented (at least in the unlatching direction) to support grip engagement without externally-applied rotation.

In Embodiment #2, sufficient tractional resistance of the clutch interface is required, typically with the added constraint of free rotation of the load adaptor of the upper latch assembly. For applications where these boundary conditions can be readily and reliably met, Embodiments #1 and #2 can provide the benefits of faster cycle times and reduced risk of connection thread damage, plus the benefit of comparative mechanical simplicity. However, for applications where these boundary conditions cannot be readily achieved, means can be provided for releasing a J-latch independent of available tractional resistance or control of top drive rotation, as in alternative embodiments described below.

Embodiment #3—Latch Release Mechanism Adapted for "Base Configuration": CRTs Incorporating a Latching Tri-Cam Assembly Embodiment #3 is configured to force relative rotation of the upper and lower rotary latch components through the latch release mechanism. In this embodiment:

- the upper rotary latch component is rigidly carried by a main body of the upper latch assembly;
- the lower rotary latch component is rotationally and axially constrained and carried by the lower latch assembly, which acts in coordination with the main body to prevent relative rotary and axial movement when the upper and lower rotary latch components are latched;
- the latch release mechanism acts between the upper and lower latch assemblies and comprises four main elements, as follows:
  - a latching tri-cam assembly as disclosed in International Publication No. WO 2010/006441 (Slack) and in U.S. Pat. No. 8,424,939 [the contents of which are incorporated herein in their entirety, in jurisdictions where so permitted];
  - a trigger reaction ring having one or more downward-facing reaction dog pockets rigidly attached to the upper latch assembly;
  - a trigger element carried by the lower latch assembly and having one or more upward-facing trigger dog teeth generally mating and interacting with the downward-facing reaction dog pockets; and
  - a movable land element also carried by the lower latch assembly, and provided with a generally downward-facing land surface adapted for axial compressive engagement with the upper end of a tubular workpiece.

The movable land element and the trigger element are coupled to each other and to the lower latch assembly such that upward axial compressive movement or stroke of the movable land element relative to the lower latch assembly from a first (or land) position to a second (or fully-stroked) position, as urged by contact with a tubular workpiece, will urge rotation and downward axial movement of the trigger dog teeth. Initially, rotation of the trigger dog teeth is prevented by interaction with the reaction dog pockets which causes rotation of the lower rotary latch component relative to the upper rotary latch component to their unlatched position, and when the movable land element is fully stroked, the trigger dog teeth are fully retracted and disengaged from the reaction dog pockets. The retraction of the trigger dog teeth from the reaction dog pockets supports re-latching under application of external rotation in the re-latching direction. This embodiment preferably includes biasing means tending to resist both the axial compression of the movable land element and the retraction of the trigger element, so that the land and trigger elements return to their initial positions upon unloading and withdrawal from the tubular workpiece.

Embodiment #4—Retracting Trigger Acting Between a Floating Load Adaptor and Main Body: CRTe with Stroke Embodiment #4, like Embodiment #3, is configured to force relative rotation of the upper and lower rotary latch components through the latch release mechanism. In this embodiment:

- the upper latch assembly includes a load adapter, coupled to a main body so as to carry axial load while allowing axial stroke;
- the upper rotary latch component is axially carried by the main body but is rotationally coupled to the load adaptor;
- the lower latch assembly (comprising the grip assembly of a CRT) is carried by and rotationally coupled to the main body while permitting axial movement, over at least some range of motion, when the latch is in its unlatched position; and
- the lower latch assembly is further configured to carry a land surface for contact with a tubular workpiece:
  - to support set-down loads;
  - to enable relative rotation between the lower latch assembly and the upper latch assembly by sliding at the contact with the workpiece if the load adaptor resists rotation during set-down due to restrictions imposed by the top drive; and
  - to enable moving from the unlatched to the latched position by providing tractional resistance to rotation.

The latch release mechanism is configured to act between the sliding load adaptor and main body, and, similar to Embodiment #3, comprises three main elements:

- reaction dog pockets carried by a selected one of the load adaptor and the main body;
- a primary trigger element having trigger dog teeth; and
- a secondary trigger element carried by the other of the load adaptor and the main body.

In the following discussion, it is assumed that the reaction dog pockets are upward-facing and are carried by the main body, and that the primary trigger element (having downward-facing trigger dog teeth) and the secondary trigger element (having a downward-facing standoff surface) are carried by the load adaptor. When the tool is in the latched position, the trigger dog teeth and the reaction dog pockets are configured for aligned engagement upon downward axial sliding movement of the load adaptor through its axial stroke, as urged by contact with a tubular workpiece.

An upward-facing reaction surface is also provided with the reaction dog pockets, and therefore is rigidly carried by the main body and arranged to contact the downward-facing standoff surface at an axial stroke position lower than required for engagement of the trigger dog teeth with the reaction dog pockets. The secondary trigger element and the primary trigger element are coupled to each other and to the load adaptor assembly such that downward axial compressive movement or stroke of the standoff surface relative to the load adaptor from a first (land) position to a second (fully-stroked) position, as urged by contact with a tubular workpiece, will urge both rotation and upward axial movement of the trigger dog teeth.

Initially, rotation of the trigger dog teeth is prevented by interaction with the reaction dog pockets, which causes rotation of the lower rotary latch component relative to the upper rotary latch component to their unlatched position, and when the secondary trigger element is fully stroked, the trigger dog teeth will be fully retracted and disengaged from the reaction dog pockets, and this retraction of the trigger dog teeth will support re-latching under application of external rotation in the re-latching direction. This embodiment preferably includes biasing means tending to resist both axial compression of the secondary trigger element and retraction of the primary trigger element, such that upon unloading and withdrawal from the tubular workpiece, the primary and secondary trigger elements return to their initial positions.

To further support reverse rotation under set-down load as needed to effect re-latching, the secondary trigger element may be provided as a secondary trigger assembly comprising a secondary trigger extension, having a downward-facing standoff surface, threaded to the secondary trigger element but rotationally keyed to the main body such that rotation in the direction of unlatching tends to move the standoff surface lower, causing compressive engagement of the standoff surface and the reaction surface at axially-higher positions, which prevents the premature engagement of the trigger dog teeth with the reaction dog pockets until the rotational position for re-latching has been reached.

BRIEF DESCRIPTION OF THE DRAWINGS

Embodiments will now be described with reference to the accompanying Figures, in which numerical references denote like parts, and in which.

DETAILED DESCRIPTION

Figure 1:
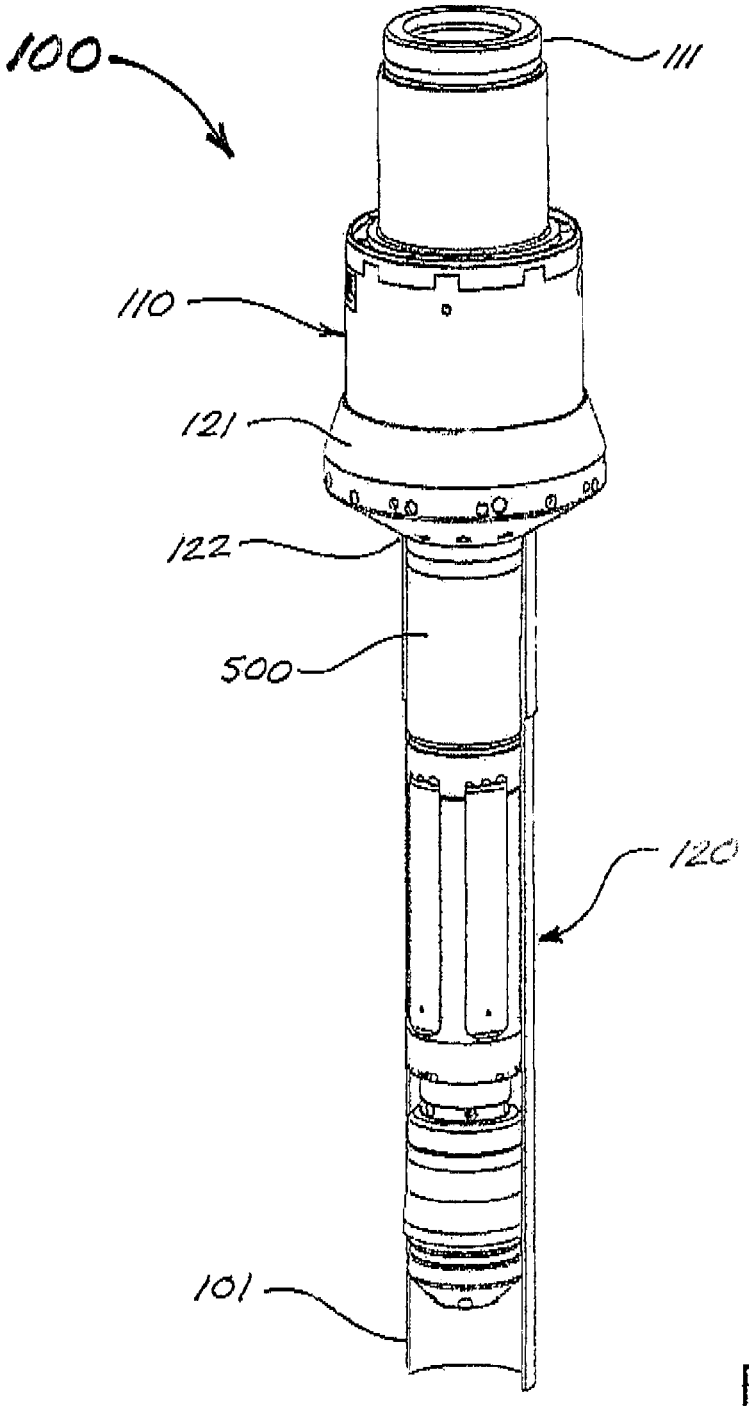
FIG. 1 (Prior Art)
FIG. 1 illustrates a prior art internally-gripping casing running tool (CRTi) essentially corresponding to that shown in FIGS. 48 and 49 of U.S. Pat. No. 8,424,939.

FIG. 1 illustrates a prior art internally-gripping CRT 100 essentially corresponding to the CRTi shown in FIGS. 48 and 49 of U.S. Pat. No. 8,424,939. CRT 100 includes a body assembly 110, a grip assembly 120, and a cage 500 linked to grip assembly 120. CRT 100 is shown in FIG. 1 as it would appear in the latched position and inserted into a tubular workpiece 101 (shown in partial cutaway). In this latched position, relative axial movement between body assembly 110 and grip assembly 120 is prevented, such that grip assembly 120 is held in its retracted position.

The upper end of body assembly 110 is provided with a load adaptor 111, illustrated by way of non-limiting example as having a conventional tapered-thread connection 112 for structural connection to a top drive quill (not shown) of a drilling rig (not shown). Grip assembly 120 includes a land surface 122 carried by a fixed bumper 121 rigidly attached to cage 500 of grip assembly 120. As described in U.S. Pat. No. 8,424,939 (but not shown herein), body assembly 110 carries an upper rotary latch component, and grip assembly 120 carries a lower rotary latch component, which is linked to cage 500 so as to be generally fixed against rotation and axial movement relative to cage 500 when in the latched position, but configured for rotary movement to an unlatched position in response to typically right-hand rotation of body assembly 110 relative to grip assembly 120, with the latch actuation torque corresponding to this rotary movement being reacted by tractional engagement of land surface 122 with tubular workpiece 101.

Figure 2A:
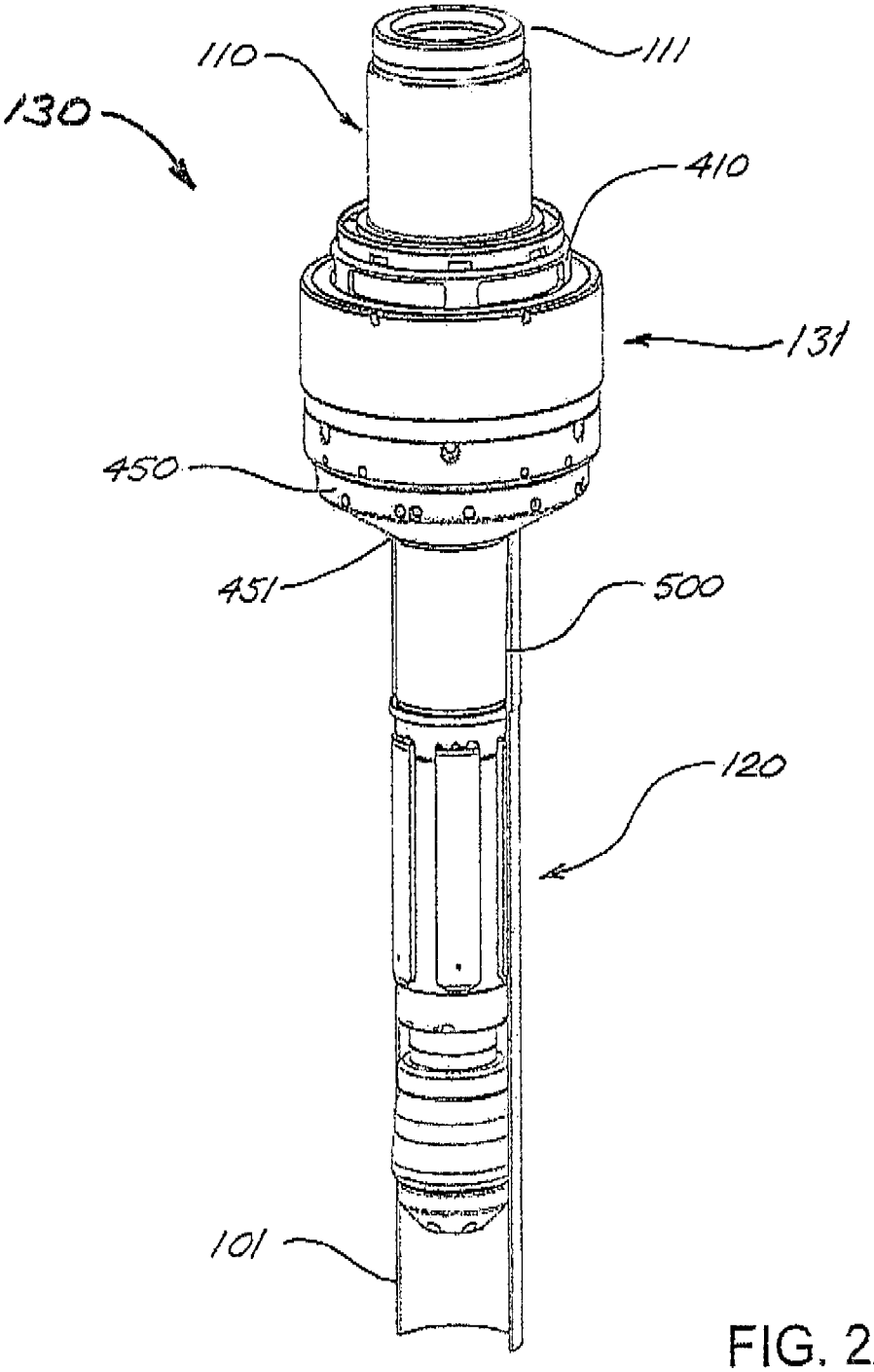
FIGS. 2A and 2B, respectively, are isometric and sectional views of a prior art CRTi as in FIG. 1, fitted with an embodiment of a latch release mechanism in accordance with the present disclosure.

FIG. 2A illustrates a CRTi 130 generally corresponding to CRT 100 in FIG. 1, but modified to incorporate an embodiment of a rotary latch release mechanism (alternatively referred to herein as a trigger mechanism) in accordance with the present disclosure. CRTi 130 is shown in FIG. 2A as it appears in the latched position. In this particular embodiment, CRTi 130 includes a latch release mechanism 201 (schematically illustrated in figures that follow) comprising:

an upper rotary latch component provided in the form of a trigger reaction ring 204 rigidly carried by body assembly 110, and having one or more downward-facing trigger reaction dog pockets 205, with each trigger reaction dog pocket 205 being generally defined by a reaction pocket load flank 206, a reaction pocket crest 207, and a reaction pocket lock flank 208;

a trigger element 210 having one or more upward-facing trigger dog teeth 211, with each trigger dog tooth 211 being generally defined by a trigger dog tooth load flank 212, a trigger dog tooth crest 213, and a trigger dog tooth lock flank 214, wherein each trigger dog tooth 211 engages a corresponding trigger reaction dog pocket 205 when latch release mechanism 201 is in the latched position as shown in FIG. 2A; and a movable bumper 218 having a movable land surface 220, wherein trigger element 210 and movable bumper 218 are carried by a lower rotary latch component provided in the form of a cage extension 222 rigidly coupled to cage 500.

Cage extension 222, trigger element 210, and movable bumper 218 are generally configured as a coaxially-nested group of closely-fitting cylindrical components, where relative rotary and translational movements between these components are constrained to keep them coaxially aligned, but also linked by cam pairs in the manner of cam followers and cam surfaces as described later herein.

FIGS. 3A and 3B, FIGS. 4A and 4B, FIGS. 5A and 5B, FIGS. 6A and 6B, and FIGS. 7A and 7B schematically illustrate the operative relationships of the various components of latch release mechanism 201, at sequential stages of the operation of latch release mechanism 201. Although latch release mechanism 201 is a three-dimensional rotary assembly, in order to facilitate a clear understanding of the structure and operation of latch release mechanism 201, the basic components of latch release mechanism 201 are shown in FIGS. 3A to 7B in a generally two-dimensional schematic manner, with the tangential (rotary) direction being transposed into the horizontal direction, and with the axial direction being transposed into the vertical direction.

Figure 3A:
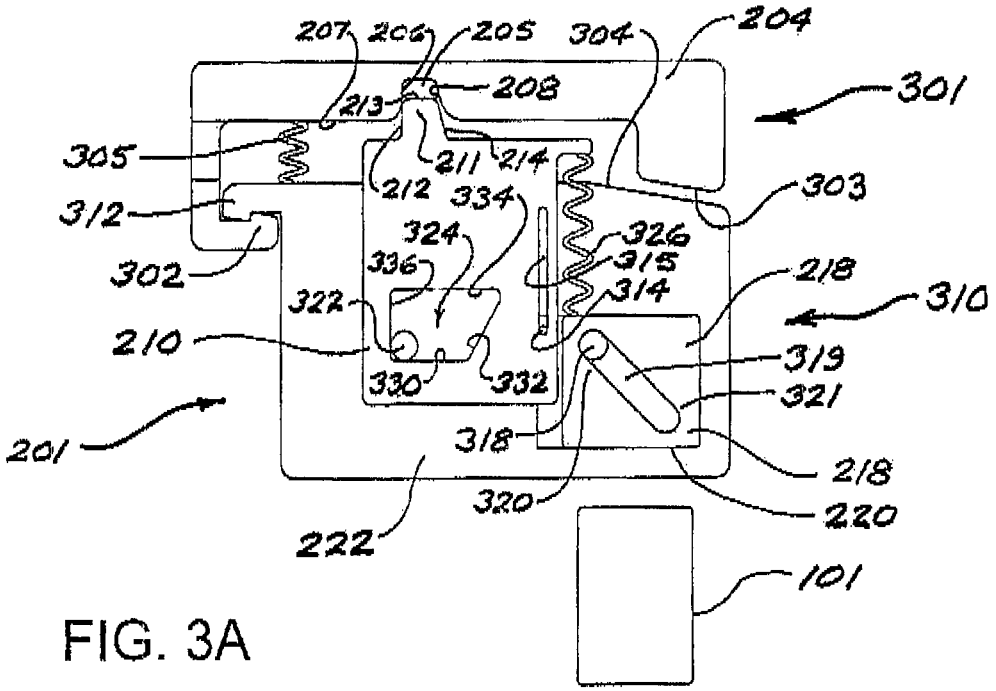
FIGS. 3A and 3B, respectively, are schematic elevation and isometric views of an exemplary embodiment of a latch release mechanism in accordance with the present disclosure, shown in the latched and unloaded position.
Figure 3B:
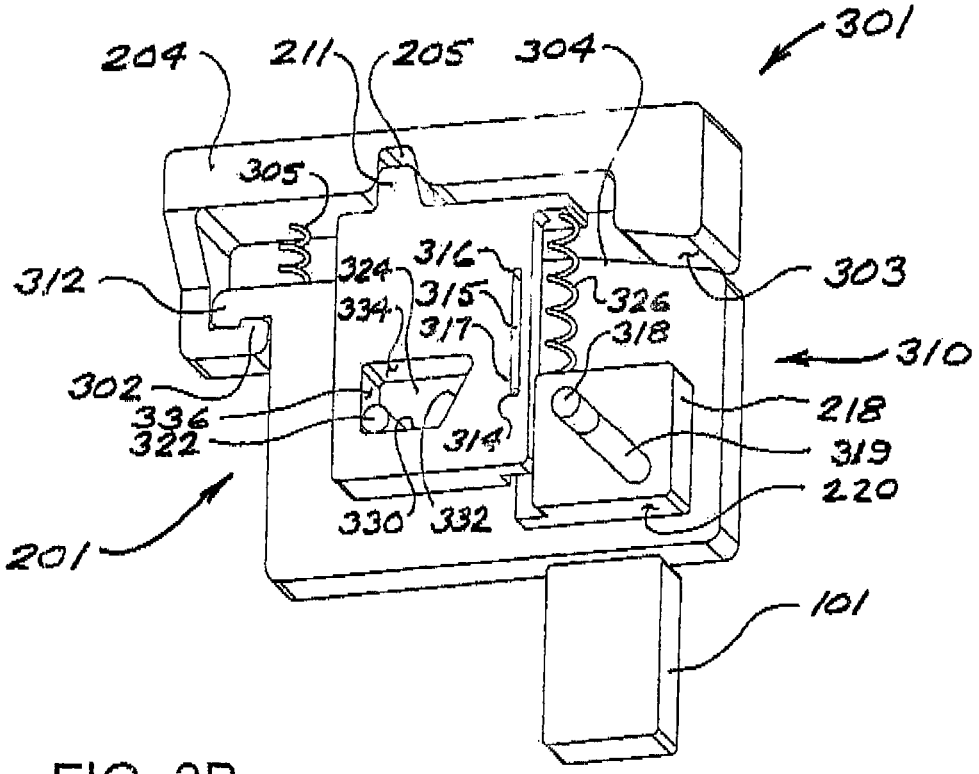

FIGS. 3A and 3B illustrate latch release mechanism 201 in relation to a schematically-represented CRT, still in the fully-latched position, with a schematically-represented tubular workpiece 101 disposed slightly below movable bumper 218. Reference number 301 represents an upper latch assembly rigidly coupled to body assembly 110 of the CRT, and having a trigger reaction dog pocket 205 and an upper rotary latch receiver 302. Reference number 310 represents a lower latch assembly comprising a cage extension 222 incorporating a lower rotary latch hook 312 shown in the latched position relative to upper rotary latch receiver 302. Upper latch assembly 301 carries an internal upper cam ramp surface 303, shown nearly in contact with an internal lower cam ramp surface 304 on cage extension 222, with an internal biasing spring 305 disposed and acting between body assembly 110 and cage extension 222. These features are shown to represent the internal reactions and forces operative between body assembly 110 and grip assembly 120 of the CRT, to facilitate an understanding the functioning of the CRT in coordination with latch release mechanism 201.

Cage extension 222 carries a movable bumper 218 having a movable land surface 220 and a trigger element 210. Movable bumper 218 is linked to trigger element 210 by a bumper-trigger cam follower 314 rigidly fixed to movable bumper 218 and movable within an axially-oriented bumper-trigger cam slot 315 (having an upper end 316 and a lower end 317) formed in trigger element 210, such that movable bumper 218 is axially movable relative to trigger element 210. A bumper-cage cam follower 318, rigidly fixed to cage extension 222, is constrained to move within a bumper-cage cam slot 319 formed in movable bumper 218 (with bumper-cage cam slot 319 having an upper end 320 and a lower end 321); and a trigger-cage cam follower 322, rigidly fixed to cage extension 222, is constrained to move within a trigger-cage cam pocket 324 provided in trigger element 210.

Notwithstanding the particular and exemplary arrangement of the components of the latch release mechanism 201 as described above and illustrated in FIGS. 3A and 3B, it will be apparent to persons skilled in the art that the choice of fixing the cam follower to one or the other of two components to be paired, and the cam profile in the other, is arbitrary with respect to the relative movement constraint, and corresponding freedom, associated with such a mechanism. Similarly, the choice of cam follower/cam surface as the means for providing the desired movement constraint is not intended to be in any way limiting. Persons skilled in the art will readily understand that generally equivalent mechanisms can be provided in other forms without departing from the intended scope of the present disclosure.

In the illustrated embodiment, bumper-trigger cam slot 315 is provided as an axially-oriented slot, closely fitting with the diameter of the associated bumper-trigger cam follower 314, and thus having a single degree of freedom to permit only relative axial sliding movement between trigger element 210 and movable bumper 218 but not relative rotation, with a trigger bias spring 326 being provided to act between trigger element 210 and movable bumper 218, in the direction of axial sliding, to bias movable bumper 218 downward relative to trigger element 210. Bumper-cage cam slot 319 is sloped at a selected angle relative to the vertical (shown by way of non-limiting example in FIGS. 3A and 3B as approximately 45 degrees) and is closely-fitting with the diameter of the associated bumper-cage cam follower 318 to provide a single degree of freedom linking relative axial movement of movable bumper 218 to rotation of cage extension 222. However, free movement of trigger-cage cam follower 322 is permitted within the trapezoidal trigger-cage cam pocket 324, constrained only by contact against cam constraint surfaces defining the perimeter of trigger-cage cam pocket 324, as follows:

- a trigger advance cam surface 330, defining a horizontal lower edge of trigger-cage cam pocket 324;
- a trigger withdraw cam surface 332, defining a sloped right-side edge of trigger-cage cam pocket 324, sloped at a selected angle from the vertical;
- a trigger re-latch cam surface 334, defining a horizontal upper edge of trigger-cage cam pocket 324; and
- a trigger reset cam surface 336, defining a vertical left-side edge of trigger-cage cam pocket 324.

During typical operations, the operative status of latch release mechanism 201 may be characterized with reference to the position of trigger-cage cam follower 322 within trigger-cage pocket 324, as follows:

- Start position: with trigger-cage cam follower 322 proximal to the intersection of trigger reset cam surface 336 and trigger advance cam surface 330 (as seen in FIGS. 3A, 3B, 4A, and 4B);
- Advanced position: with trigger-cage cam follower 322 proximal to the intersection of trigger advance cam surface 330 and trigger withdraw cam surface 332 (as in seen FIGS. 5A and 5B);
- Withdrawn position: with trigger-cage cam follower 322 proximal to the intersection of trigger withdraw cam surface 332 and trigger re-latch cam surface 334; and
- Reset position: with trigger-cage cam follower 322 proximal to the intersection of trigger re-latch cam surface 334 and trigger reset cam surface 336.

When latch release mechanism 201 is in the latched position (as shown in FIGS. 3A and 3B), bumper-cage cam follower 318 is positioned toward upper end 320 of bumper-cage cam slot 319, and trigger-cage cam follower 322 is urged toward the start position within trigger-cage cam pocket 324 by trigger bias spring 326. At the same time, trigger bias spring 326 maintains the engagement of trigger dog tooth 211 within trigger reaction dog pocket 205, which engagement can position trigger dog tooth lock flank 214 in close opposition with reaction pocket lock flank 208 of trigger reaction dog pocket 205, as in this illustrated embodiment, so as to prevent accidental rotation of upper latch assembly 301 relative to lower latch assembly 310 as controlled by the selection of the mating flank angle and gap, where a more vertically-inclined angle is selected to more strongly resist rotation for a given trigger bias spring 326 force.

It will be apparent that upper rotary latch receiver 302 and lower rotary latch hook 312 (configured as a J-slot requiring axial displacement) already provides some protection against accidental rotation. However, for the type of J-latch typically employed in CRTs where axial displacement is not required and unlatching with only torque is allowed, the trigger dog tooth lock flank 214 and mating reaction pocket lock flank 208 provide the additional benefit of protection against accidental rotation.

In actual operation of the rotary latch release mechanism, the contact force reacted by tubular workpiece 101 against movable land surface 220 tends to build as CRTi 130 is lowered. However, as a matter of convenience for purposes of illustration in FIGS. 3A to 7B, upper latch assembly 301 will be considered as the datum, with tubular workpiece 101 being viewed as tending to move upward relative to upper latch assembly 301, and correspondingly tending to urge movable land surface 220 upward (rather than downward as in actual operation).

Figure 4A:
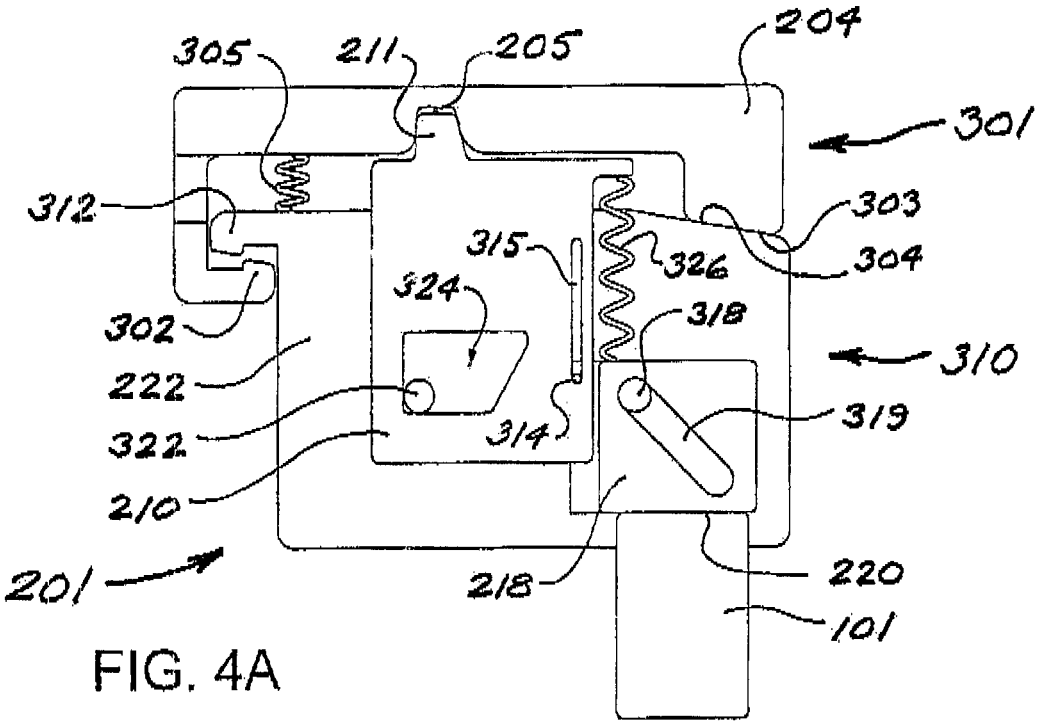
FIGS. 4A and 4B, respectively, are schematic elevation and isometric views of the latch release mechanism in FIGS. 3A and 3B, shown after application of axial load causing axial movement to initiate a latch release sequence.
Figure 4B:
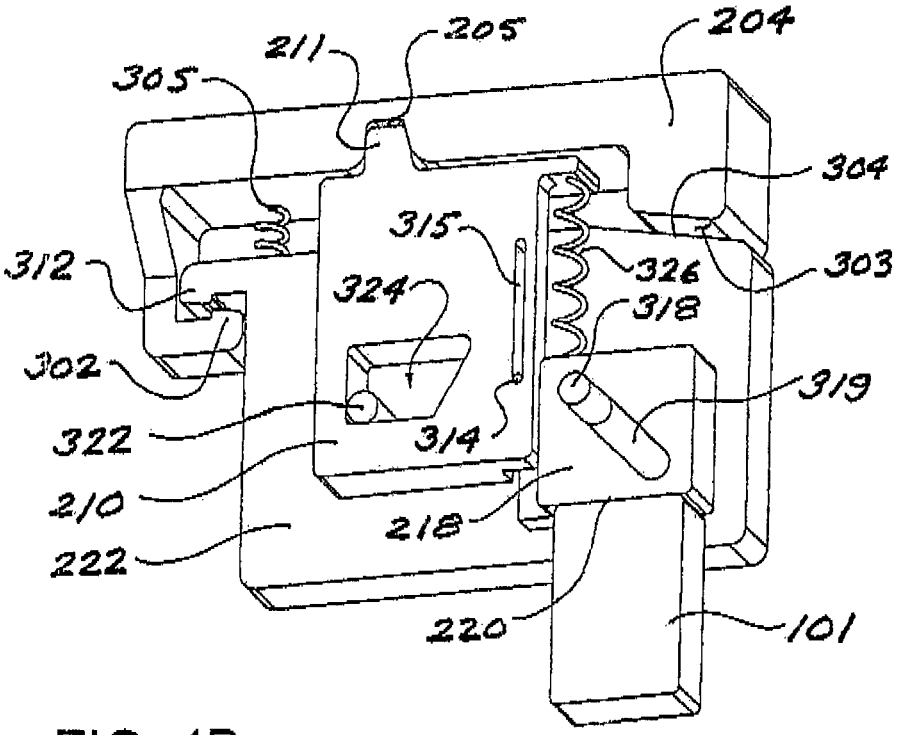

Referring now to FIGS. 4A and 4B, where the force of trigger bias spring 326 is sufficient to prevent relative movement between the components of latch release mechanism 201, force applied to movable land surface 220 will be transmitted through to cage extension 222, with upward movement being resisted until the force of internal biasing spring 305 is overcome, resulting in upward movement of the entire lower latch assembly 310, and correspondingly moving lower rotary latch hook 312 axially upward relative to upper rotary latch receiver 302. This upward movement is restricted by contact between internal upper cam ramp surface 303 and internal lower cam ramp surface 304, as illustrated in FIGS. 4A and 4B.

While such upward movement causing axial separation of lower rotary latch hook 312 from upper rotary latch receiver 302 is not a required movement for the type of J-latch typically employed for all CRTs, as will be known to persons skilled in the art, mating lower rotary latch hook 312 and upper rotary latch receiver 302 can alternatively be configured to disengage in response to applied torque only.

Figure 5A:
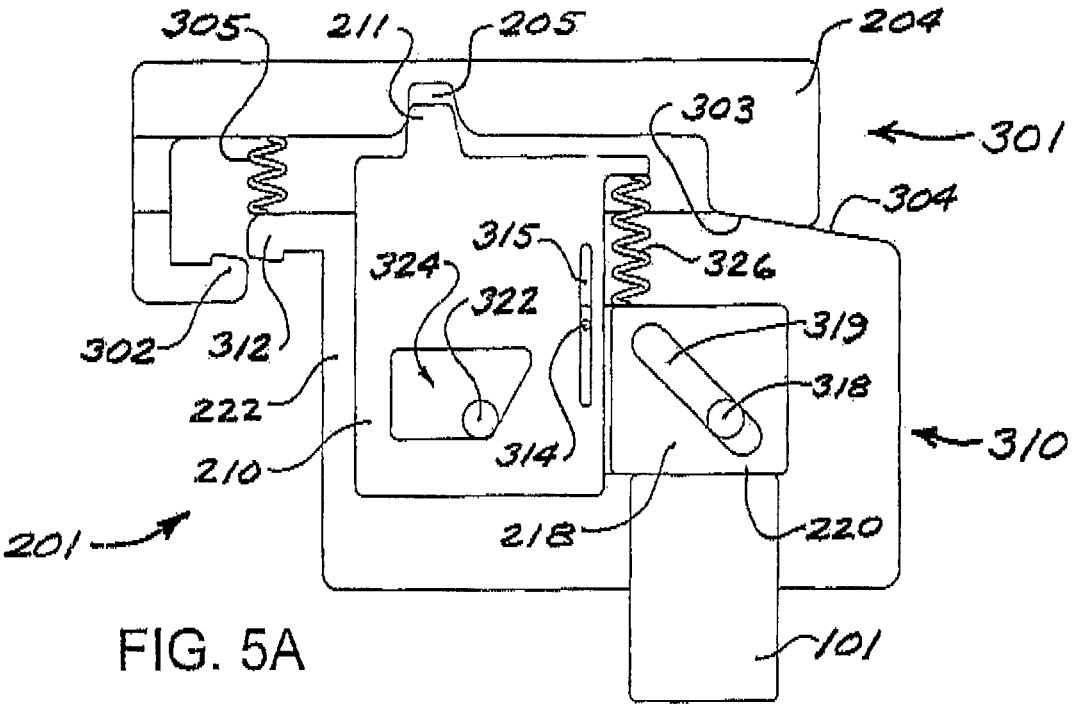
FIGS. 5A and 5B, respectively, are schematic elevation and isometric views of the latch release mechanism in FIGS. 3A and 3B, shown after application of axial load to stroke the latch release mechanism so as to cause rotary movement sufficient to release the latch.
Figure 5B:
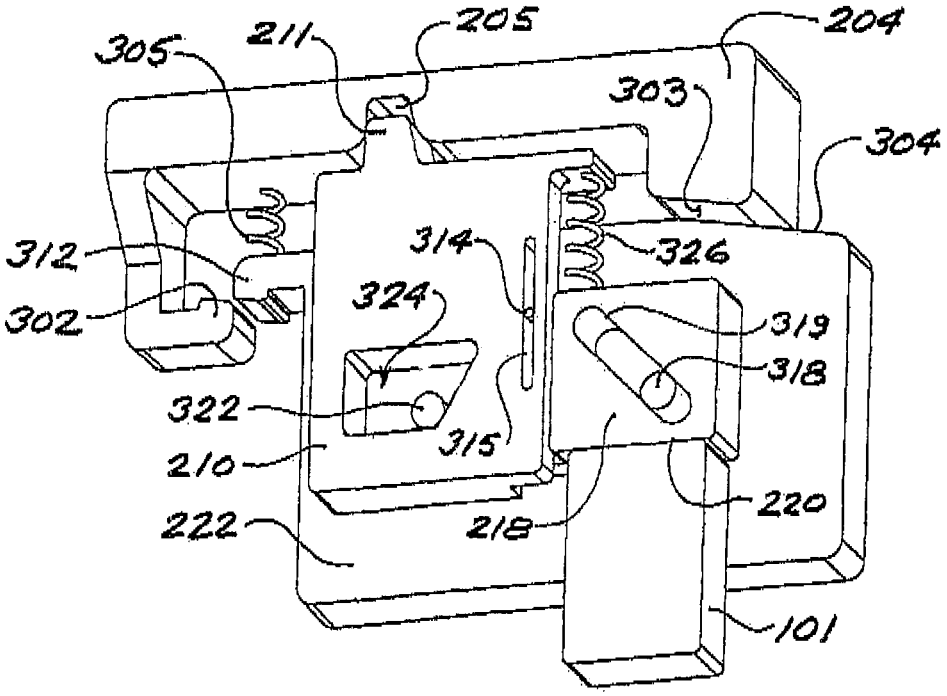

Independent of whether the applied load is first sufficient to overcome the force of the internal biasing spring 305, when sufficient force is applied by tubular workpiece 101 to overcome the force of trigger bias spring 326, movable bumper 218 will move upward, causing bumper-cage cam follower 318 to move downward within sloped bumper-cage cam slot 319, as shown in FIGS. 5A and 5B. The upward movement of movable bumper 218 tends to cause rotation of cage extension 222, but such rotation is resisted by the actuation torque acting between upper latch assembly 301 and lower latch assembly 310. This torque is transferred through movable bumper 218 to trigger element 210 via bumper-cage cam follower 318 and cam slot 319, and through trigger dog tooth load flank 212 to reaction pocket load flank 206 and thence back to upper latch assembly 301, thus internally reacting the latch actuation torque and causing trigger-cage cam follower 322 to move along trigger advance cam surface 330 to the advanced position within trigger-cage cam pocket 324, thus moving the rotary latch to its unlatched position as shown in FIGS. 5A and 5B. This movement is illustrated as right-hand rotation of upper latch assembly 301 relative to lower latch assembly 310.

Figure 6A:
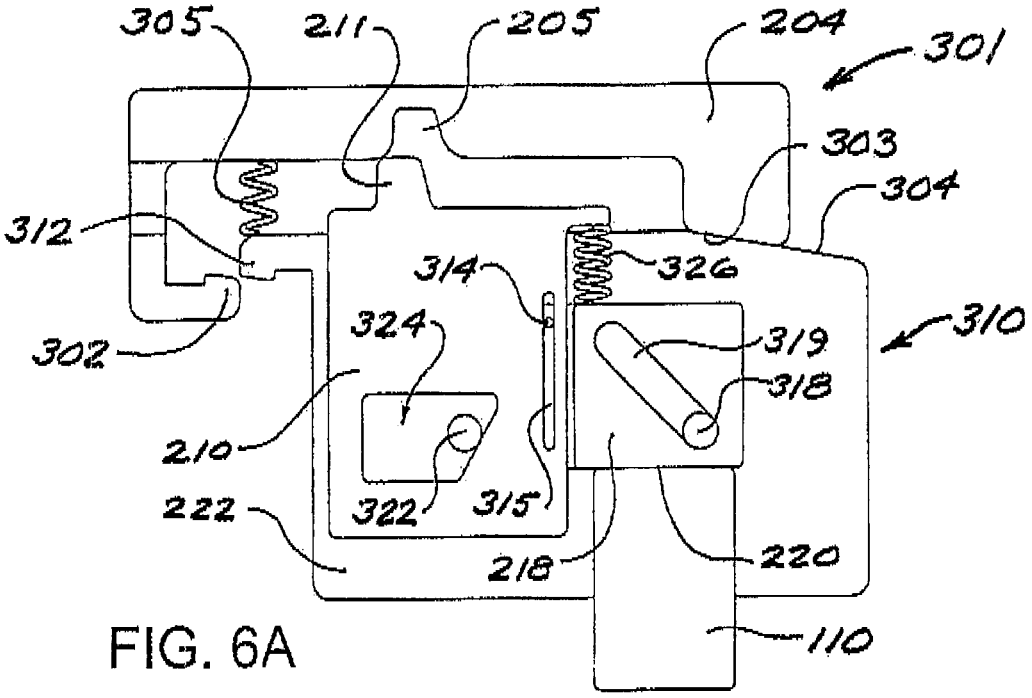
FIGS. 6A and 6B, respectively, are elevation and isometric views of the latch release mechanism in FIGS. 3A and 3B, shown after application of axial load to stroke the latch release mechanism so as to cause axial movement sufficient to withdraw the latch.
Figure 6B:
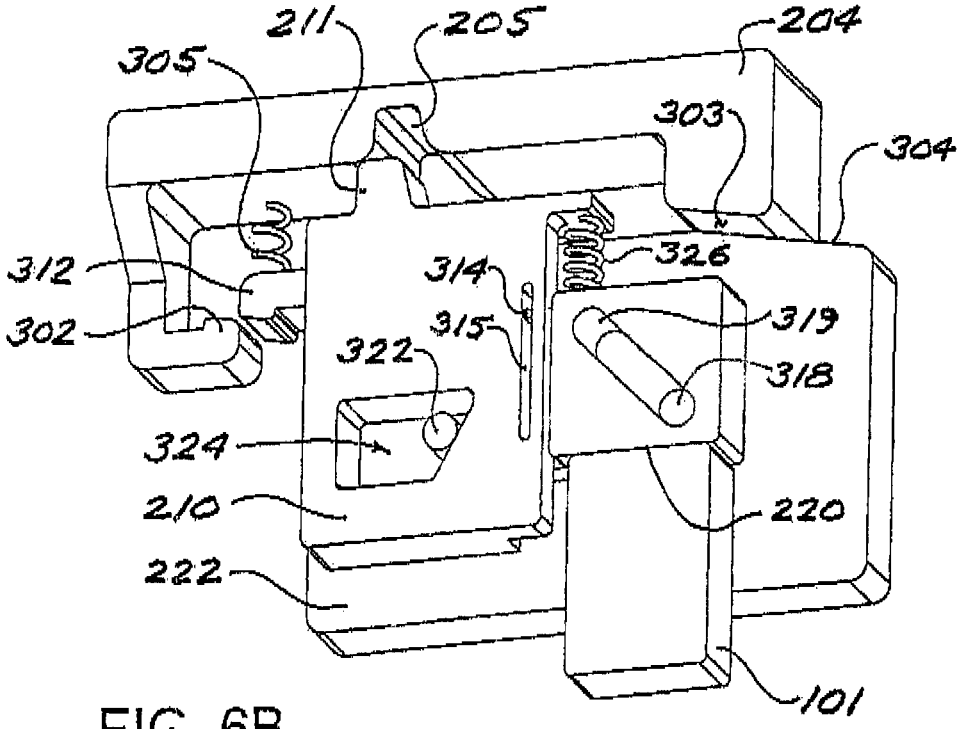

As may be understood with reference to FIGS. 6A and 6B, further upward movement of movable bumper 218 continues to urge rotation of cage extension 222, causing: (1) movement of trigger-cage cam follower 322 to the withdrawn position within trigger-cage cam pocket 324, (2) resultant downward movement of trigger element 210, and (3) corresponding withdrawal of trigger dog tooth 211 from engagement with trigger reaction dog pocket 205. The slope angle of trigger withdraw cam surface 332 of trigger-cage cam pocket 324 is selected relative to the orientation of bumper-cage cam slot 319 to promote the withdrawal of trigger dog tooth 211 without jamming or otherwise inducing excess force considering the operative trigger bias spring 326 force and frictional forces otherwise tending to affect the withdrawal movement. Furthermore, it will be apparent that with trigger element 210 withdrawn from trigger reaction ring 204, upper latch assembly 301 is free to rotate relative to the lower latch assembly 310, and, more specifically, allows left-hand rotation of upper latch assembly 301 relative to lower latch assembly 310 to re-latch the tool.

This rotation supports movement of lower rotary latch hook 312 into engagement with upper rotary latch receiver 302 (i.e., the latched position), with corresponding actuation torque being resisted by tractional engagement of movable land surface 220 with tubular workpiece 101. In general, though, the portion of the set-down load carried by contact between internal upper cam ramp surface 303 and internal lower cam ramp surface 304, as a function of the associated cam ramp angle, tends to require less tractional engagement for this re-latching movement than required for unlatching in tools having different types of latch release mechanisms.

Figure 7A:
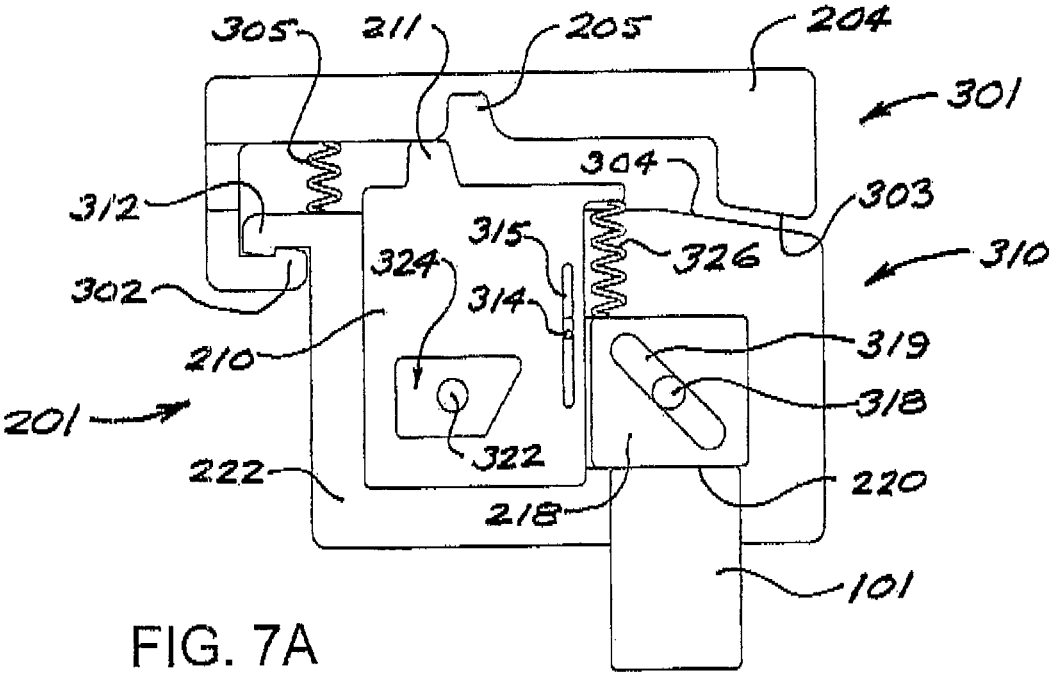
FIGS. 7A and 7B, respectively, are elevation and isometric views of the latch release mechanism in FIGS. 3A and 3B, shown after rotation to re-latch the latch, and after sufficient reduction of axial load to partially reset the latch release mechanism.
Figure 7B:
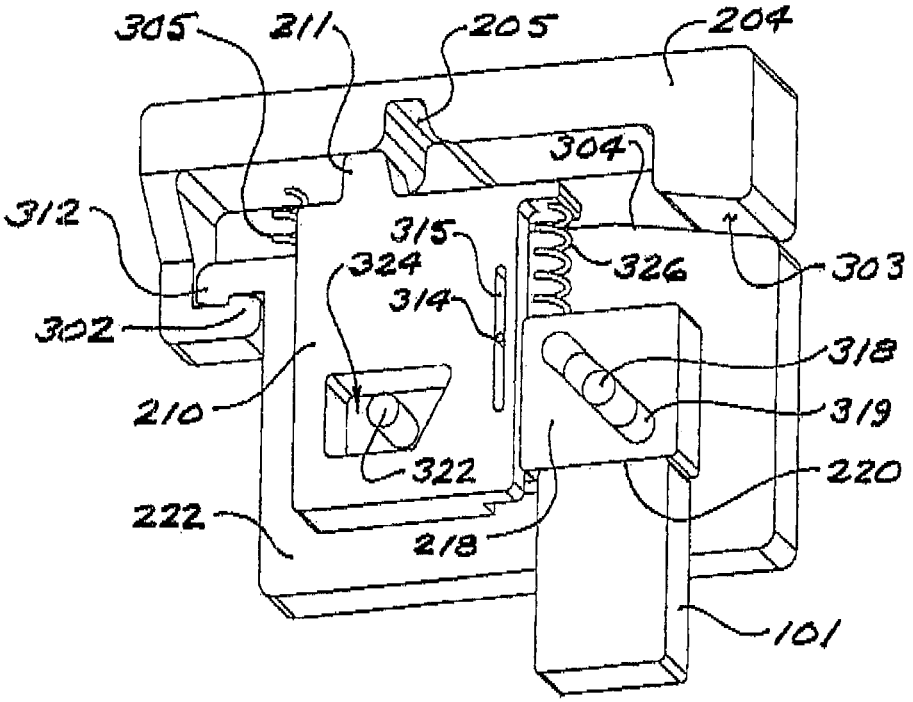

Referring now to FIGS. 7A and 7B, it will be seen that as the operational step to remove the tool from tubular workpiece 101 causes a reduction of the upward axial force acting on movable land surface 220, trigger bias spring 326 urges movable bumper 218 downward and correspondingly causes rotation of movable bumper 218 relative to cage extension 222, possibly with associated sliding at the interface between movable land surface 220 and tubular workpiece 101, and resultant tractional frictional force acting in the direction to maintain latching. This movement of movable bumper 218 and the force from trigger bias spring 326 tend to urge trigger element 210 to reverse the withdrawal movement just described, moving trigger dog tooth 211 upward. However, this upward movement is prevented when trigger dog tooth crest 213 slidingly engages reaction pocket crest 207, forcing trigger-cage cam follower 322 to move from the withdrawn position toward the reset position within trigger-cage cam pocket 324.

As movable bumper 218 continues to move downward, following the movement of tubular workpiece 101, a point is reached where trigger dog tooth crest 213 no longer engages (i.e., slides off) reaction pocket crest 207, thereby allowing trigger-cage cam follower 322 to move from the reset position and back toward the start position within trigger-cage cam pocket 324, thus returning latch release mechanism 201 to the operational state shown in FIGS. 3A and 3B, in which the tool is once again ready to initiate the operational sequence illustrated in FIGS. 3A and 3B through 7A and 7B.

CRTi Embodiment

Figure 2B:
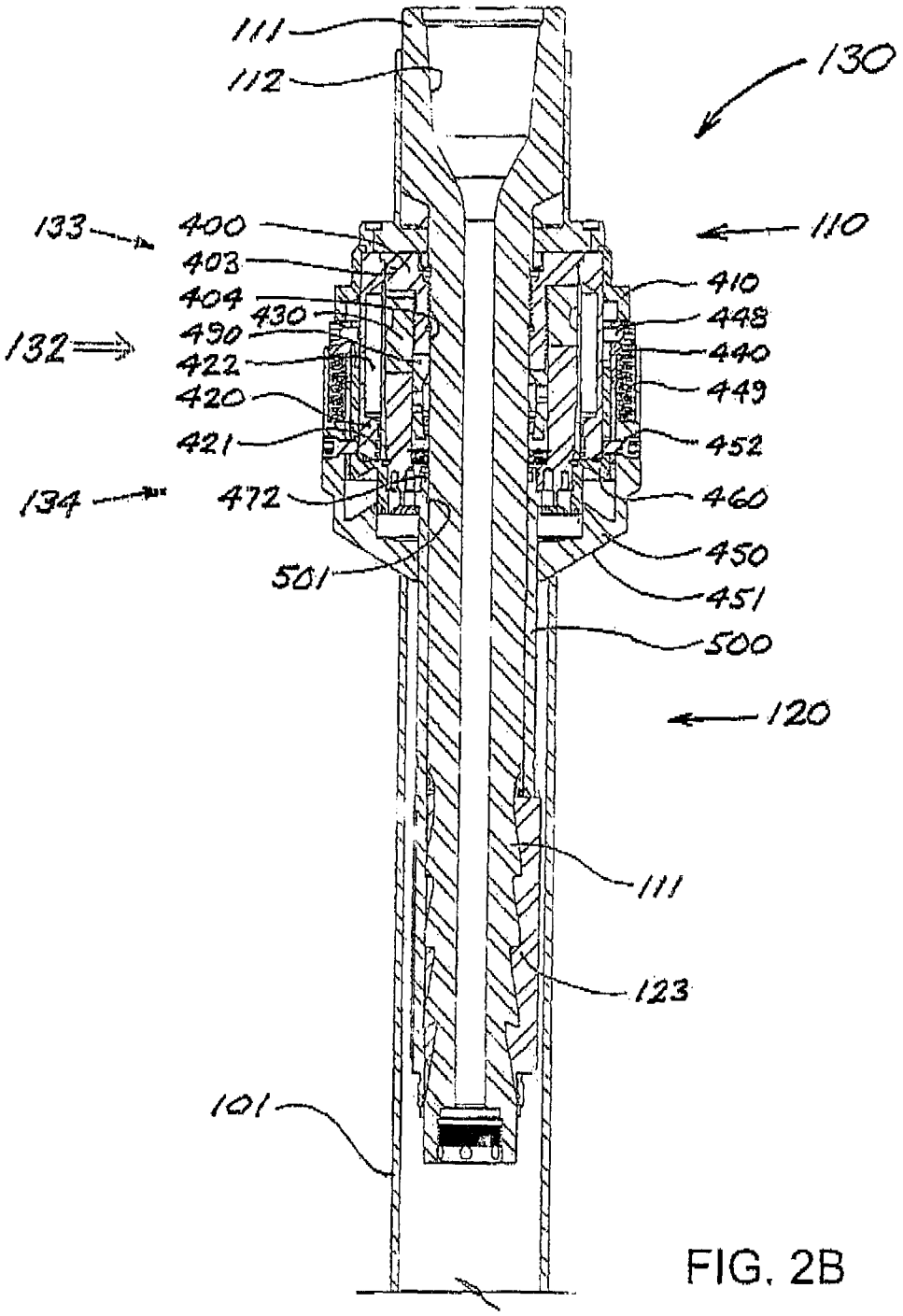

FIG. 2B illustrates a CRTi 130 modified to incorporate an exemplary embodiment of a latch release mechanism 131 in accordance with the present disclosure, and a tri-cam latching linkage 132 generally as disclosed in U.S. Pat. No. 8,424,939. FIGS. 8A and 8B, FIGS. 9A and 9B, FIGS. 10A and 10B, and FIGS. 11A and 11B illustrate sequential operational stages of latch release mechanism 131.

In the embodiment illustrated in FIG. 2B, modified CRTi 130 comprises a body assembly 110 incorporating a load adaptor 111 for structural connection to the top drive quill of a drilling rig (not shown), a grip assembly 120 comprising a cage 500 and jaws 123, latch release mechanism 131, and tri-cam latching linkage 132. Tri-cam latching linkage 132 comprises an upper latch assembly 133 fixed to and carried by body assembly 110, and a lower latch assembly 134 fixed to and carried by grip assembly 120.

Figure 8A:
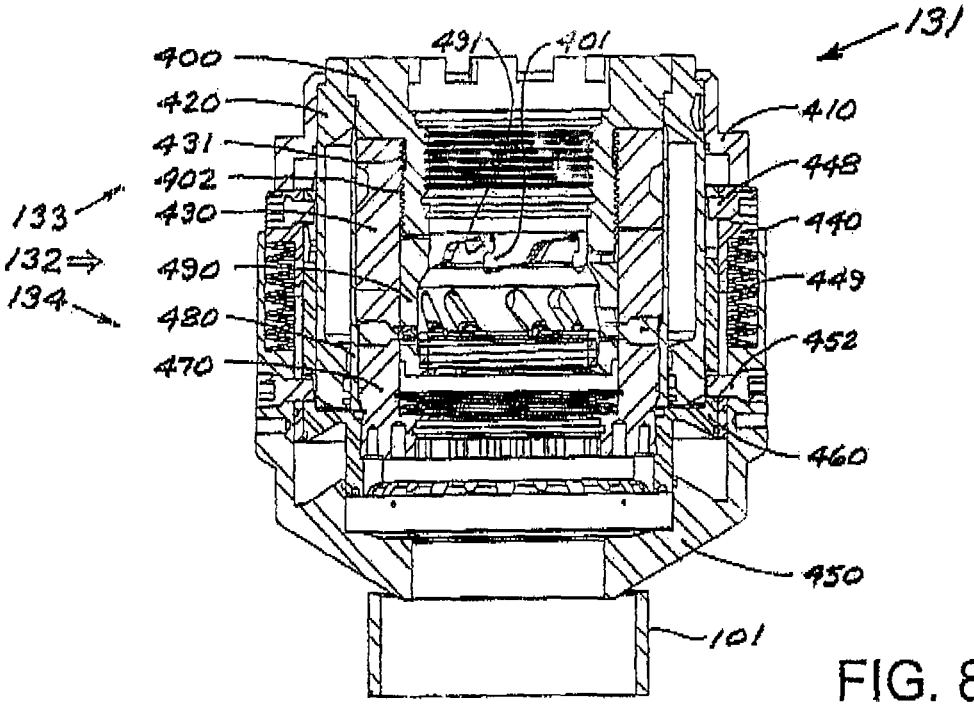
FIG. 8A is a cross-section through the tri-cam latching linkage and latch release mechanism of the modified CRTi tool in FIGS. 2A and 2B, shown in the latched and unloaded position.

As illustrated in FIG. 8A, latch release mechanism 131 includes an upper latch assembly 133 comprising a drive cam body 400 carrying a plurality of drive cam latch hooks 401, and a drive cam housing 420, with drive cam body 400 being rigidly constrained to body assembly 110 of CRTi 130. Latch release mechanism 131 further includes a lower latch assembly 134 comprising a driven cam body 470, a driven cam housing 480, and a latch cam 490, with latch cam 490 having a plurality of latch cam latch hooks 491, and being rigidly constrained to grip assembly 120 of CRTi 130. Tri-cam latching mechanism 132 also includes an intermediate cam body 430 having load threads 431 on the inside surface that engage with load threads 402 on the outside surface of drive cam body 400.

A drive cam body-housing seal 403, a drive cam body-mandrel seal 404, a drive housing-driven housing seal 421, a drive cam body-cage seal 472, and a cage mandrel seal 501 define an annular piston area and a gas spring chamber 422. When pressurized with a gas, gas spring chamber 422 forms an internal gas spring that tends to urge the separation of upper latch assembly 133 and lower latch assembly 134, thereby tending to urge separation of body assembly 110 and grip assembly 120 to move latch release mechanism 131 between a first (unlatched) position and a second (latched) position. Such separation is resisted by matingly-engageable drive cam latch hooks 401 and latch cam latch hooks 491, which can be disengaged by the application of sufficient right-hand torque (i.e., latch actuation torque) and corresponding right-hand rotation of body assembly 110 relative to grip assembly 120. Tri-cam latching linkage 132 is considered to be in the latched position when drive cam latch hooks 401 and latch cam latch hooks 491 are engaged, and in the unlatched position when drive cam latch hooks 401 and latch cam latch hooks 491 are disengaged.

Figure 8B:
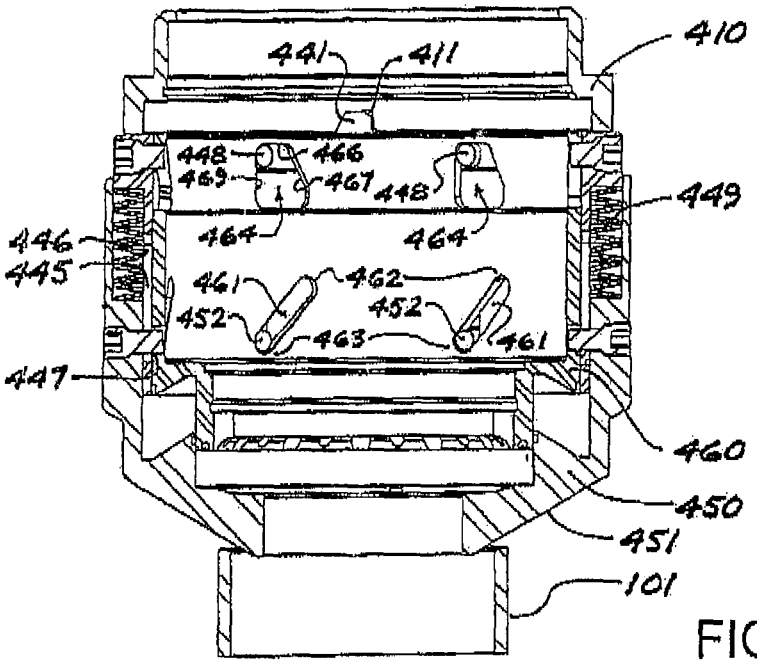
FIG. 8B is a cross-section through the latch release mechanism of the modified CRTi tool in FIGS. 2A and 2B, shown in the latched and unloaded position.

The following section details a mechanism that can be employed to use only axial compression and corresponding axial displacement to generate the right-hand torque and rotation required to unlatch the tri-cam latching linkage 132, having reference to FIG. 8B, which is a cross-section through latch release mechanism 131 shown in the latched position. For purposes of the discussion of this mechanism, the body assembly 110 will be considered as the datum, and the tubular workpiece 101 will be viewed as tending to move upward.

As illustrated in FIG. 8B, latch release mechanism 131 comprises a trigger reaction ring 410 fixed to body assembly 110, a trigger element 440, a trigger bias spring 449, a movable bumper 450 having a movable land surface 451, a bumper cam follower 452, and a cage extension 460 fixed to grip assembly 120. The components of latch release mechanism 131 and tri-cam latching linkage 132 are generally configured as a coaxially-nested group of closely-fitting cylindrical components, with relative rotary and translational movements between these components being constrained to first maintain them in coaxial alignment.

In operation, CRTi 130 with latch release mechanism 131 would first be inserted or "stabbed" into tubular workpiece 101 and lowered until movable land surface 451 contacts tubular workpiece 101, and the contact force resulting from tool weight and set-down load applied by the top drive (not shown) increases above the "trigger set-down load", at which point latch release mechanism 131 has applied the required latch actuation torque and the displacement required to disengage drive cam latch hooks 401 and latch cam latch hooks 491. The gas spring will cause axial displacement of body assembly 110 relative to grip assembly 120, transitioning CRTi 130 with latch release mechanism 131 from the retracted position to the engaged position. This operational sequence differs from prior art CRT 100 in two ways:

First, CRTi 130 with latch release mechanism 131 does not require externally-applied right-hand rotation to transition between the retracted and engaged positions, which simplifies the operational procedure.

Second, latch release mechanism 131 is designed such that it does not rely on tractional engagement between movable land surface 451 and tubular workpiece 101; instead, the latch actuation torque is internally reacted, thus reducing operational uncertainty.

Figure 10A:
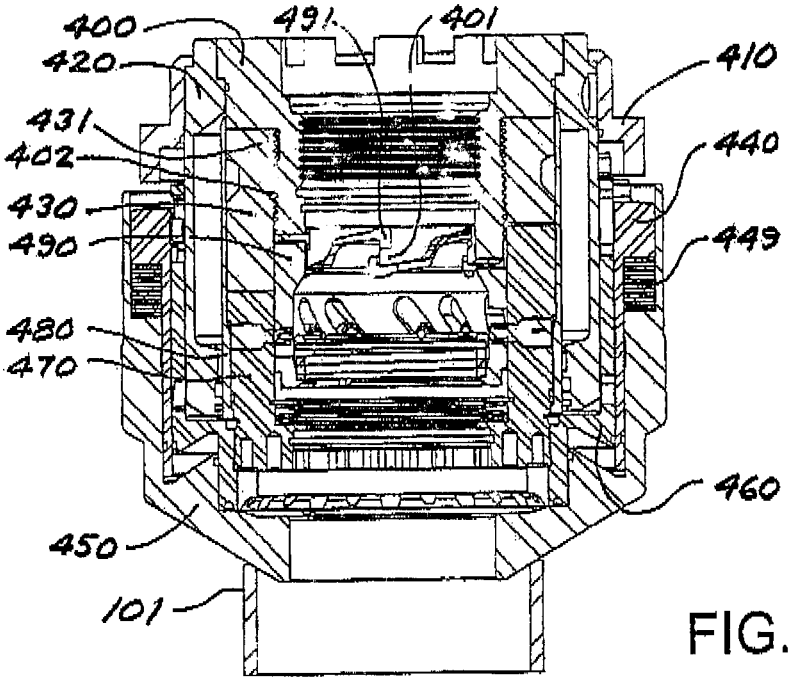
FIG. 10A is a cross-section through the tri-cam latching linkage and latch release mechanism in FIG. 8A, shown after the application of sufficient axial load to stroke the latch release mechanism so as to withdraw the trigger dog.
Figure 10B:
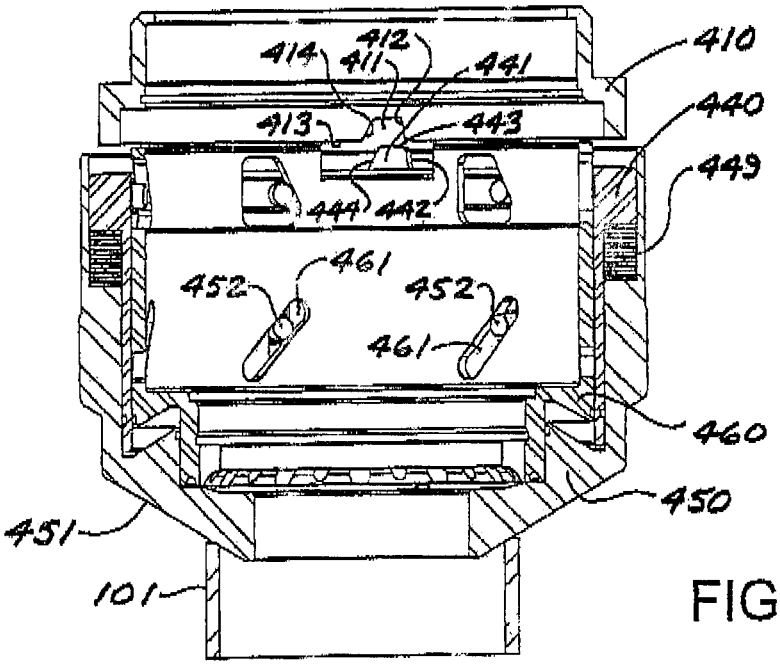
FIG. 10B is a cross-section through the latch release mechanism in FIG. 8B, shown after the application of sufficient axial load to stroke the latch release mechanism so as to withdraw the trigger dog.

As best understood with reference to FIG. 10B, trigger reaction ring 410 has one or more downward-facing trigger reaction dog pockets 411, each of which is generally defined by a reaction pocket load flank 412, a reaction pocket crest 413, and a reaction pocket lock flank 414, with each trigger reaction dog pocket 411 being engageable with a corresponding upward-facing trigger dog tooth 441. Each trigger dog tooth 441 is generally defined by a trigger dog tooth load flank 442, a trigger dog tooth crest 443, and a trigger dog tooth lock flank 444 (when the tool is in the latched position as shown in FIG. 8B). Movable bumper 450 and trigger element 440 are linked by bumper cam follower 452, fixed to movable bumper 450 and movable within a trigger cam slot 445 provided in trigger element 440, between an upper end 446 and a lower end 447 of trigger cam slot 445. Additionally, movable bumper 450 is linked to cage extension 460 by bumper cam follower 452, which is constrained to move within a bumper-cage cam slot 461 between an upper end 462 and a lower end 463 thereof. Trigger element 440 is linked to cage extension 460 by a trigger cam follower 448, which is fixed to trigger element 440 and is constrained to move within a cage cam pocket 464 provided in cage extension 460. Additionally, cage extension 460 is rigidly fixed to driven cam body 470.

It will be apparent to persons skilled in the art that the cam follower can be fixed to either of the two components to be paired, with the cam profile defined in the other of the two paired components, and that the design choice in this regard will typically be based on practical considerations such as efficiency of assembly, disassembly and maintenance. Similarly, the choice of cam follower/cam surface as the means for providing the desired movement constraint is not intended to be in any way limiting, where persons skilled in the art will understand that generally equivalent mechanisms can be provided in other forms.

In the embodiment shown in FIG. 8B, trigger cam slot 445 is provided as an axially-oriented slot, closely fitting with bumper cam follower 452, and thus generally providing a single degree of freedom to permit relative axial movement between trigger element 440 and movable bumper 450, but not permitting relative rotation. Trigger bias spring 449 is provided to act between trigger element 440 and movable bumper 450 in the direction of axial sliding, to bias movable bumper 450 downward. Bumper-cage cam slot 461 is sloped at a selected angle relative to the vertical (shown by way of non-limiting example in FIG. 8B as approximately 45 degrees), and is closely-fitting with the associated bumper cam follower 452 to provide a single degree of freedom linking relative axial movement of movable bumper 450 to rotation of cage extension 460. However, free movement of trigger cam follower 448 is permitted within trapezoidal cage cam pocket 464, constrained only by contact against cam surfaces defining the perimeter of cage cam pocket 464, as follows:

an advance cam surface 466, defining a flat upper edge of cage cam pocket 464;

a withdraw cam surface 467, forming a helical path; and a reset cam surface 469, defining an axially-oriented side edge of cage cam pocket 464.

During typical operations, the operative status of latch release mechanism 131 may be characterized with reference to the position of trigger cam follower 448 within cage cam pocket 464, as follows:

Start position: with trigger cam follower 448 proximal to the intersection of reset cam surface 469 and advance cam surface 466;

Advanced position: with trigger cam follower 448 proximal to the intersection of advance cam surface 466 and withdraw cam surface 467;

Withdrawn position: with trigger cam follower 448 proximal to withdraw cam surface 467; and Reset position: with trigger cam follower 448 proximal to reset cam surface 469.

With the latch release mechanism in the latched position as in FIG. 8B, with bumper cam follower 452 positioned at lower end 463 of bumper-cage cam slot 461, trigger bias spring 449 will urge trigger cam follower 448 toward the start position within cage cam pocket 464, while simultaneously maintaining the engagement of trigger dog teeth 441 within corresponding trigger reaction dog pockets 411. This engagement of trigger dog teeth 441 disposes trigger dog tooth lock flanks 444 in close opposition to corresponding reaction pocket lock flanks 414 so as to prevent accidental rotation of upper latch assembly 133 relative to lower latch assembly 134 as controlled by the selection of the mating flank angle and gap. If necessary, a more axially-aligned camming surface may be selected to more strongly resist rotation for a given force exerted by trigger bias spring 449.

Figure 9A:
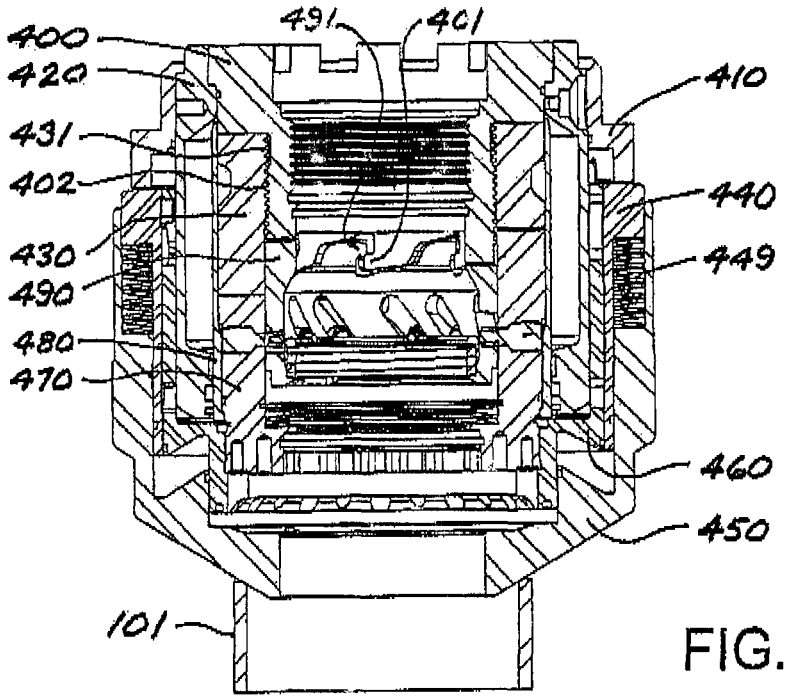
FIG. 9A is a cross-section through the tri-cam latching linkage and latch release mechanism as in FIG. 8A, shown after application of axial load to stroke the latch release mechanism so as to cause rotary movement sufficient to release the latch.
Figure 9B:
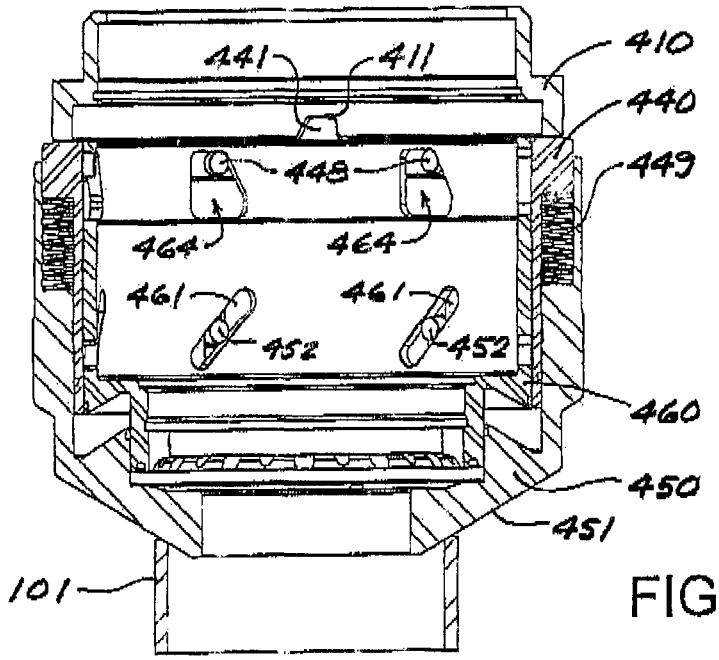
FIG. 9B is a cross-section through the latch release mechanism in FIG. 8B, shown after the application of axial load so as to stroke the latch release mechanism to cause rotary movement sufficient to release the latch.

Referring now to FIG. 9B, when sufficient force is applied by tubular workpiece 101 to overcome the force of trigger bias spring 449, movable bumper 450 moves upward, causing bumper cam follower 452 to move axially upward within bumper-cage cam slot 461. This axially-upward axial movement tends to rotate cage extension 460, but such rotation is resisted by the latch actuation torque acting between upper latch assembly 133 and lower latch assembly 134, which torque is transmitted through movable bumper 450 to trigger element 440 via bumper cam follower 452 and trigger cam slot 445, and through trigger dog tooth load flank 442 to reaction pocket load flank 412 and to upper latch assembly 133. This causes the latch actuation torque to be internally reacted, and causes trigger cam follower 448 to move along advance cam surface 466 to the advanced position within cage cam pocket 464, thereby disengaging drive cam latch hooks 401 from latch cam latch hooks 491 and changing the state of tri-cam latching linkage 132 from the latched position as in FIG. 8A to the unlatched position as in FIG. 9A, through right-hand rotation of upper latch assembly 133 relative to lower latch assembly 134.

Once drive cam latch hooks 401 and latch cam latch hooks 491 have disengaged, the gas spring urges separation of upper latch assembly 133 from lower latch assembly 134. It is at this point in the operational sequence of casing running that a combination of axial tension and rotation will be applied during the course of connection make-up to induce right-hand rotation of upper latch assembly 133 relative to lower latch assembly 134. During this stage of operation, latch release mechanism 131 will not interfere with the regular function of the casing running tool.

Further upward movement of movable bumper 450 continues to urge rotation of cage extension 460 and, therefore, movement of trigger cam follower 448 to the withdrawn position within cage cam pocket 464, thereby moving trigger element 440 down and correspondingly withdrawing trigger dog teeth 441 from engagement with trigger reaction dog pockets 411 as shown in FIG. 10B. The angle of withdraw cam surface 467 relative to sloped bumper-cage cam slot 461 may be selected so as to promote the withdrawal of trigger dog teeth 441 from engagement with trigger reaction dog pockets 411 without jamming or otherwise inducing force in excess of the operative trigger bias force and frictional forces otherwise tending to affect the withdrawal movement.

With trigger element 440 withdrawn from trigger reaction ring 410 as shown in FIG. 10B, trigger dog tooth lock flank 444 is no longer opposite reaction pocket load flank 412, so upper latch assembly 133 can be rotated relative to lower latch assembly 134 in order to re-latch tri-cam latching linkage 132. As may be seen in FIG. 11A, this rotation of upper latch assembly 133 relative to lower latch assembly 134 causes latch cam latch hooks 491 to move into engagement with drive cam latch hooks 401 (i.e., the latched position), with the corresponding actuation torque induced by this rotation being resisted by tractional engagement of movable land surface 451 with tubular workpiece 101.

Figure 11A:
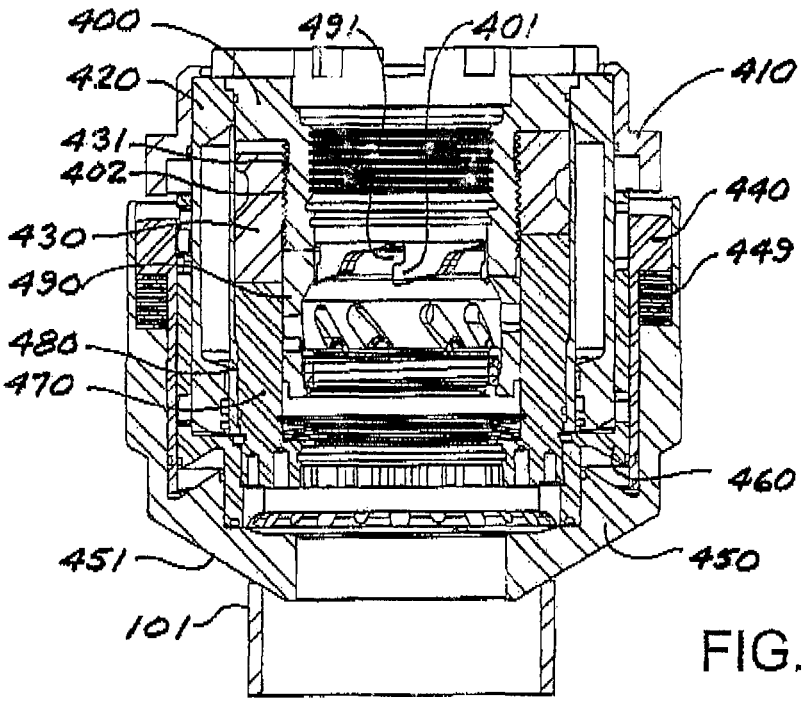
FIG. 11A is a cross-section through the tri-cam latching linkage and latch release mechanism in FIG. 8A, shown after rotation to re-latch the latch release mechanism.
Figure 11B:
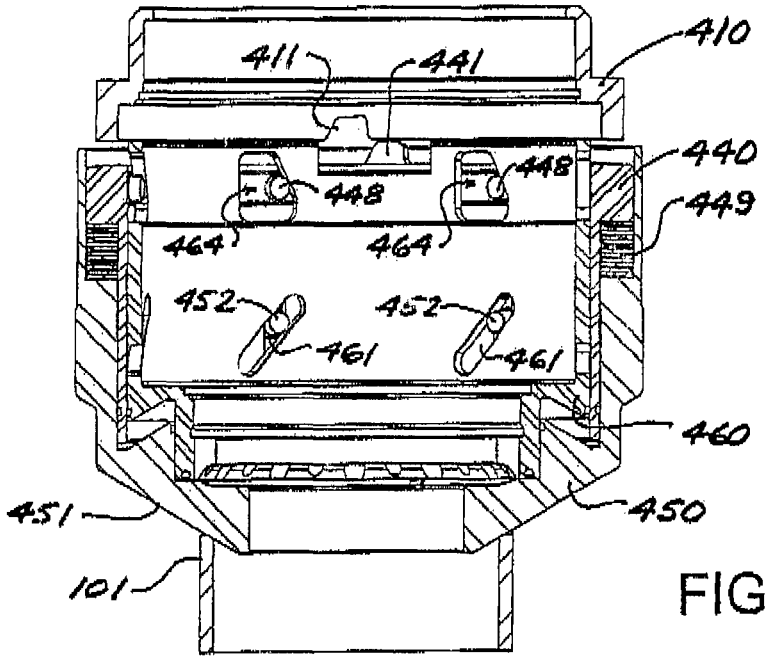
FIG. 11B is a cross-section through the latch release mechanism in FIG. 8A, shown after rotation to re-latch the latch release mechanism.

Referring now to FIG. 11B, with CRTi 130 thus in the re-latched position, as the operational step of removing CRTi 130 from tubular workpiece 101 reduces the axial force acting on movable land surface 451, trigger bias spring 449 urges movable bumper 450 downward and correspondingly causes movable bumper 450 to rotate relative to cage extension 460, with possible attendant sliding between movable land surface 451 and tubular workpiece 101. Tractional frictional force from trigger bias spring 449 thus tends to urge trigger element 440 to reverse the withdrawal movement described above, moving trigger dog teeth 441 upward. However, this upward movement of trigger dog teeth 441 is prevented by sliding engagement of trigger dog tooth crests 443 with reaction pocket crest 413, forcing trigger cam follower 448 to move from the withdrawn position to the reset position within cage cam pocket 464. As movable bumper 450 continues to move downward, following the movement of tubular workpiece 101, a point is reached where trigger dog tooth crests 443 no longer engage (i.e., they slide off) reaction pocket crest 413, thereby allowing trigger cam follower 448 to move from the reset position to the start position within cage cam pocket 464, thus returning latch release mechanism 131 to the position shown in FIG. 8A, from which position the operational sequence shown in FIGS. 8A to 11B can be repeated.

Frictional/Inertial CRTi Embodiment

There will now be described a latch release mechanism which in quasi-static operation relies on tractional resistance between movable land surface 451 of movable bumper 450 and tubular workpiece 101. This latch release mechanism is a modification to the latch release mechanism 131 described previously herein under the heading "CRTi Embodiment". As used in this disclosure, the phrase "quasi-static operation" with respect to a latch release mechanism is to be understood as referring to operation of the mechanism such that axial load is applied in a sufficiently slow manner that dynamic effects associated therewith are minimal or negligible.

Figure 12:
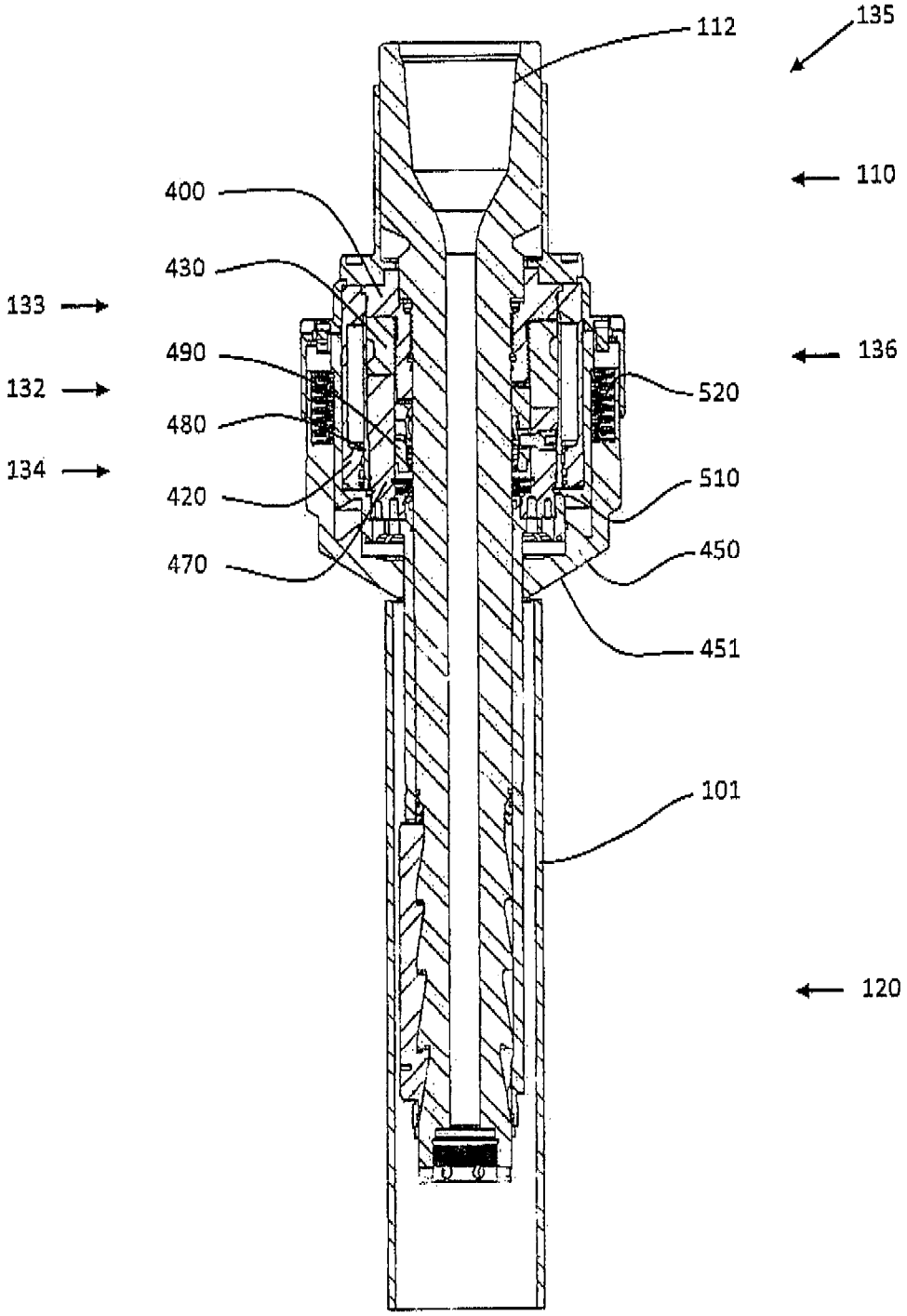
FIG. 12 illustrates a prior art CRTi fitted with an embodiment of a latch release mechanism in accordance with the present disclosure.

FIG. 12 is a sectional view of a prior art CRTi 135 fitted with a tri-cam latching linkage 132 and a latch release mechanism 136 carried by lower latch assembly 134 and comprising a movable bumper 450, a bumper cam follower 452 fixed to movable bumper 450, a trigger bias spring 520, and a cage extension 510, which are generally configured as a coaxially-nested group of closely-fitting cylindrical components, with relative rotary and translational movements between these components being constrained so as to keep them coaxially aligned. Tri-cam latching linkage 132, movable bumper 450, and bumper cam follower 452 in FIG. 12 are identical to those previously described under the "CRTi Embodiment" heading and depicted in FIGS. 8A and 8B.

Figure 13A:
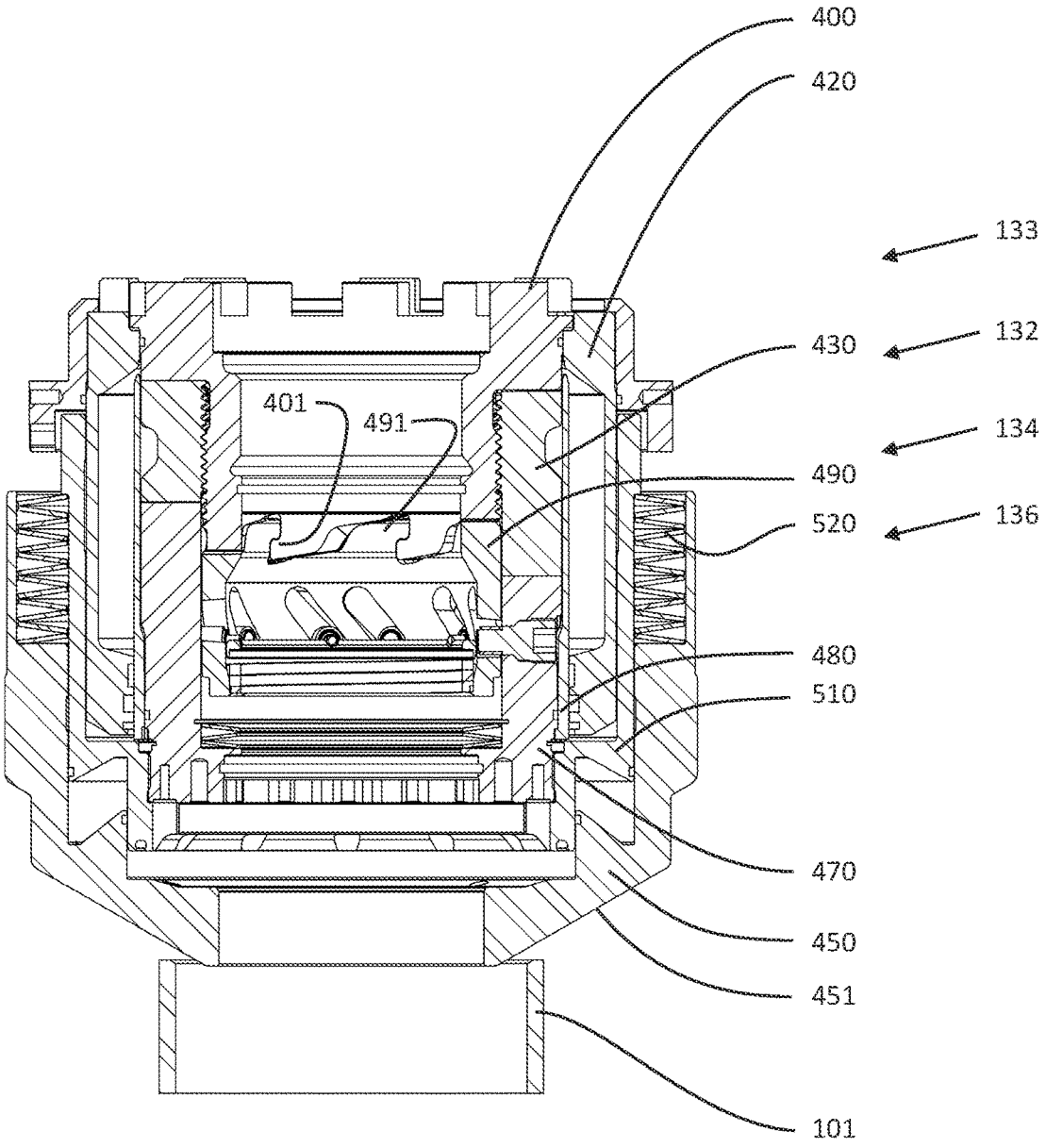
FIG. 13A is a cross-section through the tri-cam latching linkage and latch release mechanism of the modified CRTi in FIG. 12.
Figure 13B:
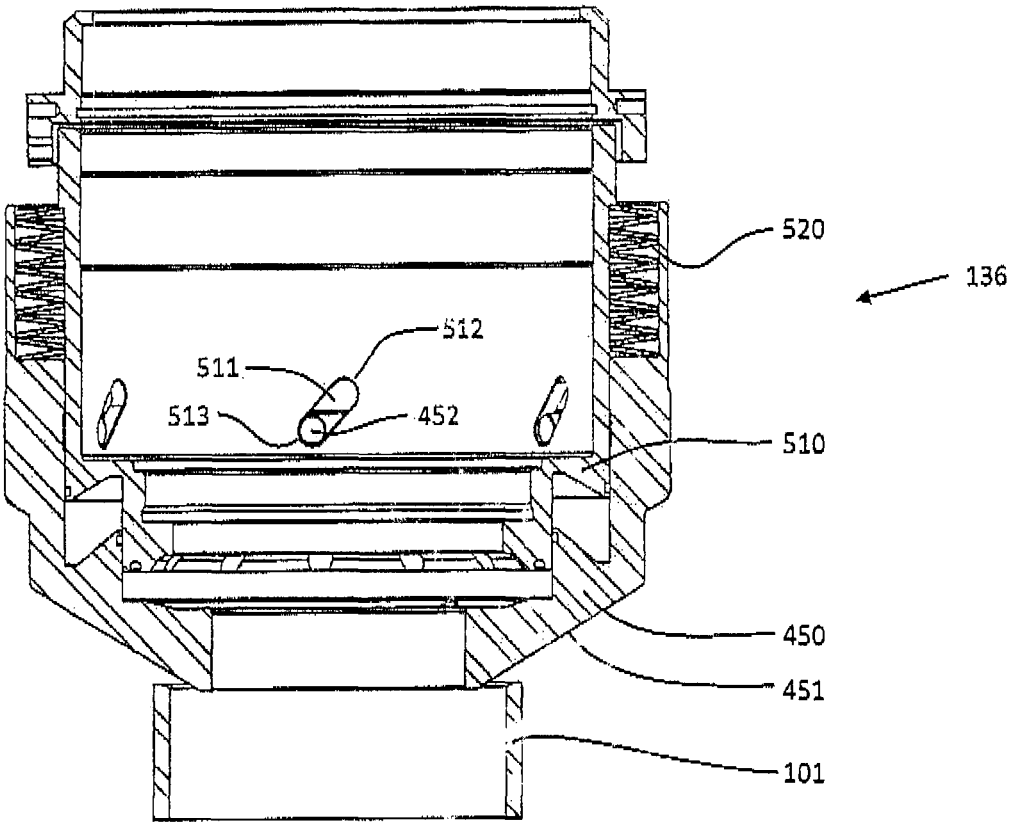
FIG. 13B is a cross-section through the latch release mechanism in FIG. 13A.

As best understood with reference to FIGS. 13A and 13B, movable bumper 450 and cage extension 510 are linked by bumper cam follower 452, which is movable within a cage cam slot 511 provided in cage extension 510 and between an upper end 512 and a lower end 513 of cage cam slot 511. Cage cam slot 511 is sloped at a selected angle (shown by way of non-limiting example in FIG. 13B as approximately 45 degrees) relative to the longitudinal axis of the tool, and is closely-fitting with the associated bumper cam follower 452, which defines a translational-rotational relationship between movable bumper 450 and cage extension 510. Additionally, cage extension 510 is rigidly fixed to driven cam body 470, and trigger bias spring 520 is provided to act between cage extension 510 and movable bumper 450 to bias movable bumper 450 axially downward, as well as biasing bumper cam follower 452 to be in contact with lower end 513 of cage cam slot 511.

It will be apparent to persons skilled in the art that bumper cam follower 452 can be fixed to either one of the two components to be paired, with the cam profile being defined in the other one of the paired components. The design choice in this regard will typically be based on practical considerations including efficiency of assembly, disassembly, and maintenance. Similarly, the choice of cam follower/cam surface as the means for providing the desired movement constraint is not intended to be in any way limiting; persons skilled in the art will understand that functionally effective alternative mechanisms can be provided in other forms.

For purposes of the present discussion, body assembly 110 will be considered as the datum, relative to which tubular workpiece 101 will be viewed as tending to move upward. As shown in FIGS. 13A and 13B, when tri-cam latching linkage 132 is in the latched position, bumper cam follower 452 will be positioned at lower end 513 of cage cam slot 511 due to the axial downward force applied by trigger bias spring 520. In operation, CRTi 135 with latch release mechanism 136 will be lowered until movable land surface 451 on movable bumper 450 contacts tubular workpiece 101, and the contact force resulting from tool weight and set-down load applied by the top drive (not shown) increases above the "trigger set-down load", at which point latch release tubular workpiece 136 will have applied the required latch actuation torque and the rotation required to disengage drive cam latch hooks 401 from latch cam latch hooks 491.

Figure 14A:
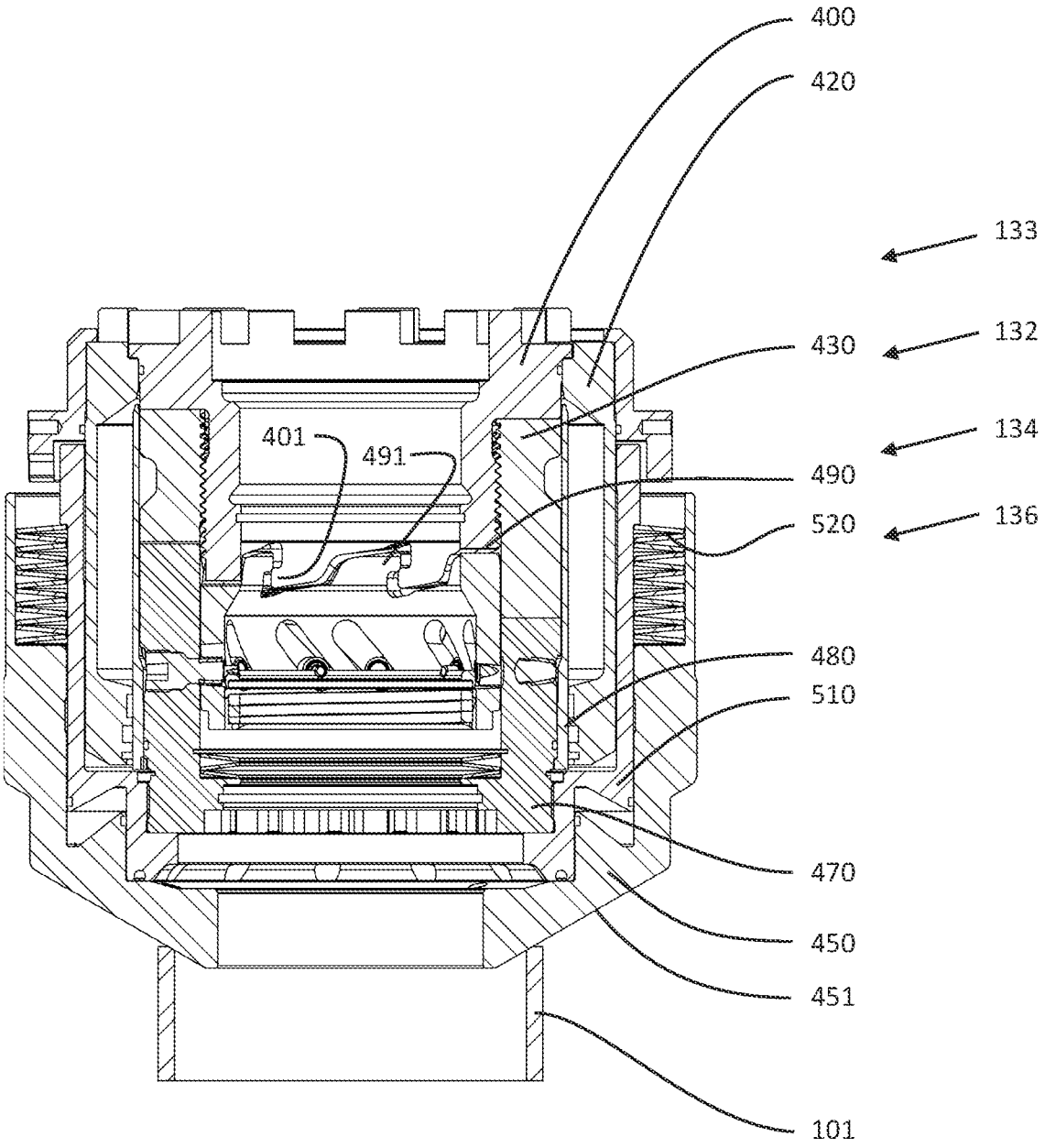
FIG. 14A is a cross-section through the tri-cam latching linkage and latch release mechanism of the modified CRTi in in FIGS. 13A and 13B, shown in the latched and unloaded position.
Figure 14B:
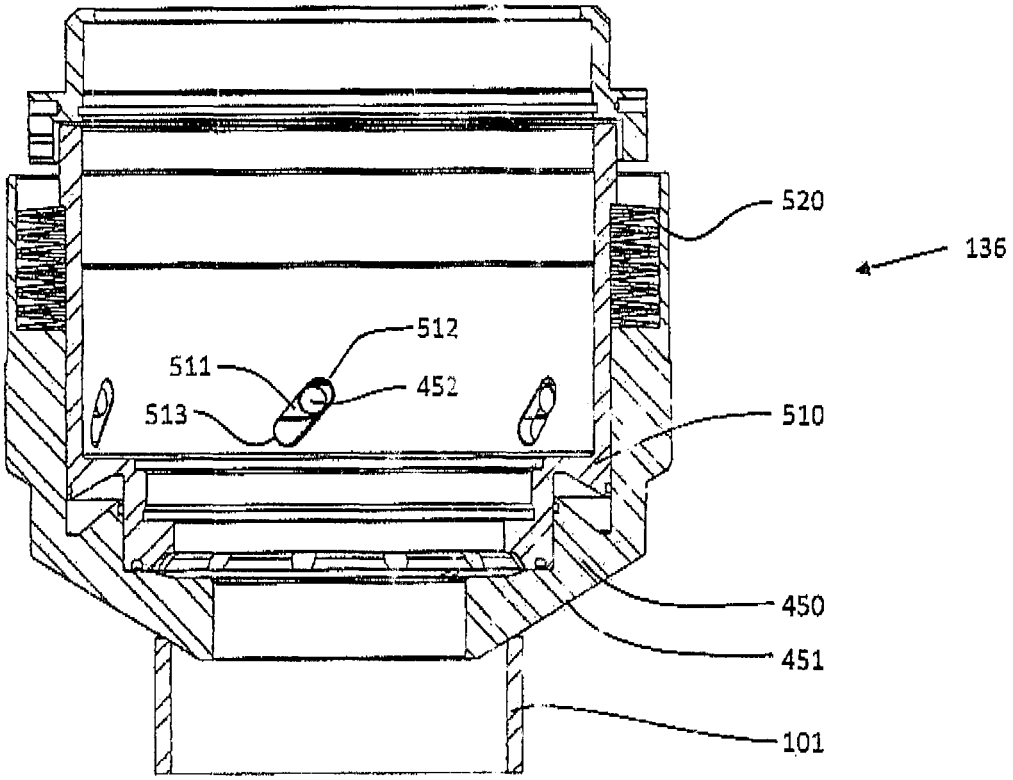
FIG. 14B is a cross-section through the latch release mechanism in FIG. 14A.

As illustrated in FIGS. 14A and 14B, when sufficient force is applied in a quasi-static manner by tubular workpiece 101 to overcome the force of trigger bias spring 520, movable bumper 450 will move upward, generating torque between itself and cage extension 510 due to the interaction of bumper cam follower 452 within cage cam slot 511, which torque, for the movable bumper 450, must be reacted by tractional engagement of movable land surface 451 with tubular workpiece 101, which tractional engagement, if sufficient, will result in rotation of cage extension 510.

The rotation of cage extension 510 will be resisted by the latch actuation torque acting between upper latch assembly 133 and lower latch assembly 134. The latch actuation torque will be transmitted from upper latch assembly 133 to load adaptor 111, and in turn must be reacted by the top drive, thereby disengaging drive cam latch hooks 401 from latch cam latch hooks 491, and resulting in movement of tri-cam latching linkage 132 from a latched position as shown in FIG. 13A to an unlatched position as shown in FIG. 14A, through right-hand rotation of upper latch assembly 133 relative to lower latch assembly 134. Once drive cam latch hooks 401 and latch cam latch hooks 491 have disengaged, a gas spring associated with latch release mechanism 136 (generally as previously described with reference to latch release mechanism 131) will urge upper latch assembly 133 to separate from lower latch assembly 134.

It will be apparent to persons skilled in the art that the described latch release mechanism 136 will be able to generate the latch actuation torque and corresponding rotation required to move CRTi 135 from a disengaged position to an engaged position by means of quasi-static application of axial set-down load and displacement only, provided that the following two boundary conditions can be readily met:

1. The tractional engagement between movable land surface 451 and tubular workpiece 101 is sufficient to react latch actuation torque; and
2. The top drive has sufficient torque resistance to react latch actuation torque.

In instances where the above two conditions can be readily and reliably met, latch release mechanism 136 can provide the benefits of faster cycle times, operational simplicity, and comparative mechanical simplicity.

Additionally, the nature of the tool's operation can be taken advantage of to supplement the tractional engagement between movable land surface 451 and tubular workpiece 101, i.e., movable bumper 450 can be designed with a high moment of inertia about the tool's axis relative to the combined moment of inertia of the cage extension 510 and grip assembly 120, and when the set-down load is applied with sufficient speed, the cage extension 510 and grip assembly 120 will have a greater tendency to rotationally accelerate, causing right-hand rotation of upper latch assembly 133 relative to lower latch assembly 134, and disengaging drive cam latch hooks 401 from latch cam latch hooks 491.

To disengage CRTi 135 from tubular workpiece 101, set-down load and left-hand torque are applied to load adaptor 111 and are reacted between movable bumper 450 and tubular workpiece 101. When the set-down load and left-hand torque are sufficient, upper latch assembly 133 will rotate in the left-hand direction relative to lower latch assembly 134, causing drive cam latch hooks 401 to move into engagement with latch cam latch hooks 491 (i.e., into the latched position), with the corresponding torque induced by this rotation being resisted by tractional engagement of movable land surface 451 with tubular workpiece 101.

The operational step of removing CRTi 135 from tubular workpiece 101 will reduce the axial force acting on movable land surface 451, with trigger bias spring 520 urging movable bumper 450 downward and correspondingly causing movable bumper 450 to rotate relative to cage extension 510, with possible attendant sliding between movable land surface 451 and tubular workpiece 101 and resultant tractional frictional force acting in the direction to maintain latching. With sufficient axial downward movement of tubular workpiece 101, bumper cam follower 452 will contact lower end 513 of cage cam slot 511, thus returning latch release mechanism 136 to the position shown in FIG. 13A, from which position the operational sequence shown in FIGS. 13A through 14B can be repeated.

CRTe Embodiment

Figure 15:
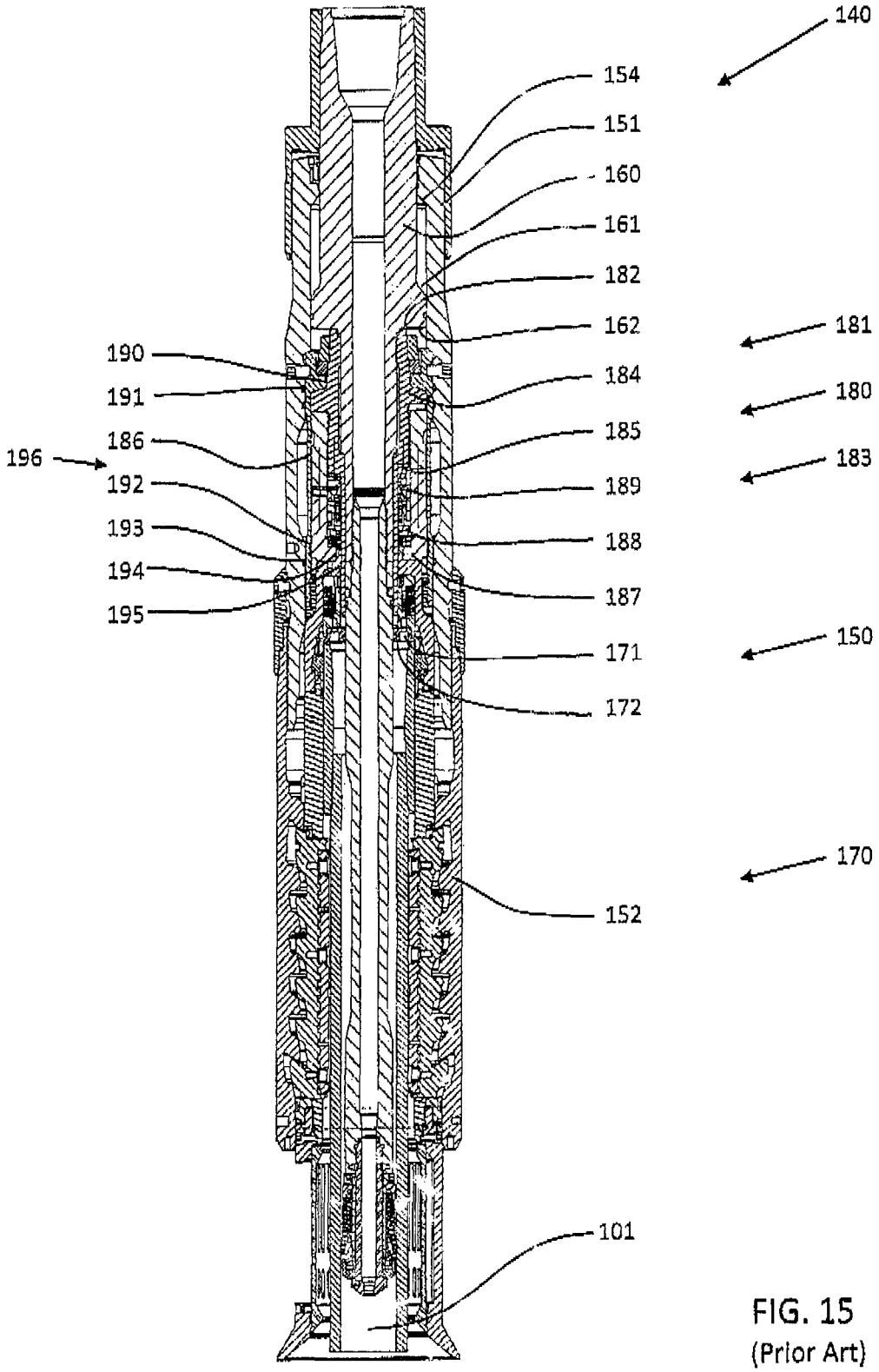
FIG. 15 (Prior Art)
FIG. 15 is a cross-section through a prior art CRTe.

FIG. 15 is a sectional view of a prior art externally-gripping casing running tool (CRTe) 140 comprising a main body assembly 150, which has a main body upper housing 151 rigidly fixed to a main body lower housing 152, a floating load adaptor 160 for structural connection to the top drive quill of a drilling rig (not shown), a grip assembly 170 that rigidly carries a bumper 171, and a tri-cam latching linkage 180 comprising an upper latch assembly 181 axially fixed to main body assembly 150, and a lower latch assembly 183 fixed to and carried by grip assembly 170. Upper latch assembly 181 is rotationally coupled to floating load adaptor 160, and comprises a drive cam 184 that carries a plurality of drive cam latch hooks 185, plus a drive cam housing 186. Lower latch assembly 183 comprises a driven cam 187, plus a latch cam 188 that carries a plurality of latch cam latch hooks 189.

As shown in FIG. 15, an upper cam-housing seal 190, a main body-housing upper seal 191, a lower cam-housing seal 192, a main body-housing lower seal 193, a lower cam-cage seal 194, and a upper cam-cage seal 195 define a gas spring chamber 196, with lower cam-housing seal 192 and upper cam-cage seal 195 defining a piston area carried by lower latch assembly 183. When pressurized with a gas, gas spring chamber 196 forms an internal gas spring that tends to urge separation of upper latch assembly 181 from lower latch assembly 183, and thereby tending to urge separation of main body upper housing 151 from grip assembly 170 so as to move CRTe 140 from a retracted position to an engaged position relative to tubular workpiece 101.

Such separation is resisted by matingly-engageable drive cam latch hooks 185 and latch cam latch hooks 189, which can be disengaged by the application of sufficient right-hand torque (i.e., latch actuation torque) and corresponding right-hand rotation of floating load adaptor 160 relative to main body assembly 150. In the prior art CRTe 140, latch actuation torque is applied through floating load adaptor 160, and is reacted through tractional engagement between tubular workpiece 101 and a land surface 172 provided on bumper 171. The tri-cam latching linkage 180 is considered to be in the latched position when drive cam latch hooks 185 and latch cam latch hooks 189 are engaged, and in the unlatched position when drive cam latch hooks 185 and latch cam latch hooks 189 are disengaged.

As also shown in FIG. 15, floating load adaptor 160 has a floating load adaptor upper axial shoulder 161 that permits the transfer of axial tension loads through contact with an axial shoulder 154 of the main body assembly 150. Additionally, floating load adaptor 160 has a floating load adaptor lower axial shoulder 162 that permits the transfer of axial compression loads through contact with an axial shoulder 182 on upper latch assembly 181 which in turn transfers the axial compression loads to main body upper housing 151. The axial distance between axial shoulder 154 on main body upper housing 151 and axial shoulder 182 on upper latch assembly 181 is greater than the axial distance between upper axial shoulder 161 and lower axial shoulder 162 on floating load adaptor 160, thereby providing an axial range through which floating load adaptor 160 can move without transferring axial tension or compressive loads to main body assembly 150.

Figure 16:
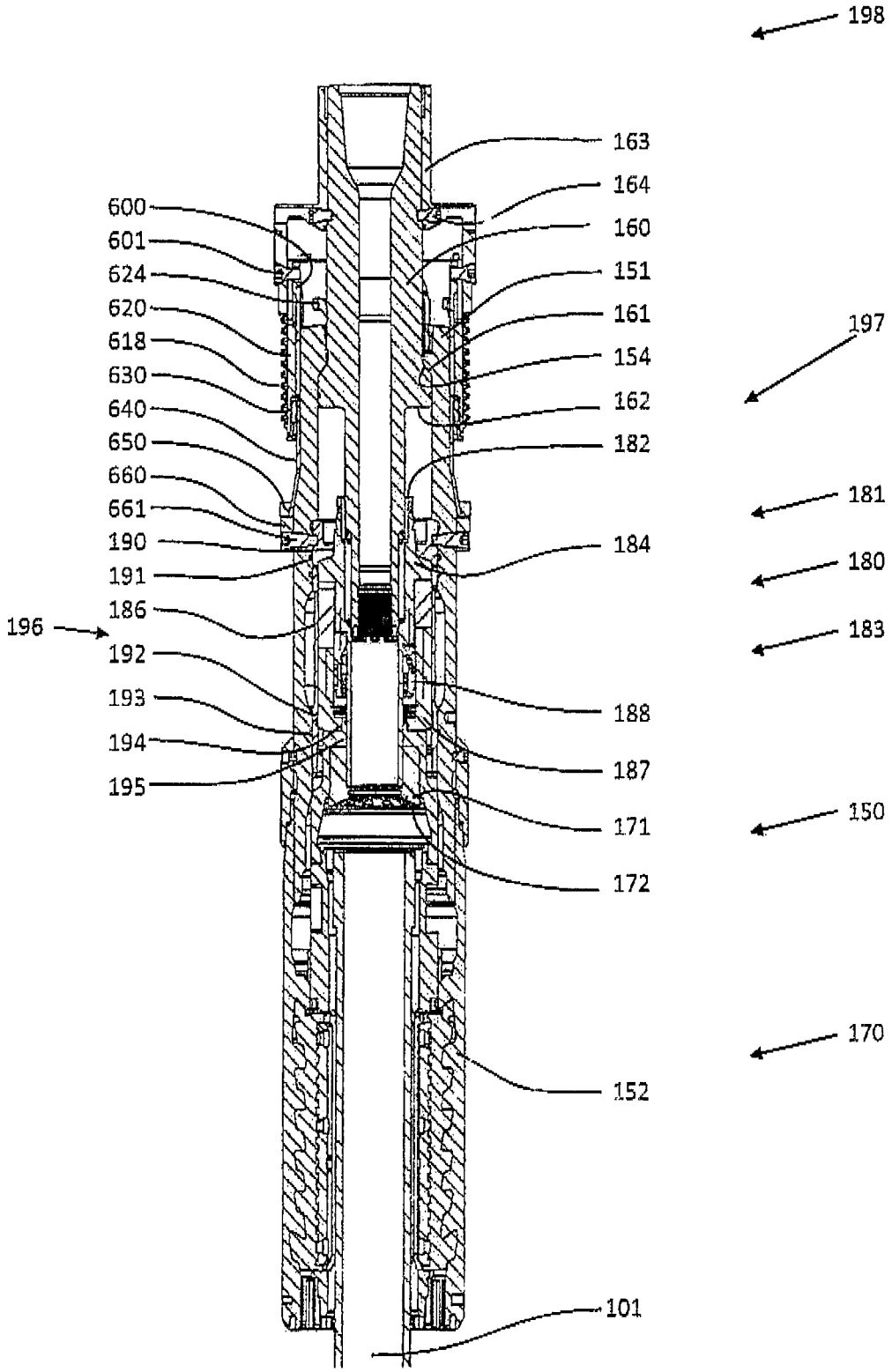
FIG. 16 is a cross-section through a prior art externally-gripping casing running tool (CRTe) fitted with an embodiment of a latch release mechanism in accordance with the present disclosure.

FIG. 16 illustrates a CRTe 197 substantially corresponding to prior art CRTe 140 of FIG. 15 but fitted with a latch release mechanism 198 that can be employed to use only axial compression and corresponding axial displacement to generate the right-hand torque (i.e. latch actuation torque) and rotation required to unlatch the tri-cam latching linkage 180, allowing CRTe 197 to transition from the retracted position to the engaged position and then return to the retracted position to facilitate repetition of the casing make-up and hoisting process involved in constructing an oil and gas well.

FIG. 16 shows CRTe 197 in the latched position. Latch release mechanism 198 comprises:

- a load adaptor extension 163, fixed to floating load adaptor 160 and comprising a downward-extending skirt 165;
- a primary trigger element 600 (alternatively referred to as primary trigger 600) coaxially disposed within load adaptor extension 163; a trigger bias spring 618;
- a secondary trigger element 620 (alternatively referred to as secondary trigger 620);
- a secondary trigger extension 630;
- a main body extension 640;
- a clamp ring 650; and
- a main body lock 660.

These components of latch release mechanism 198 are generally configured as a coaxially-nested group of closely-fitting, generally cylindrical components, with relative rotational and translational movements between these components being constrained to keep them in coaxial alignment as will be described in greater detail below.

In operation, CRTe 197 would first be inserted or "stabbed" over tubular workpiece 101, and the contact force resulting from tool weight and set-down load applied by the top drive (not shown) would increase, causing corresponding axial displacement between main body assembly 150 and floating load adaptor 160, enabling latch release mechanism 198 to generate the required latch actuation torque and corresponding rotation to unlatch tri-cam latching linkage 180, with the gas spring causing axial displacement between grip assembly 170 and main body assembly 150 transitioning CRTe 197 from the an initial retracted position to an engaged position. This operational sequence for CRTe 197 differs from the operation of prior art CRTe 140 in two ways:

First, CRTe 197 does not require externally-applied right-hand rotation to transition between the retracted and engaged positions, thus simplifying the operational procedure.

Second, latch release mechanism 198 of CRTe 197 is configured such that it does not rely on tractional engagement between land surface 172 and tubular workpiece 101; instead, the latch actuation torque is internally reacted, thus reducing operational uncertainty.

The following discussion describes how latch release mechanism 198 generates latch actuation torque and corresponding rotation by means of set-down load and axial displacement only.

Figure 17A:
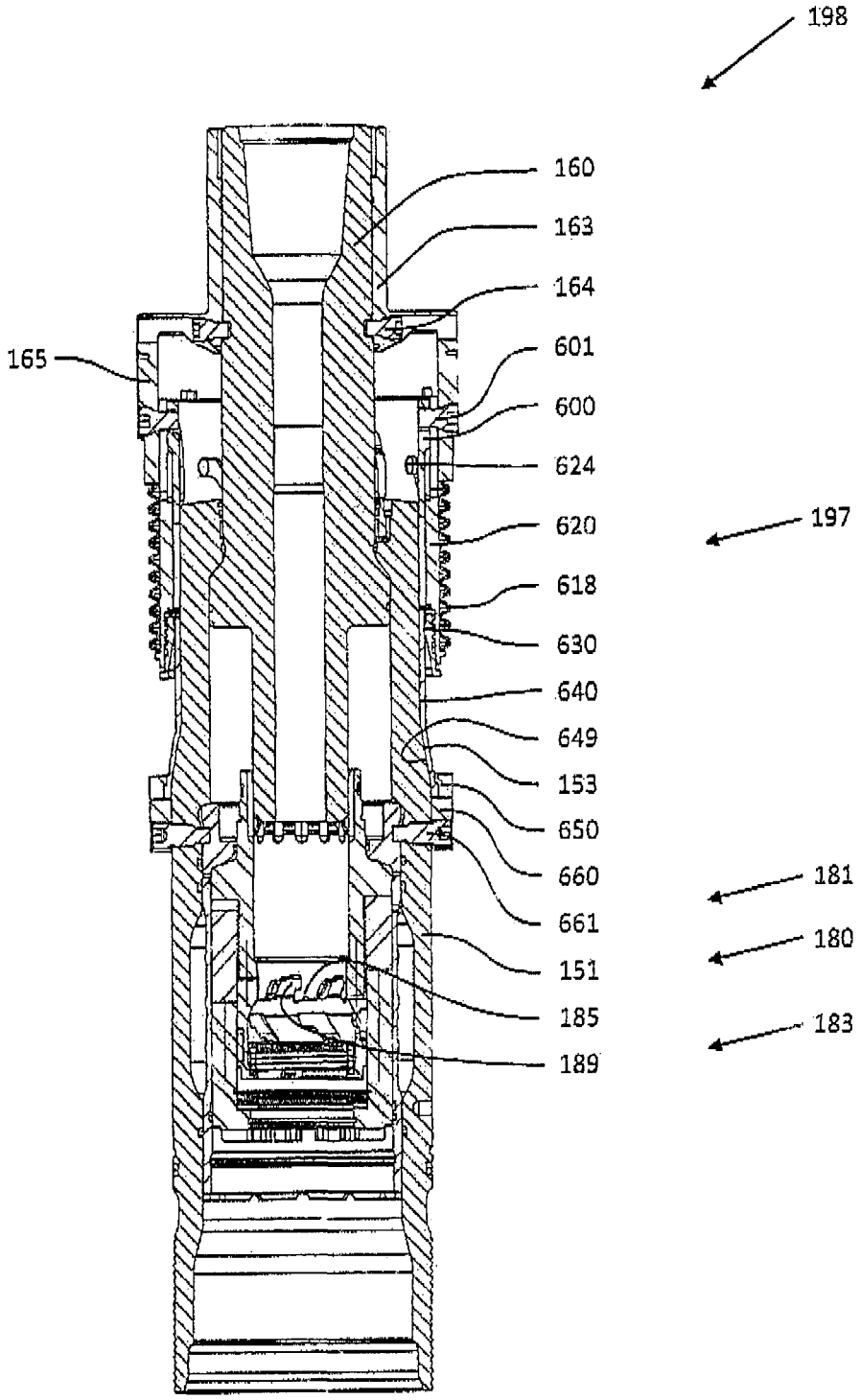
FIGS. 17A and 17B are cross-sections through the tri-cam latching linkage and latch release mechanism in FIG. 16, shown in an initial latched position.
Figure 17B:
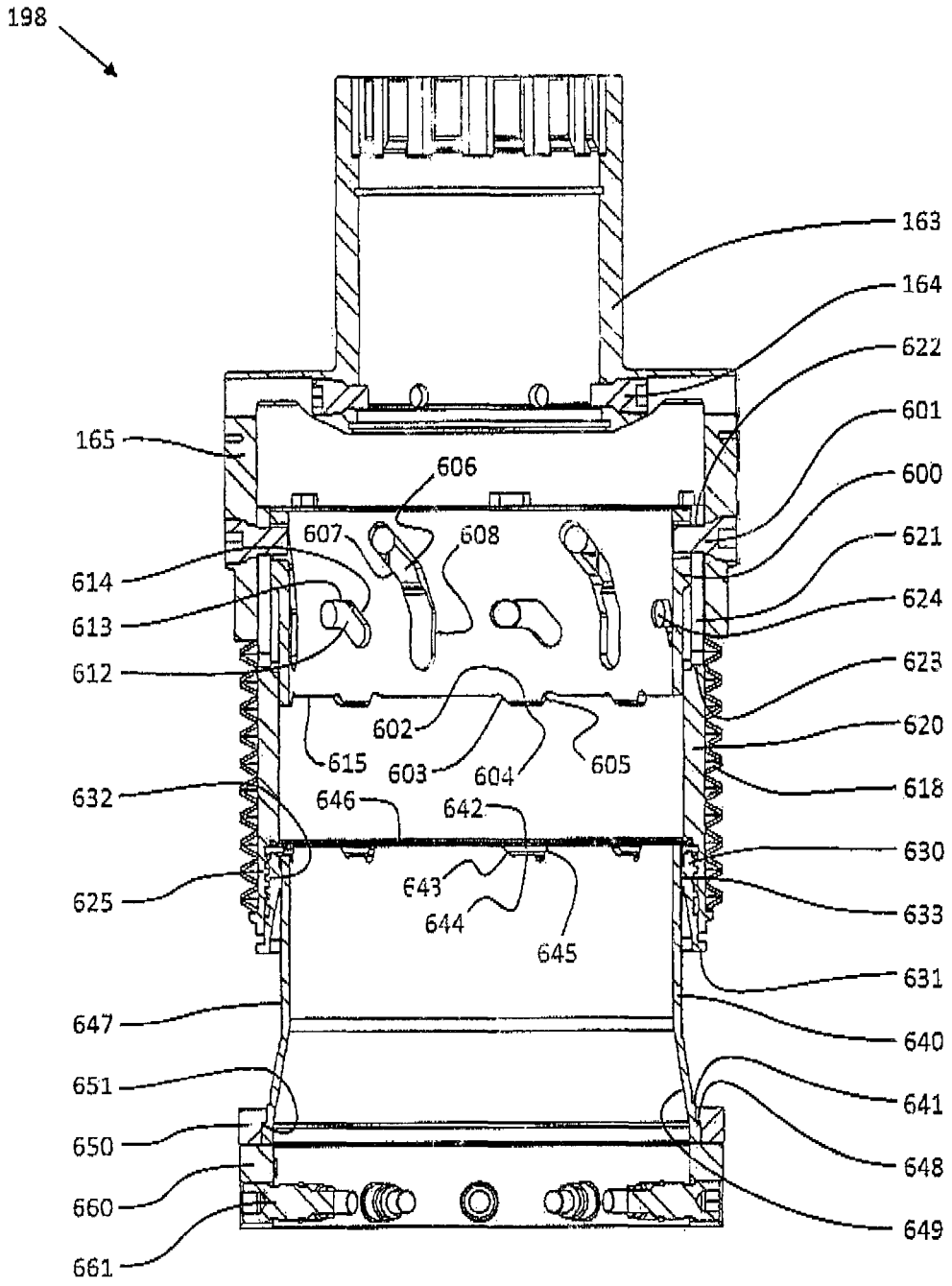

FIG. 17A is a cross-section through CRTe 197, with the grip assembly 170, tubular workpiece 101, and main body lower housing 152 hidden for clarity, and FIG. 17B is a section through latch release mechanism 198 of CRTe 197, shown in both views in an initial latched position. Load adaptor extension 163 is rigidly fixed to floating load adaptor 160 by one or more load adaptor lugs 164, and rigidly carries one or more load adaptor cam followers 601, each of which is constrained to move within a primary trigger cam slot 606 provided by primary trigger 600 and within a secondary trigger cam slot 621 provided by secondary trigger 620. Primary trigger cam slot 606 also has a vertical lower portion 608 contiguous with upper portion 607. Upper portion 607 of primary trigger cam slot 606 is sloped at a selected angle from the vertical (which angle may vary along the length of upper portion 607). The relative axial and rotational movements between load adaptor extension 163 and primary trigger 600 are therefore bounded by upper and lower portions 607 and 608 of primary trigger cam slot 606.

Secondary trigger cam slot 621 is axially oriented and closely fitting to load adaptor cam follower 601, thereby coupling the rotation of load adaptor extension 163 and secondary trigger 620. Secondary trigger cam slot 621 has a lower end 623, plus an upper end 622 which load adaptor cam follower 601 is biased to be in contact with by trigger bias spring 618, which acts between secondary trigger 620 and load adaptor extension 163 to apply an axially-downward biasing force to secondary trigger 620. Relative axial movement between load adaptor extension 163 and secondary trigger 620 is therefore constrained within the upper end 622 of secondary trigger cam slot 621 and secondary trigger cam slot lower end 623.

Secondary trigger 620 rigidly carries one or more secondary trigger cam followers 624, each of which is close-fitting within a dog retraction cam slot 612 provided on primary trigger 600. Each dog retraction cam slot 612 has an upper end 613, which is circumferentially oriented and constrains secondary trigger 620 and primary trigger 600 to initially be axially coupled, and which transitions to a lower end 614 that is sloped at a selected angle (which angle may vary along the length of lower end 614) from the vertical, and is close-fitting to a corresponding secondary trigger cam follower 624 to define a translational-rotational relationship between secondary trigger 620 and primary trigger 600.

Relative axial and rotational movement between secondary trigger 620 and primary trigger 600 is therefore constrained within upper and lower ends 613 and 614 of dog retraction cam slots 612.

Referring still to FIGS. 17A and 17B, secondary trigger extension 630 has a secondary trigger extension thread 632, with a defining helix in the left-hand direction, that engages a secondary trigger thread 625 provided on secondary trigger 620. Additionally, secondary trigger extension 630 has a secondary trigger extension lug 633 closely fitting to axially-oriented slots 647 provided on main body extension 640 so as to couple the rotation of main body extension 640 and secondary trigger extension 630. Main body lock 660 is held fixed to main body upper housing 151 by main body lock lugs 661. Clamp ring 650 is axially bolted to main body lock 660, with the axial load generated from the bolted connection being transferred into a clamp ring load shoulder 651 provided on clamp ring 650, to a main body extension load shoulder 648 provided on main body extension 640, and in turn reacted between a main body extension lock surface 649 and an upper housing lock surface 153 provided on main body assembly 150, which engagement allows main body extension 640 to tractionally resist torsional loads that may be generated by latch release mechanism 198. Thus arranged, main body extension 640 can first be assembled onto main body assembly 150 and rotationally positioned, and then clamp ring 650 can be secured, effectively rigidly connecting main body extension 640 to main body assembly 150.

As shown in FIG. 17B, a plurality of primary trigger dog teeth 602, each comprising a primary trigger dog tooth load flank 603, a primary trigger dog tooth crest 604, and a primary trigger dog tooth lock flank 605, may be provided on a downward-facing primary trigger reaction surface 615 on primary trigger 600, with a corresponding plurality of mating reaction dog pockets 642, each defining a reaction pocket load flank 643, a reaction pocket crest 644, and a reaction pocket lock flank 645 being provided on an upward-facing dog reaction surface 646 provided on main body extension 640. In this illustrated embodiment, primary trigger dog teeth 602 initially are rotationally aligned with but axially separated from corresponding mating reaction dog pockets 642.

Figure 18A:
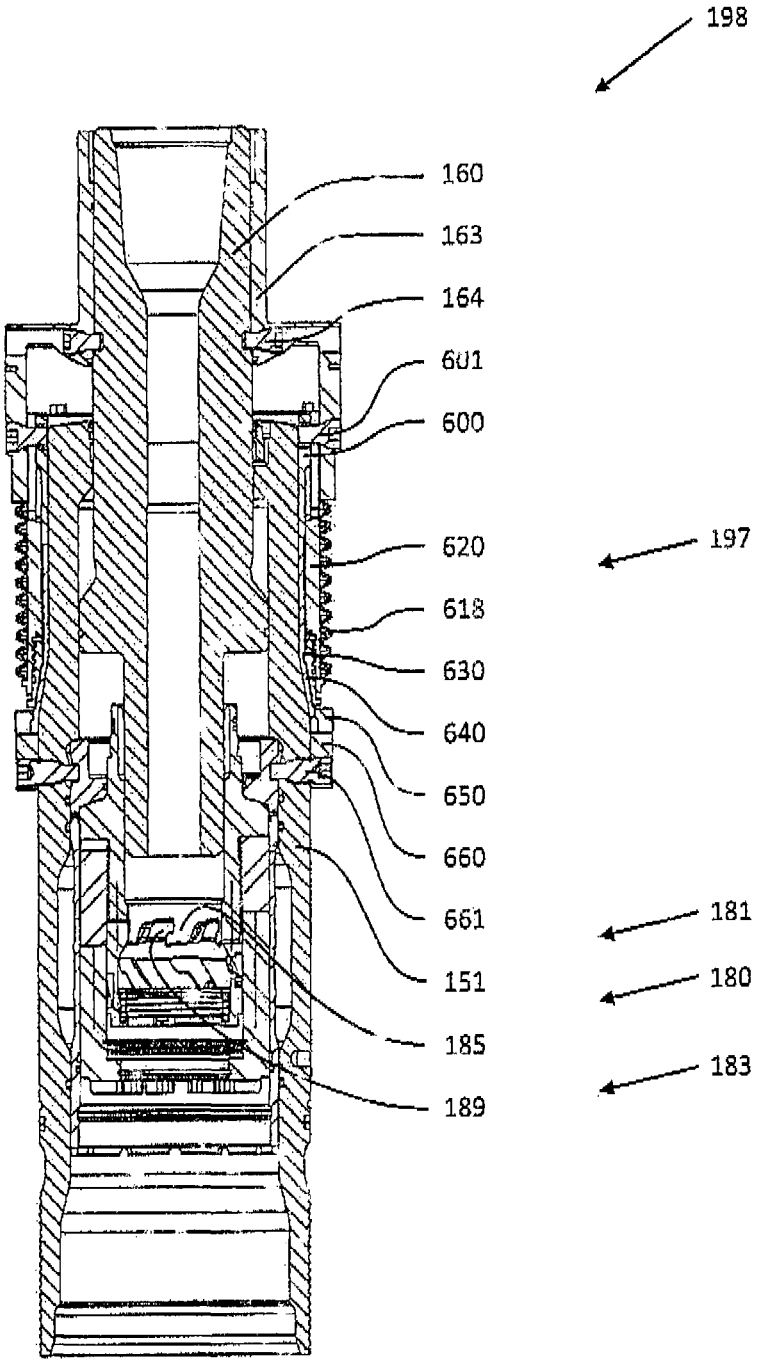
FIGS. 18A and 18B are cross-sections through the tri-cam latching linkage and latch release mechanism in FIG. 17, shown after the application of sufficient set-down and corresponding displacement to cause axially downward movement of the floating load adaptor extension.
Figure 18B:
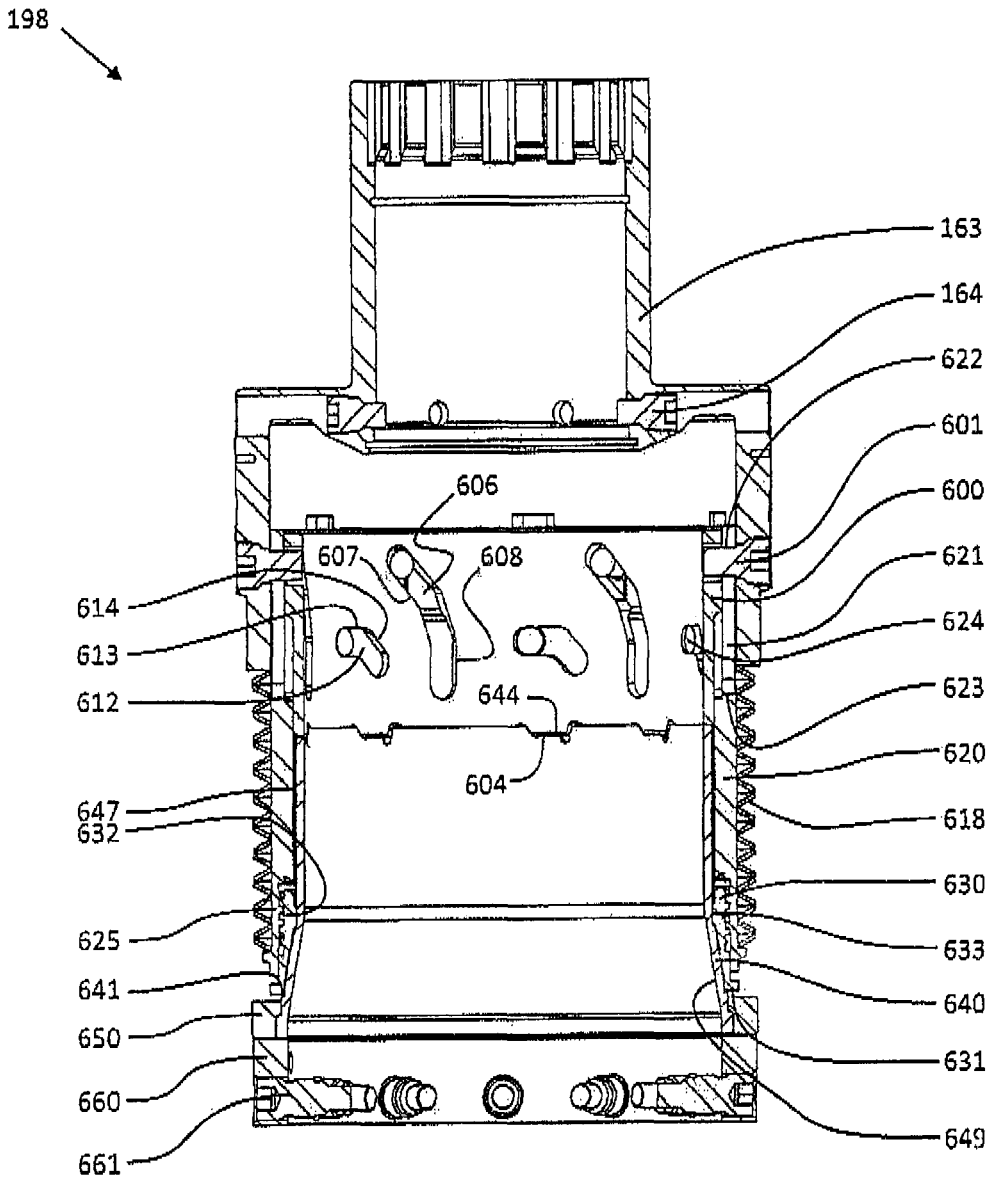

FIG. 18A is a sectional view of CRTe 197, and FIG. 18B is a sectional view of latch release mechanism 198, both shown after contact between tubular workpiece 101 and bumper 171 has been established and sufficient axial set-down load and corresponding displacement have been generated to cause load adaptor extension 163, floating load adaptor lug 164, primary trigger 600, load adaptor cam follower 601, secondary trigger 620, secondary trigger cam follower 624 and secondary trigger extension 630 to translate axially downwards until primary trigger dog tooth crests 604 and their corresponding reaction pocket crests 644 initiate contact, at which point a standoff surface 631 provided on secondary trigger extension 630 is close to but not in contact with a second reaction surface 641 provided on main body extension 640.

Figure 19A:
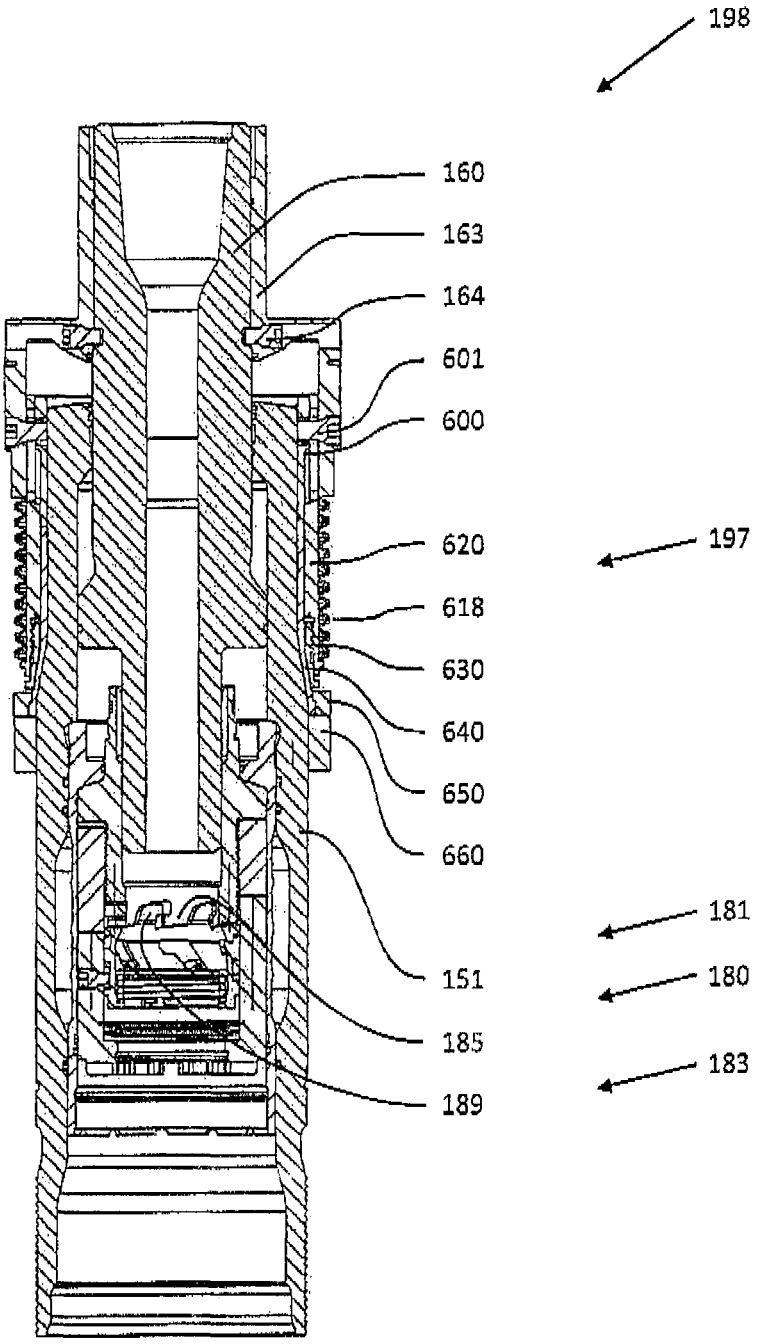
FIGS. 19A and 19B are cross-sections through the tri-cam latching linkage and latch release mechanism in FIG. 18, shown after continued application of set-down load and corresponding displacement tending to unlatch the latching linkage.
Figure 19B:
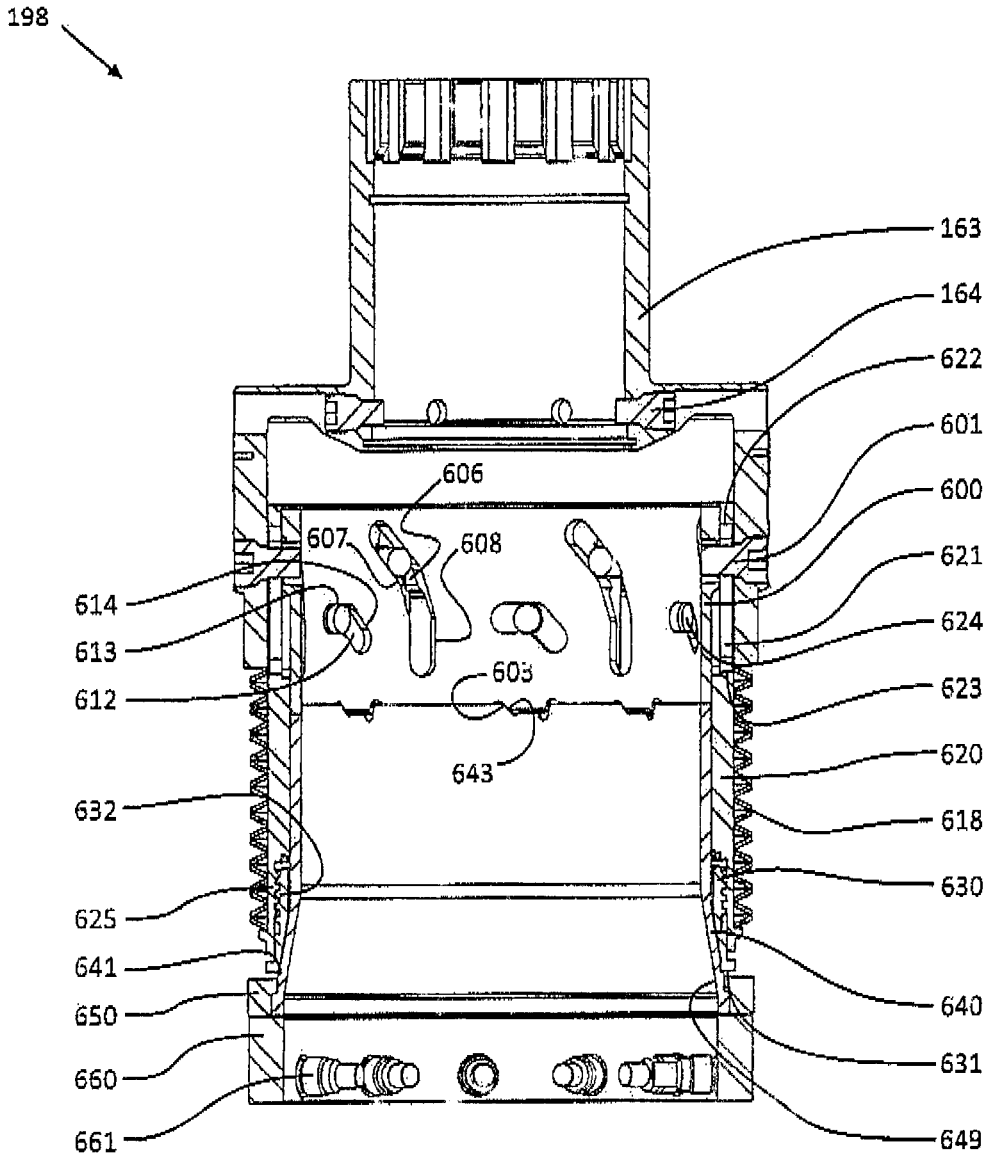

Referring to FIGS. 19A and 19B, continued set-down load and corresponding displacement will cause primary trigger 600 to begin to move axially upwards, and to rotate in the right-hand direction, tending to unlatch tri-cam latching linkage 180, as a result of the constraints imposed on primary trigger 600 by the engagement of load adaptor cam follower 601 in the upper portion 607 of primary trigger cam slot 606. This rotation causes the engagement of primary trigger dog tooth load flank 603 with reaction pocket load flank 643, producing torque on main body extension 640 in the direction tending to unlatch tri-cam latching linkage 180. The torque applied to main body extension 640 is resisted by tractional engagement between main body extension lock surface 649 and upper housing lock surface 153 and is transferred into main body assembly 150. It will now be apparent that the latch release mechanism 198 is able to generate the torque and corresponding rotation in the direction tending to unlatch the tri-cam latching linkage 180 with the application of set-down load and displacement only.

Figure 20A:
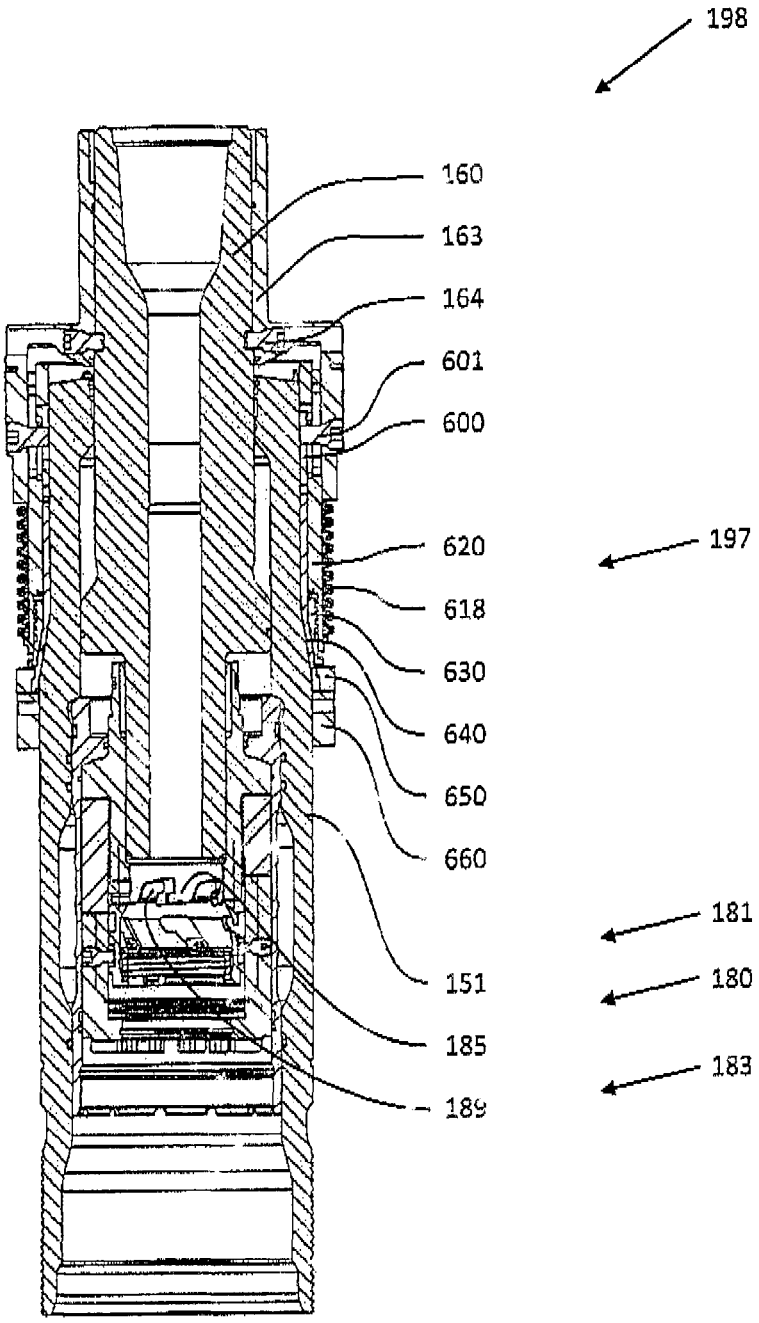
FIGS. 20A and 20B are cross-sections through the tri-cam latching linkage and latch release mechanism in FIG. 19, shown after further application of set-down load and corresponding displacement tending to disengage the trigger dog teeth from the reaction dog pockets so as to allow relative rotation between the main body assembly and the floating load adaptor.
Figure 20B:
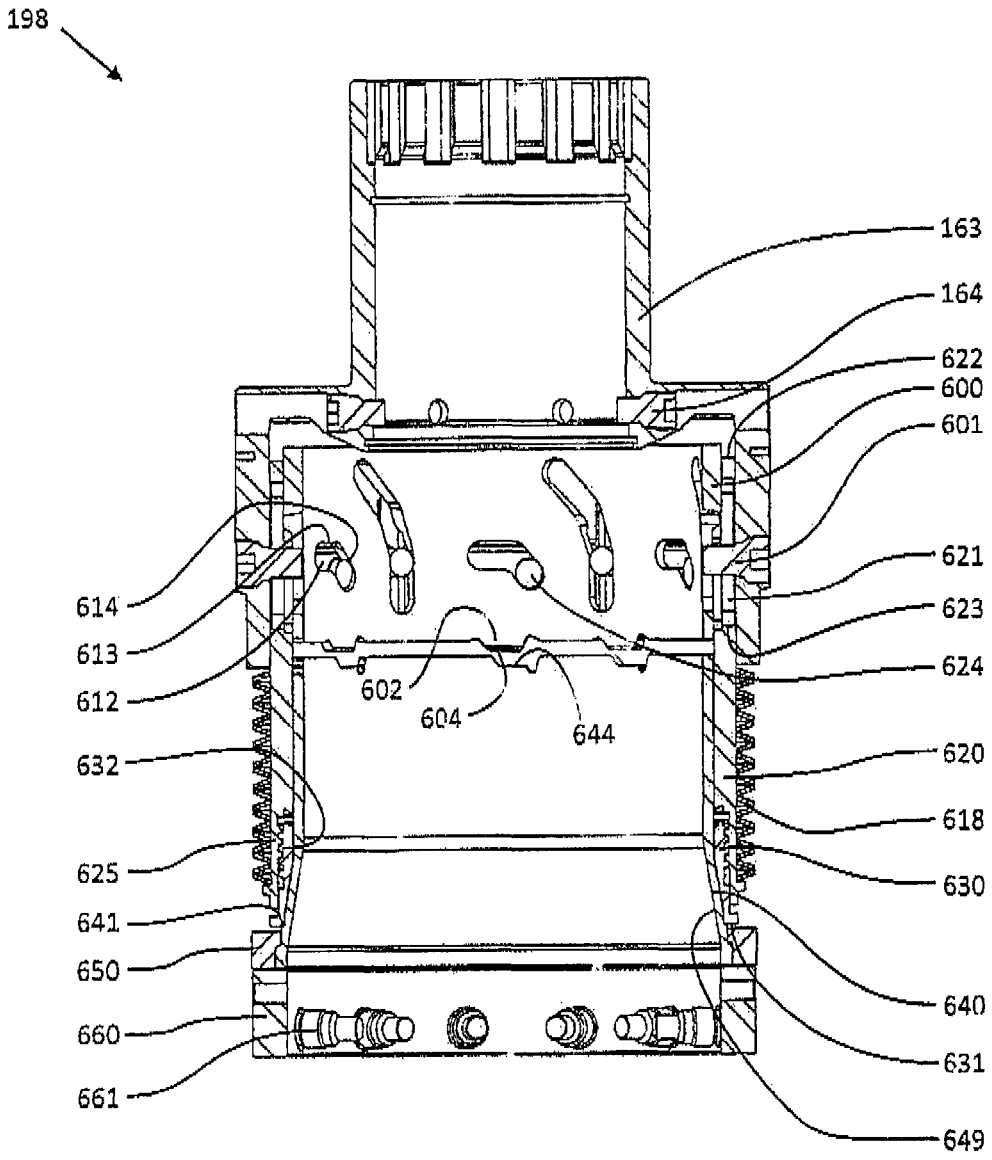

Referring now to FIGS. 20A and 20B, further set-down load and corresponding axial displacement will cause secondary trigger cam followers 624 to engage lower ends 614 of dog retraction cam slots 612. This engagement tends to move primary trigger dog teeth 602 axially upward relative to main body extension 640, transferring the axial set-down load initially reacted between primary trigger dog tooth crests 604 and reaction pocket crests 644 to be reacted between standoff surface 631 and second reaction surface 641. With sufficient set-down load and corresponding displacement, primary trigger dog teeth 602 will become completely disengaged from reaction dog pockets 642, allowing relative rotation between the main body assembly 150 and floating load adaptor 160 in either direction.

Figure 21A:
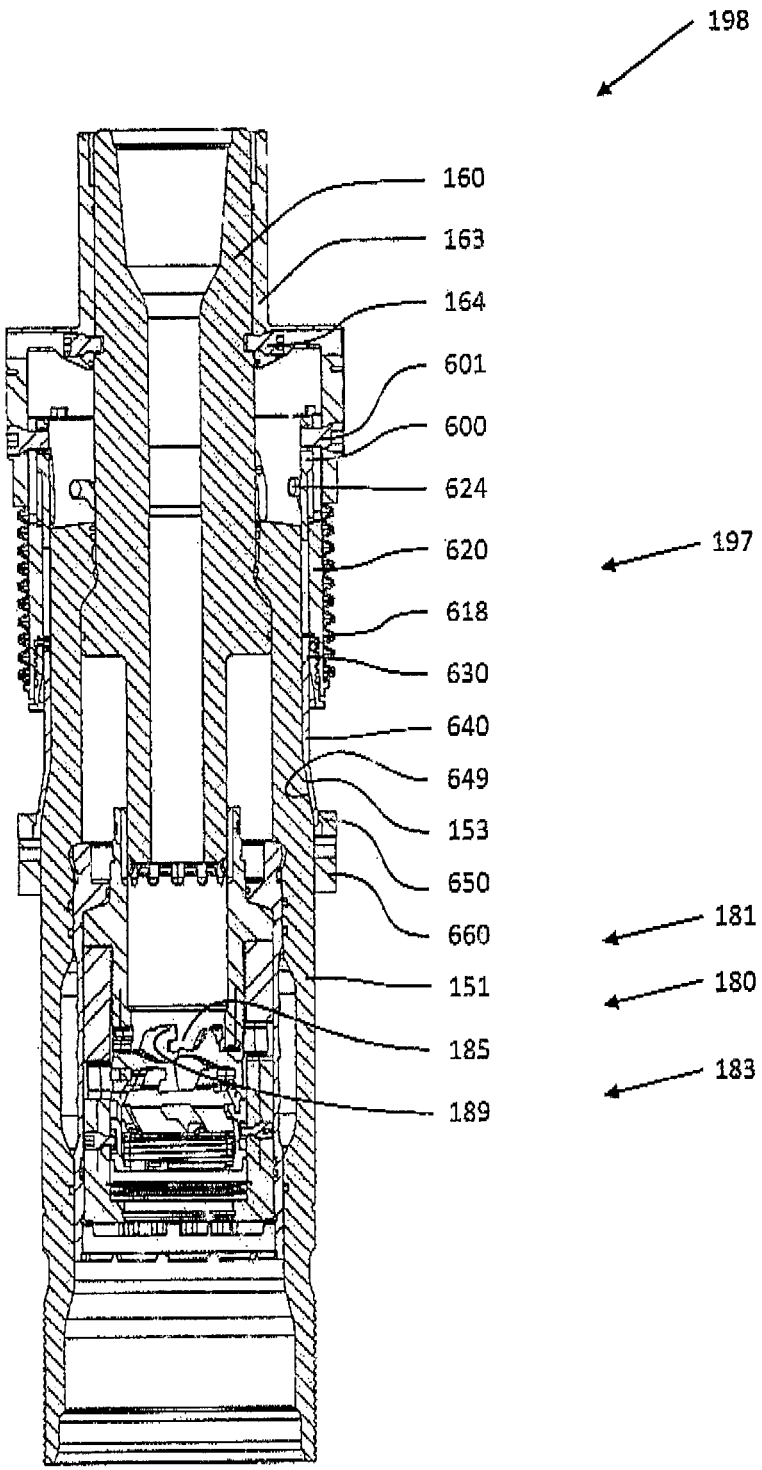
FIGS. 21A and 21B are cross-sections through the tri-cam latching linkage and latch release mechanism in FIG. 20, shown after the application of sufficient axial set-down load to unlatch the tri-cam latching linkage, with the floating load adaptor having moved upward to remove the set-down load.
Figure 21B:
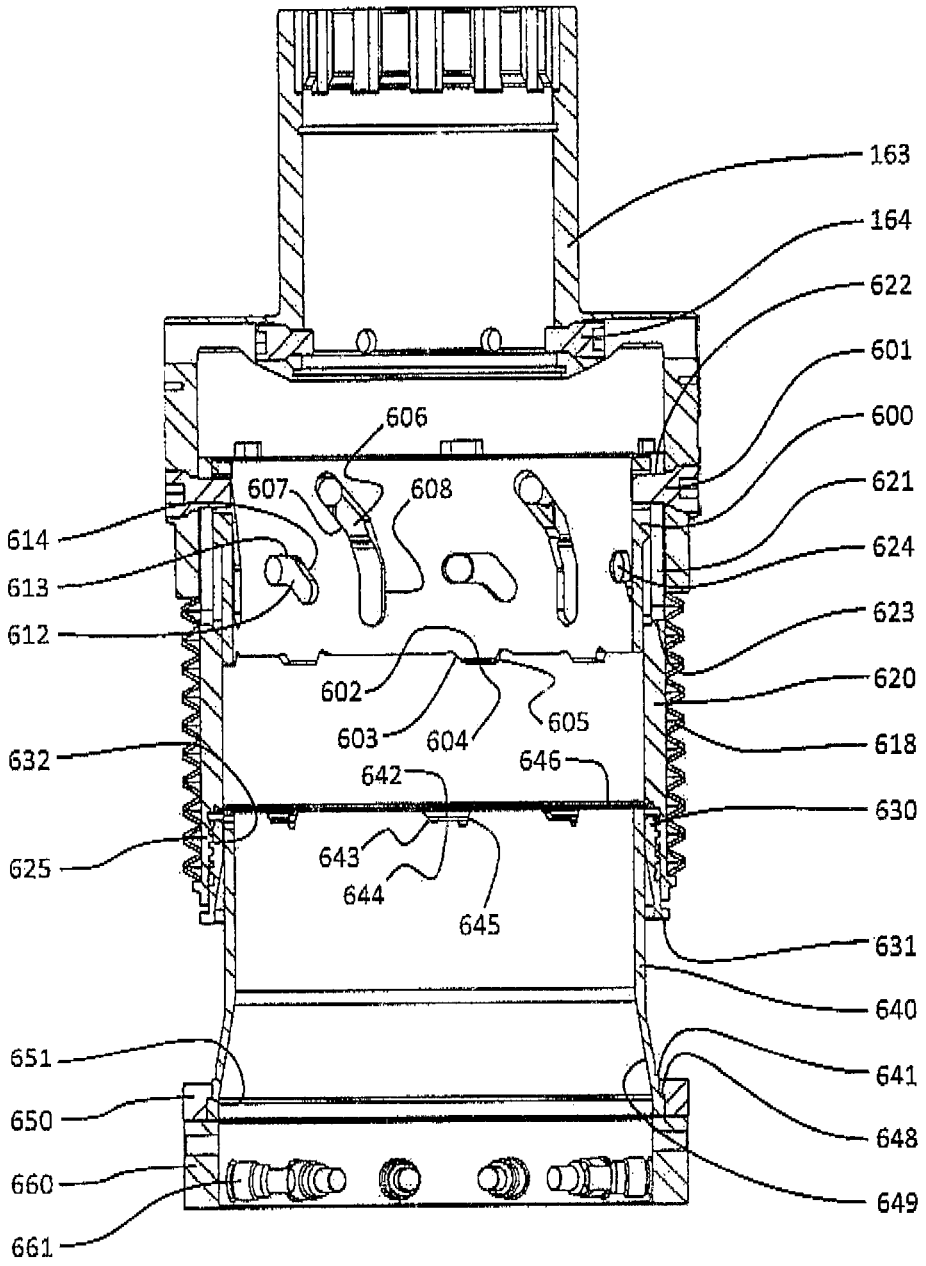
Figure 22A:
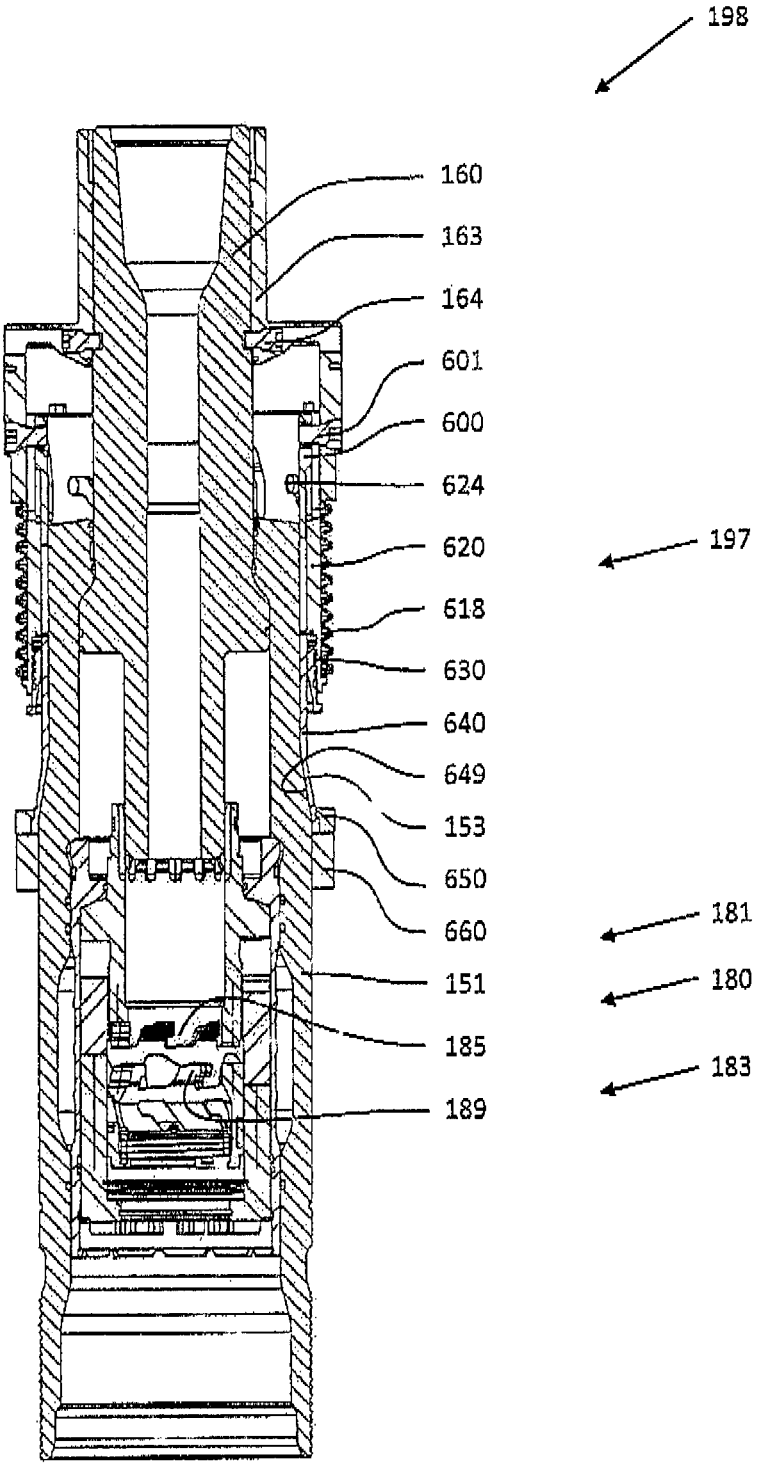
FIGS. 22A and 22B are cross-sections through the tri-cam latching linkage and latch release mechanism in FIG. 21, showing right-hand rotation of the floating load adaptor causing engagement of the standoff surface on the secondary trigger extension to move downward toward the reaction surface on the main body extension.
Figure 22B:
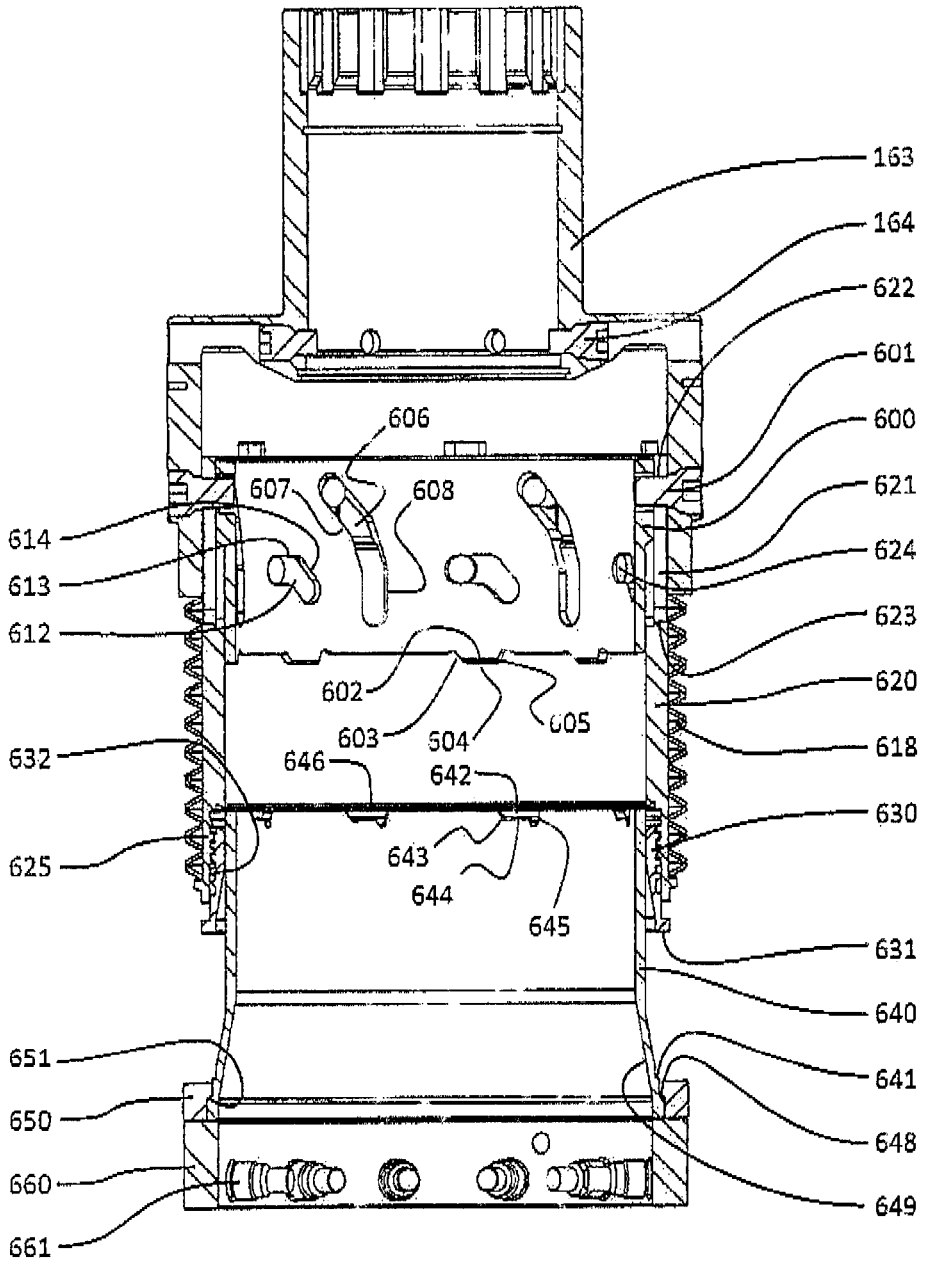

FIGS. 21A and 21B, respectively, are sectional views of CRTe 197 and latch release mechanism 198, both shown after sufficient set-down load has been applied to unlatch tri-cam latching linkage 180 whereupon floating load adaptor 160 has been moved axially upwards, removing the axial set-down load. At this point, right-hand (or left-hand) rotation can be applied to floating load adaptor 160 to make up (or break out) the casing string connection. As shown in FIGS. 22A and 22B, the application of right-hand rotation between floating load adaptor 160 and main body assembly 150 will cause standoff surface 631 to move axially downwards due to the left-hand thread formed by secondary trigger extension thread 632 and secondary trigger thread 625, which downward axial movement in turn causes standoff surface 631 to engage second reaction surface 641 at relatively higher axial positions of floating load adaptor 160.

Figure 23A:
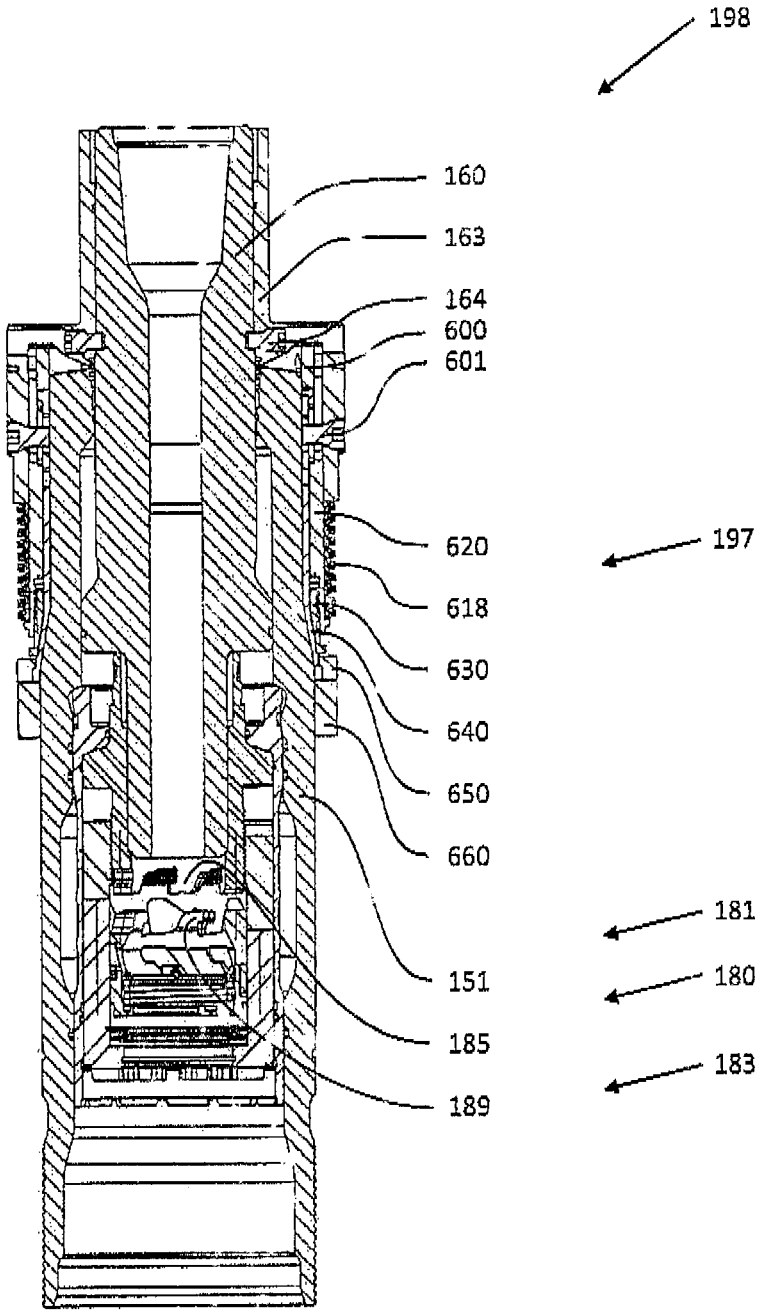
FIGS. 23A and 23B are cross-sections through the tri-cam latching linkage and latch release mechanism in FIG. 22, showing right-hand rotation applied after set-down load and corresponding displacement to disengage the trigger dog teeth from the reaction dog pockets.
Figure 23B:
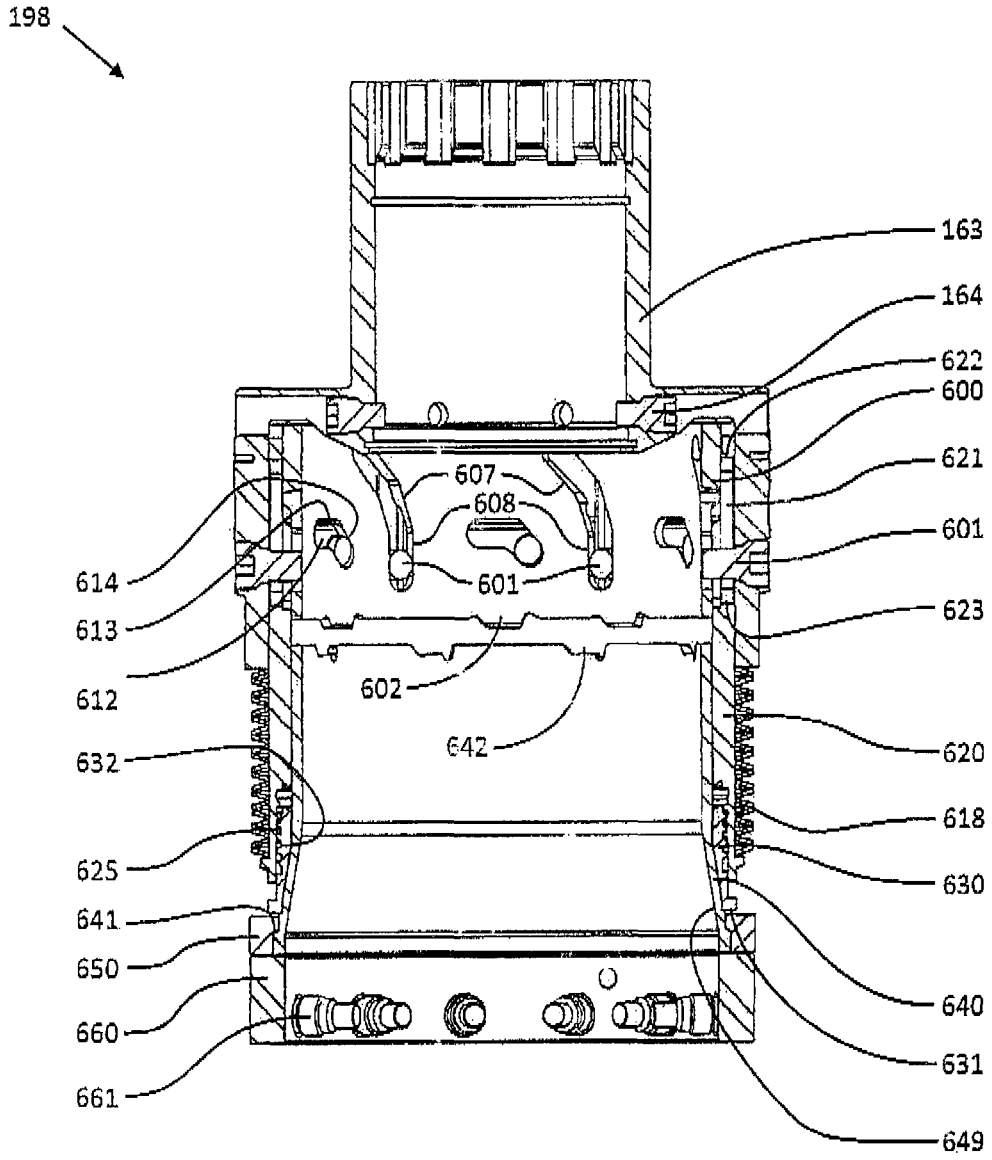

Alternatively, as shown in FIGS. 23A and 23B, right-hand rotation can be applied immediately after the axial set-down load and corresponding displacement are sufficient to disengage primary trigger dog teeth 602 from the corresponding reaction dog pockets 642, rather than moving floating load adaptor 160 axially upwards and then applying right-hand rotation. In this scenario, standoff surface 631 engages second reaction surface 641, and the application of right-hand rotation to floating load adaptor 160 will generate axially-upward force and corresponding displacement of secondary trigger 620. The axially-upward displacement of secondary trigger 620 causes load adaptor cam follower 601 to engage lower portion 608 of primary trigger cam slot 606.

Figure 24A:
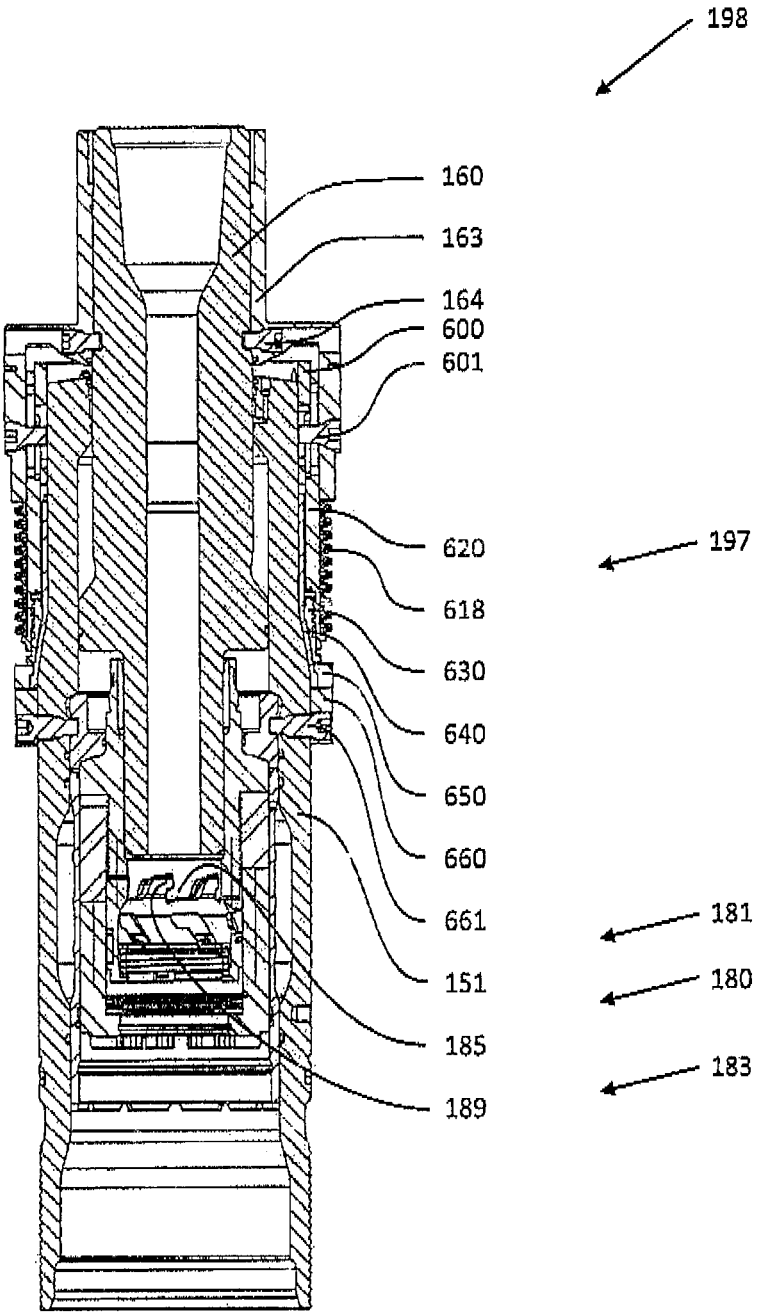
FIGS. 24A and 24B are cross-sections through the tri-cam latching linkage and latch release mechanism in FIG. 23, showing set-down load reapplied to re-latch the latching linkage.
Figure 24B:
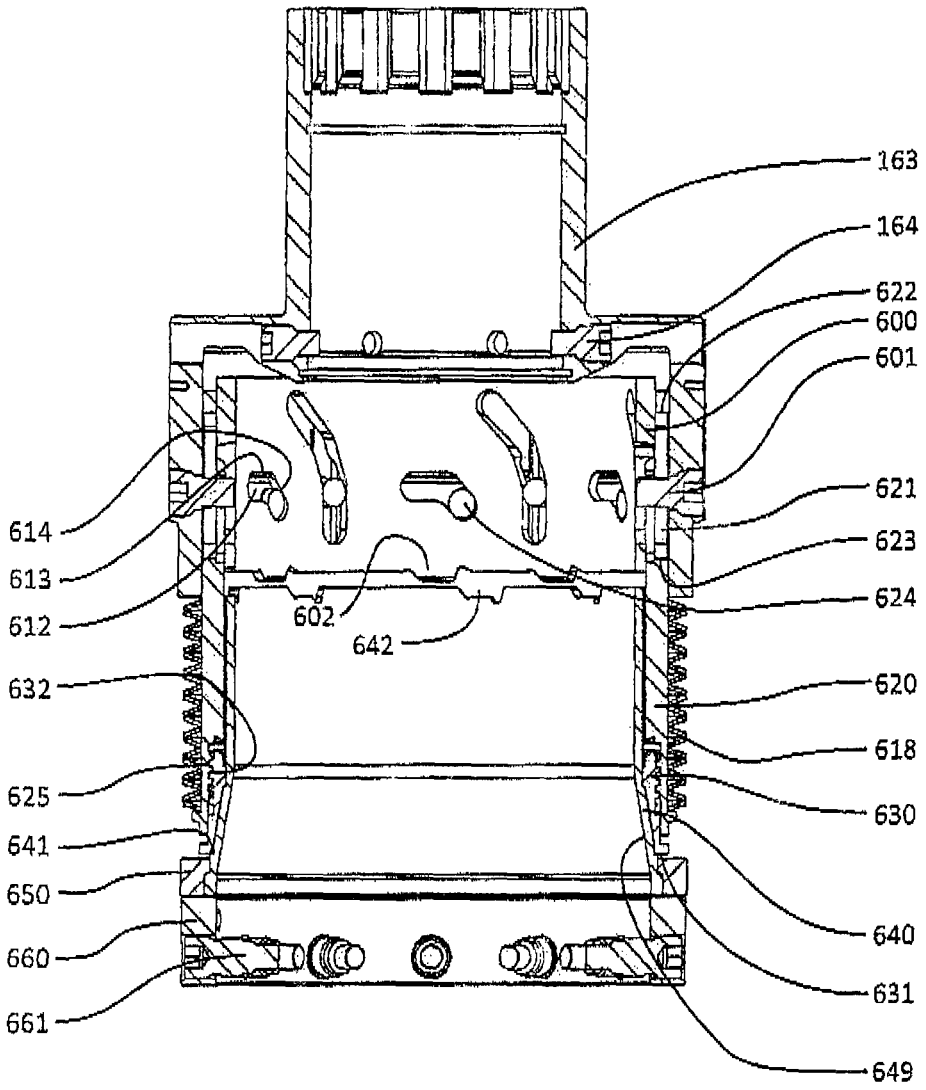

In either case, right-hand rotation will cause standoff surface 631 to move axially downward, and when set-down load is reapplied to re-latch tri-cam latching linkage 180, standoff surface 631 will engage second reaction surface 641, thereby preventing primary trigger dog teeth 602 from re-engaging reaction dog pockets 642, and thus supporting the application of torque and rotation in the left-hand direction tending to re-latch tri-cam latching linkage 180, as depicted in FIGS. 24A and 24B. With tri-cam latching linkage 180 in the latched position, grip assembly 170 will now be retracted from tubular workpiece 101, while bumper 171 is still in contact with tubular workpiece 101.

Figure 25A:
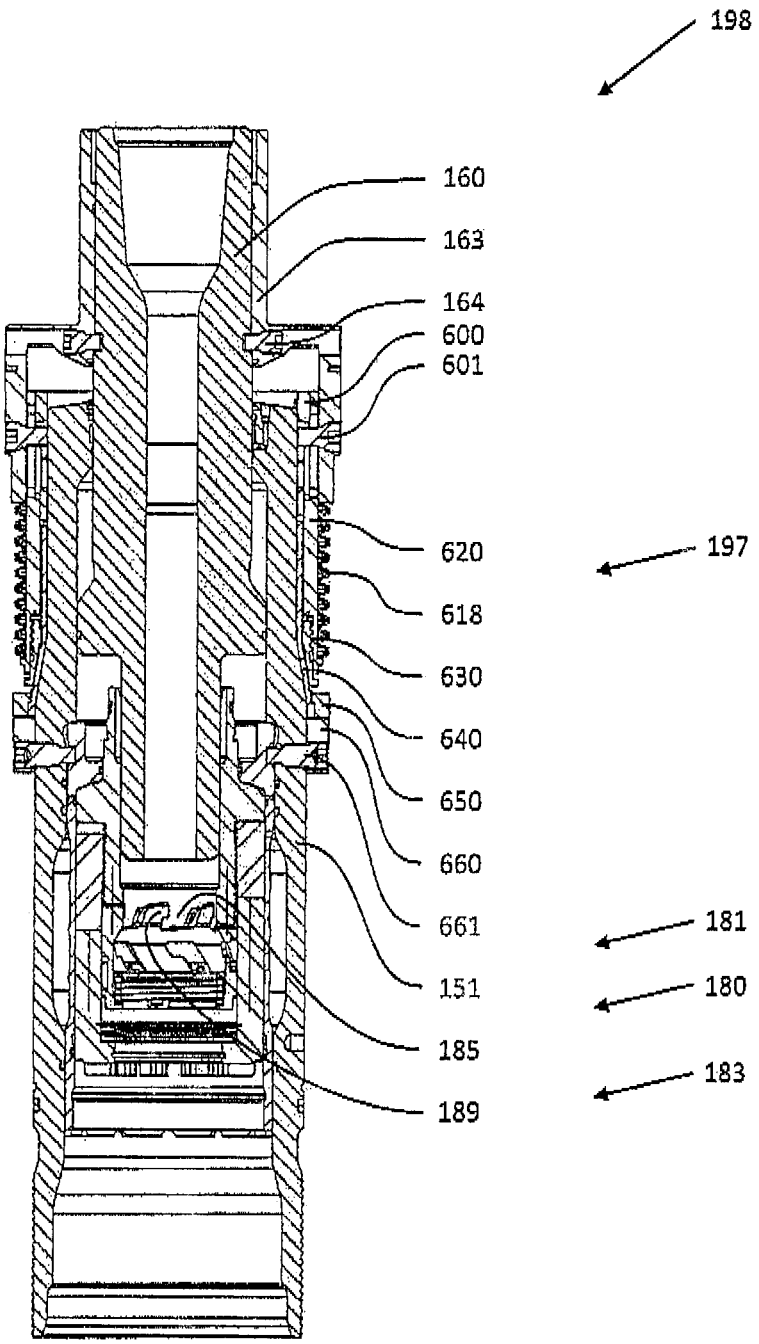
FIGS. 25A and 25B are cross-sections through the tri-cam latching linkage and latch release mechanism in FIG. 24, showing the latching linkage in the re-latched position.
Figure 25B:
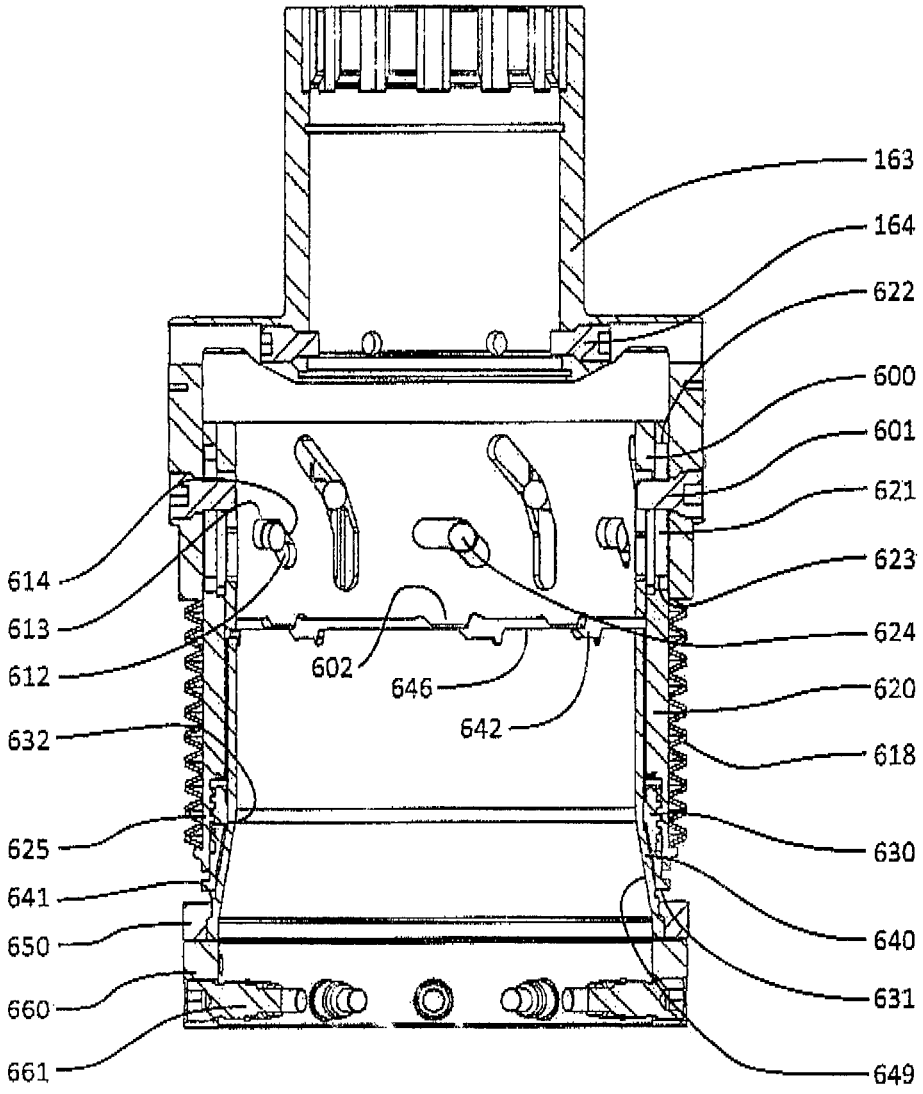

FIGS. 25A and 25B show CRTe 197 in the re-latched position. As the operational step of removing CRTe 197 from tubular workpiece 101 reduces the axial force acting on land surface 172, trigger bias spring 618 urges secondary trigger 620 downward, and correspondingly causes primary trigger 600 to rotate in the left-hand direction and to move axially downwards relative to floating load adaptor 160. However, downward movement of primary trigger 600 is impeded by sliding engagement of primary trigger dog tooth crests 604 and dog reaction surfaces 646. As floating load adaptor 160 continues to move upward, a point is reached where primary trigger dog tooth crests 604 no longer engage (i.e., they slide off) dog reaction surfaces 646, thus allowing primary trigger dog teeth 602 to re-engage reaction dog pockets 642. Further axially-upward movement of floating load adaptor 160 will leave primary trigger dog teeth 602 rotationally aligned but axially separated from reaction dog pockets 642, thus returning latch release mechanism 198 to the position shown in FIGS. 17A and 17B, from which position the operational sequence illustrated in FIGS. 17A through 25B can be repeated.

Having reference to the preceding description of the operation of latch release mechanism 198, it will be apparent to persons skilled in the art that:

- the shape of primary trigger cam slot 606 determines the relationship between relative rotational and axial motions between load adaptor extension 163 and primary trigger 600; and
- the angle from vertical of primary trigger cam slot 606 may be selected to vary along its length to coordinate the relative rotational and axial motions, and to control contact stresses and internal stresses generated as latch release mechanism 198 is actuated.

It will also be apparent to persons skilled in the art that:

- primary trigger cam slot 606 of CRTe 197 is functionally equivalent to bumper-cage cam slot 319 of the exemplary embodiment shown in FIGS. 3A to 7B, bumper-cage cam slot 461 of CRTi 130 shown in FIGS. 8B, 9B, 10B, and 11B, and cage cam slot 511 of CRTi 135 shown in FIGS. 13B and 14B; and
- as with primary trigger cam slot 606, the angle from vertical of bumper-cage cam slot 319, bumper-cage cam slot 461, and cage cam slot 511 may be selected to vary along their respective lengths to coordinate the relative rotational and axial motions, and to control contact stresses and internal stresses generated as the respective latch release mechanisms are actuated.

It will be readily appreciated by those skilled in the art that various alternative embodiments may be devised without departing from the scope of the present teachings, including modifications that may use equivalent structures or materials subsequently conceived or developed.

It is to be especially understood that it is not intended for apparatus in accordance with the present disclosure to be limited to any described or illustrated embodiment, and that the substitution of a variant of a claimed element or feature, without any substantial resultant change in the working of the apparatus and methods, will not constitute a departure from the scope of the disclosure.

In this patent document, any form of the word "comprise" is to be understood in its non-limiting sense to mean that any element or feature following such word is included, but elements or features not specifically mentioned are not excluded. A reference to an element or feature by the indefinite article "a" does not exclude the possibility that more than one of such element or feature is present, unless the context clearly requires that there be one and only one such element or feature.

Any use of any form of the terms "connect", "engage", "couple", "latch", "attach", or any other term describing an interaction between elements is not meant to limit the interaction to direct interaction between the subject elements, and may also include indirect interaction between the elements such as through secondary or intermediary structure.

Relational and conformational terms such as (but not limited to) "vertical", "horizontal", "coaxial", "cylindrical", "trapezoidal", "upward-facing", and "downward-facing" are not intended to denote or require absolute mathematical or geometrical precision. Accordingly, such terms are to be understood as denoting or requiring substantial precision only (e.g., "substantially "vertical" or "generally trapezoidal") unless the context clearly requires otherwise.

In particular, it is to be understood that any reference herein to an element as being "generally cylindrical" is intended to mean that the element in question may have inner and outer diameters that vary along the length of the element.

Wherever used in this document, the terms "typical" and "typically" are to be understood and interpreted in the sense of being representative of exemplary common usage or practice only, and are not to be understood or interpreted as implying essentiality or invariability.

LIST OF ILLUSTRATED ELEMENTS

Element Number Description

100 (prior art) CRT
101 tubular workpiece
110 body assembly
111 load adapter
112 tapered-thread connection
120 grip assembly
121 bumper
122 land surface
123 jaws
130 CRTi
131 latch release mechanism
132 tri-cam latching linkage
133 upper latch assembly
134 lower latch assembly
135 (prior art) CRTi
136 latch release mechanism
140 (prior art) CRTe
150 main body assembly
151 main body upper housing
152 main body lower housing
153 upper housing lock surface
154 axial shoulder
160 floating load adaptor
161 upper axial shoulder
162 lower axial shoulder
163 load adaptor extension
164 lug
165 skirt
170 grip assembly
171 bumper Element Number Description

172 land surface
180 tri-cam latching linkage
181 upper latch assembly
182 axial shoulder

183 lower latch assembly
184 drive cam
185 drive cam latch hooks
186 drive cam housing
187 driven cam
188 latch cam
189 latch cam latch hooks
190 upper cam-housing seal
191 main body-housing upper seal
192 lower cam-housing seal
193 main body-housing lower seal
194 lower cam-cage seal
195 upper cam-cage seal
196 gas spring chamber
197 CRTe (with latch release mechanism)
198 latch release mechanism
201 latch release mechanism
204 trigger reaction ring
205 trigger reaction dog pocket
206 reaction pocket load flank
207 reaction pocket crest
208 reaction pocket lock flank
210 trigger element
211 trigger dog tooth/teeth
212 trigger dog tooth load flank
213 trigger dog tooth crest
214 trigger dog tooth lock flank
218 movable bumper Element Number Description

220 movable land surface
222 cage extension
301 upper latch assembly
302 upper rotary latch receiver
303 internal upper cam ramp surface
304 internal lower cam ramp surface
305 internal biasing spring
310 lower latch assembly
312 lower rotary latch hook
314 bumper-trigger cam follower
315 bumper-trigger cam slot
316 (bumper-trigger cam slot) upper end
317 (bumper-trigger cam slot) lower end
318 bumper-cage cam follower
319 bumper-cage cam slot
320 (bumper-cage cam slot) upper end
321 (bumper-cage cam slot) lower end
322 trigger-cage cam follower
324 trigger-cage cam pocket
326 trigger bias spring
330 trigger advance cam surface
332 trigger withdraw cam surface
334 trigger re-latch cam surface
336 trigger reset cam surface
400 drive cam body
401 drive cam latch hooks
402 load threads
403 drive cam body-housing seal
404 drive cam body-mandrel seal
410 trigger reaction ring
411 trigger reaction dog pocket
412 reaction pocket load flank Element Number Description

413 reaction pocket crest
414 reaction pocket lock flank
420 drive cam housing
421 drive housing-driven housing seal
422 gas spring chamber
430 intermediate cam body
431 load threads
440 trigger element
441 trigger dog tooth/teeth
442 trigger dog tooth load flank
443 trigger dog tooth crest
444 trigger dog tooth lock flank
445 trigger cam slot
446 (trigger cam slot) upper end
447 (trigger cam slot) lower end
448 trigger cam follower
449 trigger bias spring
450 movable bumper
451 movable land surface
452 bumper cam follower
460 cage extension
461 bumper-cage cam slot
462 (bumper-cage cam slot) upper end
463 (bumper-cage cam slot) lower end
464 cage cam pocket
466 advance cam surface
467 withdraw cam surface
469 reset cam surface
470 driven cam body
472 drive cam body-cage seal
480 driven cam housing
490 latch cam Element Number Description

491 latch cam latch hooks
500 cage
501 cage mandrel seal
510 cage extension
511 cage cam slot
512 (cage cam slot) upper end
513 (cage cam slot) lower end
520 trigger bias spring
600 primary trigger (alternatively referred to as primary trigger element)
601 load adapter cam follower
602 primary trigger dog tooth/teeth
603 primary trigger dog tooth load flank
604 primary trigger dog tooth crest
605 primary trigger dog tooth lock flank
606 primary trigger cam slot
607 (primary trigger cam slot) upper portion
608 (primary trigger cam slot) lower portion
612 dog retraction cam slot
613 (dog retraction cam slot) upper end
614 (dog retraction cam slot) lower end
615 downward-facing primary trigger reaction surface
618 trigger bias spring
620 secondary trigger (alternatively referred to as secondary trigger element)
621 secondary trigger cam slot
622 (secondary trigger cam slot) upper end
623 (secondary trigger cam slot) lower end
624 secondary trigger cam follower
625 secondary trigger thread
630 secondary trigger extension
631 standoff surface (lower end of secondary trigger extension)
632 secondary trigger extension thread Element Number Description

633 secondary trigger extension lug
640 main body extension
641 second reaction surface
642 reaction dog pocket
643 reaction pocket load flank
644 reaction pocket crest
645 reaction pocket lock flank
646 dog reaction surface (alternatively referred to as first reaction surface)
647 axially-oriented slots
648 main body extension load shoulder
649 main body extension lock surface
650 clamp ring
651 clamp ring load shoulder
660 main body lock
661 main body lock lugs Embodiments in which an exclusive property or privilege is claimed are defined as follows:

1. A latch release mechanism acting between:

(a) a generally cylindrical main body having a main body bore; and (b) a generally cylindrical load adaptor coaxially disposed within the main body bore and both axially and rotatably movable therein, with a lower end of the load adaptor being operatively engageable with an axial-load-actuated latching linkage disposed within the main body;

wherein the latch release mechanism comprises:

(c) a generally cylindrical load adaptor extension coaxially mounted to an upper region of the load adaptor and having a lower portion forming a skirt defining a first annular space between the load adaptor extension and an outer cylindrical surface of the load adaptor;

(d) a primary trigger element having a primary trigger bore, wherein:

an upper portion of the primary trigger element is coaxially disposed within said first annular space, and is mounted to and carried by the skirt so as to be axially and rotationally movable relative to the skirt within defined constraints;

a lower portion of the primary trigger element extends over an upper region of the main body and is axially movable relative thereto; and the primary trigger element carries a downward-facing primary trigger reaction surface;

(e) a secondary trigger element coaxially disposed within a secondary annular space defined by the skirt and the primary trigger, wherein:

the secondary trigger element is mounted to and carried by the skirt so as to be axially movable, within defined constraints, relative to the skirt, but non-rotatable relative to the skirt; and the secondary trigger element is coupled to the primary trigger element so as to be axially and rotationally movable relative to the primary trigger element within defined constraints;

(f) a secondary trigger extension having a secondary trigger extension bore and being coaxially mounted to a lower end of the secondary trigger element;

(g) a main body extension coaxially and fixedly mounted to an outer cylindrical surface of the main body, said main body extension having a cylindrical upper portion coaxially disposed within the secondary trigger extension bore, wherein:

the inner and outer diameters of the cylindrical upper portion of the main body extension substantially correspond to the inner and outer diameters of the primary trigger element;

the cylindrical upper portion of the main body extension defines an upward-facing first reaction surface configured for mating engagement with the primary trigger reaction surface;

an external shoulder defining a second reaction surface is provided on a lower region of the main body extension;

the main body extension is axially movable relative to, and is co-rotatable with, the secondary trigger extension; and the lower end of the secondary trigger extension is configured to be engageable with the second reaction surface;

wherein the primary and secondary trigger elements are configured such that axial compressive load applied to the load adaptor will be reacted by contact and engagement of the first reaction surface with the primary trigger reaction surface and by contact and engagement of the second reaction surface with the lower end of the secondary trigger extension, causing corresponding axial displacement between the load adaptor and the main body, thereby inducing rotation and axial movement of the secondary trigger element relative to the primary trigger element, thus generating torque and corresponding rotation to unlatch the latching linkage.

2. A latch release mechanism as in claim 1 wherein a plurality of primary trigger dog teeth, each comprising a primary trigger dog tooth load flank, a primary trigger dog tooth crest, and a primary trigger dog tooth lock flank, are provided on the primary trigger reaction surface, with a corresponding plurality of mating reaction dog pockets, each defining a reaction pocket load flank, a reaction pocket crest, and a reaction pocket lock flank, being provided on the first reaction surface.

3. A latch mechanism having a longitudinal axis and comprising:

(a) an upper latch assembly and a lower latch assembly, said upper and lower latch assemblies being coaxially aligned, and wherein:

(a.1) an upper latch component is carried on and rotationally coupled to the upper latch assembly;

(a.2) a lower latch component is carried on and rotationally coupled to the lower latch assembly;

(a.3) the upper and lower latch components are movable between:

a latched position, in which relative axial separation of the upper and lower latch assemblies is constrained by mating engagement of the upper and lower latch components; and an unlatched position, in which the upper and lower latch components are disengaged and relative axial separation of the upper and lower latch assemblies is permitted within a defined range;

in response to relative rotation and associated torque between the upper and lower rotary latch assemblies in a first rotational direction; and (b) a latch release mechanism carrying an axially-movable land element and having actuation means for inducing relative rotation and an associated latch actuation torque sufficient to move the upper and lower latch components from the latched position to the unlatched position in response to axial movement of the land element resulting from axial force externally applied to the land element.

4. A latch mechanism as in claim 3, wherein the actuation means comprises:

(a) means for coupling the land element to a selected one of the upper latch assembly and the lower latch assembly, whereby when the land element moves axially relative to the selected latch assembly, the land element will also rotate relative to the selected latch assembly;

(b) means for engaging the non-selected latch assembly with a workpiece to provide resistance to relative rotation; and (c) means for axially moving the workpiece to engage the land element and axially move the land element relative to the selected latch assembly, whereby:

(c.1) engagement of the workpiece with the land element will provide resistance to relative rotation that is at least equal to the latch actuation torque; and (c.2) rotation of the land element resulting from the axial movement of the land element relative to the selected latch assembly and urged by the workpiece will be at least equal to the relative rotation required to move the upper and lower latch components from the latched position to the unlatched position.

5. A latch mechanism as in claim 3, wherein:

(a) the lower latch assembly is carried by a generally cylindrical main body having a main body bore;

(b) the lower latch assembly is coupled to the main body so as to be axially movable with the main body when the latch mechanism is in the latched position, and axially movable relative to the main body over a selected range of motion when the latch mechanism is in the unlatched position;

(c) the upper latch assembly comprises a generally cylindrical load adaptor that is coaxially disposed within the main body bore and both axially and rotatably movable therein;

(d) the upper latch component is axially carried by the main body and rotationally coupled to the load adaptor;

(e) the movable land element is axially movable relative to the load adaptor and is carried by and axially and rotationally coupled to the lower latch assembly;

(f) the latch release mechanism is configured to act between the load adaptor, which is rotationally coupled to the upper latch component, and the main body, which is rotationally coupled to the lower latch assembly and the lower latch component; and (g) the latch release mechanism comprises:

(g.1) a first reaction surface carried by a selected one of the main body and the load adaptor;

(g.2) a second reaction surface rigidly carried by the selected one of the main body and the load adaptor;

(g.3) a primary trigger element carried by and coupled to the non-selected one of the main body and the load adaptor, and having a primary trigger reaction surface configured for engagement with the first reaction surface;

(g.4) a secondary trigger element carried by and coupled to the non-selected one of the main body and the load adaptor; and (g.5) a standoff surface carried by the secondary trigger element and configured to be engageable with the second reaction surface;

wherein the actuation means comprises:

(h) means for coupling the primary and secondary trigger elements to each other and to the selected one of the main body and the load adaptor, whereby axial movement of the secondary trigger element and the standoff surface relative to the non-selected one of the main body and the load adaptor will urge rotation of the primary trigger element and the primary trigger reaction surface relative to the non-selected one of the main body and the load adaptor; and (i) means for axially moving a workpiece to engage the land element so as to axially move the land element and the main body relative to the load adaptor, whereby:

(i.1) the primary trigger reaction surface will engage the first reaction surface;

(i.2) the standoff surface will engage the second reaction surface; and (i.3) the standoff surface will axially stroke to urge sufficient relative rotation between the load adapter and the main body to move the upper and lower latch components from the latched position to the unlatched position.

6. A latch mechanism as in claim 5, wherein:

(a) the primary trigger reaction surface comprises one or more primary trigger dog teeth;

(b) the first reaction surface comprises one or more reaction dog pockets; and (c) the one or more primary trigger dog teeth are matingly engageable with the one or more reaction dog pockets.

7. A latch mechanism as in claim 3, wherein the latch release mechanism further comprises a biasing means for biasing the land element to resist axial movement and thereby increasing the axial force required to actuate the release mechanism and move the upper and lower latch components from the latched position to the unlatched position.

* * * * *